US009555278B2

(12) United States Patent
Kaye et al.

(10) Patent No.: US 9,555,278 B2
(45) Date of Patent: Jan. 31, 2017

(54) STRENGTH TRAINING AND STRETCHING SYSTEM AND RESISTANCE BAND ASSEMBLY FOR USE THEREWITH

(71) Applicant: ARQEX OUTDOOR FITNESS SYSTEMS, LLC, Rye Brook, NY (US)

(72) Inventors: Eric A. Kaye, Rye Brook, NY (US); William C. Cesaroni, Glenview, IL (US); Morad Ghassemian, Oak Park, IL (US); Brian W. Mathews, Waterman, IL (US); Eugene L. DiMonte, Aurora, IL (US); Donovan D. Zielke, Laguna Nigel, CA (US); Steven M. Lenz, Naperville, IL (US)

(73) Assignee: ARQFX OUTDOOR FITNESS SYSTEMS, LLC, Rye Brook, NY (US)

( * ) Notice: Subject to any disclaimer, the term of this patent is extended or adjusted under 35 U.S.C. 154(b) by 0 days.

(21) Appl. No.: 14/598,290

(22) Filed: Jan. 16, 2015

(65) Prior Publication Data

US 2015/0133276 A1 May 14, 2015

Related U.S. Application Data

(63) Continuation-in-part of application No. 13/836,359, filed on Mar. 15, 2013.

(Continued)

(51) Int. Cl.

*A63B 21/04* (2006.01)
*A63B 21/055* (2006.01)

(Continued)

(52) U.S. Cl.

CPC ..... *A63B 21/0442* (2013.01); *A63B 21/00069* (2013.01); *A63B 21/055* (2013.01);

(Continued)

(58) Field of Classification Search

CPC ..... A63B 21/4035; A63B 21/4043; A63B 21/0442; A63B 21/02; A63B 21/0407; A63B 21/05; A63B 21/0552; A63B 21/00069; A63B 21/0557; A63B 21/055; A63B 21/0555; A63B 21/00058; A63B 21/00061; A63B 21/00065; A63B 23/1218; A63B 23/03508; A63B 23/03541; A63B 23/1209; A63B 23/006; A63B 2023/006; A63B 5/02; A63B 5/20

See application file for complete search history.

(56) References Cited

U.S. PATENT DOCUMENTS

| | | | |
|---|---|---|---|
| 163,957 | A | 6/1875 | Wood |
| 652,617 | A | 6/1900 | Hotz |

(Continued)

FOREIGN PATENT DOCUMENTS

| | | |
|---|---|---|
| DE | 20305669 | 10/2003 |
| DE | 102010051083 | 8/2011 |
| WO | 2014/036123 | 3/2014 |

OTHER PUBLICATIONS

"Bollinger Fitness 3-in-1 Adjustable Resistance Band", www.kmart.com, http://www.kmart.com/bollinger-fitness-3-in-1-adjustable-resistance-band/p080V006270873000P, 1 page, accessed Oct. 15, 2013.

(Continued)

*Primary Examiner* — Loan H Thanh
*Assistant Examiner* — Megan Anderson
(74) *Attorney, Agent, or Firm* — Tarter Krinsky & Drogin LLP

(57) ABSTRACT

A fitness station and resistance band assembly and a method of using the same. The station includes a base; a support extending upwardly from the base; a first arm extending outwardly from the support; and a plurality of attachment (Continued)

members provided on one or more of the base, the support or the first arm. The assembly is selectively engageable with one of the attachment members and is operable to apply a resistive force during a performance of an exercise. The assembly includes a housing that is at least partially rigid and a first resilient member for providing the resistive force located within the housing. The assembly is attached to one of the attachment members on the fitness station. A pulling motion is applied to the assembly during the performance of an exercise. A resistive force is generated within the assembly in response to the applied pulling motion.

23 Claims, 40 Drawing Sheets

Related U.S. Application Data

(60) Provisional application No. 61/931,842, filed on Jan. 27, 2014, provisional application No. 61/931,887, filed on Jan. 27, 2014, provisional application No. 61/938,331, filed on Feb. 11, 2014.

(51) Int. Cl.

| | |
|---|---|
| ***A63B 23/035*** | (2006.01) |
| ***A63B 23/12*** | (2006.01) |
| ***A63B 21/00*** | (2006.01) |
| *A63B 23/00* | (2006.01) |

(52) U.S. Cl.

CPC ..... *A63B 21/0557* (2013.01); *A63B 21/4035* (2015.10); *A63B 21/4043* (2015.10); *A63B 23/03508* (2013.01); *A63B 23/03541* (2013.01); *A63B 23/1209* (2013.01); *A63B 23/1218* (2013.01); *A63B 2023/006* (2013.01)

(56) References Cited

U.S. PATENT DOCUMENTS 1,539,569 A 5/1925 Hubert
1,633,124 A 6/1927 Noe
1,729,399 A 9/1929 Noe
1,749,544 A 3/1930 Pagano
2,930,614 A 3/1960 McIntosh
3,345,067 A 10/1967 Smith
3,528,656 A 9/1970 Haanen
3,598,406 A 8/1971 Robinson
3,680,858 A 8/1972 Ossenkop et al.
3,759,514 A 9/1973 Cox
3,815,904 A 6/1974 Weiss et al.
4,057,246 A 11/1977 Wilson
4,373,716 A 2/1983 Pagani
4,620,701 A 11/1986 Mojden
4,685,670 A 8/1987 Zinkin
5,011,139 A 4/1991 Towley
5,039,092 A 8/1991 Olschansky
5,090,694 A 2/1992 Pauls et al.
5,112,287 A 5/1992 Brewer
5,205,803 A * 4/1993 Zemitis ..... A63B 21/0552 482/121
5,211,617 A 5/1993 Millen
5,269,737 A 12/1993 Sobotka
5,288,074 A 2/1994 Scheurer
5,431,610 A 7/1995 Miller
5,431,617 A 7/1995 Rattray, Jr.
5,496,246 A 3/1996 Pierre
5,626,546 A 5/1997 Little
5,700,232 A 12/1997 Clausen et al.
5,800,322 A 9/1998 Block
5,839,997 A 11/1998 Roth et al.
5,876,313 A 3/1999 Krull
5,885,196 A * 3/1999 Gvoich ..... A63B 21/0004 482/122
5,997,448 A 12/1999 Duba
6,015,371 A 1/2000 Davitt
6,033,350 A 3/2000 Krull
6,099,442 A 8/2000 Krull
6,142,919 A 11/2000 Jorgensen
6,186,927 B1 2/2001 Krull
6,202,263 B1 3/2001 Harker
6,238,324 B1 5/2001 MacMillan
6,322,481 B1 11/2001 Krull
6,322,483 B1 11/2001 Rotella
6,402,666 B2 6/2002 Krull
6,416,446 B1 7/2002 Krull
6,422,979 B1 7/2002 Krull
6,554,747 B1 4/2003 Rempe
6,561,956 B1 5/2003 Allison
6,626,801 B2 9/2003 Marques
6,629,910 B1 10/2003 Krull
6,669,606 B2 12/2003 Krull
6,676,576 B1 * 1/2004 Wu ..... A63B 21/0004 482/126
6,679,816 B1 1/2004 Krull
6,733,424 B2 5/2004 Krull
6,746,381 B2 6/2004 Krull
6,749,547 B2 6/2004 Krull
6,872,173 B2 3/2005 Krull
6,899,661 B1 5/2005 Krull
6,902,515 B2 6/2005 Howell et al.
6,902,516 B2 6/2005 Krull
6,908,418 B2 6/2005 Saure
6,974,405 B2 12/2005 Krull
7,032,529 B2 4/2006 Sanford
7,037,246 B2 5/2006 Kim
7,041,041 B1 5/2006 Evans
7,060,011 B1 6/2006 Krull
7,121,988 B2 10/2006 Walkerdine
7,128,697 B1 10/2006 Krull
7,153,243 B1 12/2006 Krull
7,192,390 B2 3/2007 Berard
7,192,391 B2 3/2007 Kim
7,229,392 B2 6/2007 Turnbull et al.
7,250,022 B2 7/2007 Dalebout et al.
7,264,578 B1 9/2007 Krull
7,331,909 B2 2/2008 Middleton
7,377,886 B2 5/2008 Wu
7,429,236 B2 9/2008 Dalebout et al.
7,455,632 B2 11/2008 Block et al.
7,497,814 B1 3/2009 Krull
7,510,539 B2 3/2009 Katane et al.
7,547,268 B1 6/2009 Krull
7,553,265 B2 6/2009 Crawford et al.
7,572,212 B2 8/2009 Cassidy et al.
7,578,775 B2 8/2009 Terry
7,588,520 B2 9/2009 Nalley
7,611,450 B2 11/2009 Mancini
7,621,856 B1 11/2009 Keith et al.
7,625,325 B1 12/2009 Yost
7,632,221 B1 12/2009 Kolander
7,662,074 B2 2/2010 Webb
7,736,286 B2 6/2010 Panaiotov
7,740,568 B2 6/2010 Webb
7,766,804 B2 8/2010 Placencia
7,775,949 B2 8/2010 Bowser
7,785,242 B2 8/2010 Solomon
7,785,243 B2 8/2010 Kassel
7,794,373 B2 9/2010 Crawford et al.
7,794,374 B1 9/2010 Park
7,798,945 B2 9/2010 Ko
7,798,946 B2 9/2010 Dalebout et al.
7,819,787 B2 10/2010 Kassel
D626,609 S 11/2010 Grider
7,857,739 B2 12/2010 Caldwell
7,878,954 B2 2/2011 McBride et al.
7,878,955 B1 2/2011 Ehrlich et al.
7,878,956 B2 2/2011 Kadar et al.
7,892,155 B2 2/2011 Pearson et al.
7,914,426 B1 * 3/2011 Lie ..... A63B 23/12 482/121

(56) References Cited

U.S. PATENT DOCUMENTS

| | | | | |
|---|---|---|---|---|
| 7,922,635 | B2 | 4/2011 | Lull et al. | |
| D639,355 | S | 6/2011 | Kassel | |
| D639,356 | S | 6/2011 | Kassel | |
| D644,700 | S | 9/2011 | Kassel | |
| D645,919 | S | 9/2011 | Kassel et al. | |
| 8,016,729 | B2 | 9/2011 | Webb | |
| 8,021,286 | B2 | 9/2011 | Suiter | |
| 8,033,960 | B1 | 10/2011 | Dalebout et al. | |
| 8,057,371 | B2 | 11/2011 | McBride et al. | |
| 8,109,864 | B2 | 2/2012 | Tseng | |
| 8,137,248 | B1 | 3/2012 | Krull | |
| 8,152,703 | B1 | 4/2012 | Hinds | |
| 8,246,524 | B2 | 8/2012 | Castillo | |
| 8,272,996 | B2 | 9/2012 | Weier | |
| 8,273,001 | B2 | 9/2012 | Karecki et al. | |
| 8,287,438 | B2 | 10/2012 | Krull | |
| 8,303,472 | B2 | 11/2012 | Bowser | |
| 8,317,660 | B2 | 11/2012 | Goranson | |
| 8,317,667 | B1 * | 11/2012 | Thomas | A63B 21/0555 482/121 |
| 8,485,946 | B2 | 7/2013 | Ross et al. | |
| 8,491,446 | B2 * | 7/2013 | Hinds | A63B 21/0055 482/126 |
| 8,496,567 | B2 | 7/2013 | Mayaud | |
| 8,499,383 | B1 | 8/2013 | Ungaro | |
| 8,602,950 | B2 * | 12/2013 | Savarino | A63B 21/023 267/179 |
| 8,602,951 | B2 | 12/2013 | Morris | |
| 8,602,952 | B1 | 12/2013 | Cruz | |
| 8,657,727 | B1 | 2/2014 | Kassel et al. | |
| 8,690,741 | B2 | 4/2014 | Ross et al. | |
| 8,696,529 | B2 | 4/2014 | Krull | |
| 8,821,359 | B1 | 9/2014 | Kassel | |
| 8,870,722 | B2 | 10/2014 | Kassel | |
| 8,905,905 | B2 | 12/2014 | Mangalindan | |
| 2003/0017918 | A1 | 1/2003 | Webb et al. | |
| 2003/0232707 | A1 | 12/2003 | Dalebout et al. | |
| 2004/0009854 | A1 | 1/2004 | Shiang et al. | |
| 2005/0043150 | A1 | 2/2005 | Nitta et al. | |
| 2005/0049121 | A1 | 3/2005 | Dalebout et al. | |
| 2005/0113219 | A1 | 5/2005 | Pierre, II | |
| 2005/0130814 | A1 | 6/2005 | Nitta et al. | |
| 2005/0272577 | A1 | 12/2005 | Olson et al. | |
| 2006/0035768 | A1 | 2/2006 | Kowallis et al. | |
| 2006/0128540 | A1 | 6/2006 | Engle | |
| 2007/0207903 | A1 | 9/2007 | Csabai | |
| 2007/0207904 | A1 | 9/2007 | Wu | |
| 2009/0137371 | A1 | 5/2009 | Fuller | |
| 2009/0176634 | A1 | 7/2009 | Wu | |
| 2009/0215594 | A1 | 8/2009 | Panaiotov | |
| 2010/0016132 | A1 | 1/2010 | Flynn | |
| 2010/0048368 | A1 | 2/2010 | Donofrio | |
| 2010/0137113 | A1 * | 6/2010 | Marethouse | A63B 23/0405 482/107 |
| 2010/0331152 | A1 | 12/2010 | Pedrera | |
| 2011/0124476 | A1 | 5/2011 | Holley | |
| 2011/0237410 | A1 | 9/2011 | Perez | |
| 2011/0269604 | A1 | 11/2011 | Tseng | |
| 2012/0058864 | A1 | 3/2012 | Mizrachy | |
| 2012/0214651 | A1 | 8/2012 | Ross | |
| 2013/0184127 | A1 * | 7/2013 | Eddy | A63B 21/002 482/91 |
| 2013/0225371 | A1 | 8/2013 | Harrer et al. | |
| 2013/0225372 | A1 | 8/2013 | Rochford | |
| 2013/0225376 | A1 | 8/2013 | Kinsbourne et al. | |
| 2014/0066274 | A1 | 3/2014 | Kassel | |
| 2014/0221177 | A1 | 8/2014 | Reed | |
| 2015/0251039 | A1 * | 9/2015 | Mikulski | A63B 21/0442 482/126 |

OTHER PUBLICATIONS

"SKLZ Quick Change Resistance Band System", www.amazon.com, http://www.amazon.com/SKLZ-QuickchangeResistanceSystem/dp/B00C81JUSM, 8 pages, accessed Oct. 15, 2013.

"Lifeline USA TNT Special Triple Resistance Cable", www.amazon.com, http://www.amazon.com/Lifeline-Special-Triple-Resistance-Cable/dp/B00069CP26/ref=pd_sbs_sg_3/189-4395354-1488107, 7 pages, accessed Oct. 15, 2013.

"Resistance Bands", http://bandresistance.com, 4 pages, accessed Oct. 15, 2013.

Triletics Cardio Bands https://www.triletics.com/product/triletics-cardio-bands-resistance-trainer-double, 10 pages.

* cited by examiner

| | | | |
|---|---|---|---|
| FIG-2A | FIG-2B | FIG-2C | FIG-2D |

STRENGTH TRAINING AND STRETCHING SYSTEM AND RESISTANCE BAND ASSEMBLY FOR USE THEREWITH

CROSS REFERENCE TO RELATED APPLICATIONS

This application is a Continuation-in-Part of U.S. patent application Ser. No. 13/836,359, filed Mar. 15, 2013, the entire specification of which is incorporated herein by reference. This application also claims the benefit of U.S. Provisional Application Ser. No. 61/931,842 filed on Jan. 27, 2014; U.S. Provisional Application Ser. No. 61/931,887 filed on Jan. 27, 2014, and of U.S. Provisional Application Ser. No. 61/938,331 filed on Feb. 11, 2014, the entire specifications of which are incorporated herein by reference.

BACKGROUND OF THE INVENTION

Technical Field

This invention relates generally to exercise equipment. More particularly, this invention is directed to customizable and ergonomically designed exercise equipment used for strength training and stretching. Most specifically, this invention is directed to a fitness station that may be installed in a commercial gym, a home gym, or in an outdoor exercise area and a detachable resistance band assembly for use therewith. The fitness station allows a user to conveniently and effectively perform and track with precision a variety of different exercises that engage multiple muscle groups using the resistance band assembly. The resistance band assembly is selectively engageable with one of a plurality of attachment members provided on the fitness station. The resistance band assembly may be adjusted to provide a variable resistive force to exercises performed using the fitness station.

Background Information

It is well known that in order to keep oneself healthy and active, it is necessary to incorporate exercise into one's daily routine. Many people join gyms to help them exercise on a regular basis. A typical gym will include a number of machines or large equipment systems which are dedicated to exercise one or another part of the body. The user will have to move from machine to machine in order to exercise their entire body. Most of these machines utilize weights which the user will selectively engage with the machine in order to achieve the intensity of workout that they desire. If the user is inexperienced, there is the tendency to avoid particular machines simply because it is difficult to figure out what one is supposed to do on that machine. An inexperienced user or someone who is too ambitious may inadvertently injure themselves if too much weight is applied to any particular exercise. Additionally, in busier gyms, the wait time for particular machines may be long enough that it tends to discourage people from undertaking a full exercise routine. There is therefore the tendency to pick one or two favorite machines and exercises and simply overlook the rest of the body.

Another arena that is becoming increasingly popular for people to exercise in is outdoor "exercise parks". Unlike gyms, these locations have fewer pieces of equipment for the user to use and most often there is no way to increase the intensity of the workout as the user gets fitter.

Because of the issue with weight-based equipment and the tendency of inexperienced users to accidentally injure themselves thereon, there has been a rise in the interest of using resistance bands during exercise. Resistance bands are elongated elastic or resilient member which may be stretched to greater or lesser degrees. They can be incorporated into an exercise routine for anyone from beginners through to experienced athletes.

The bands themselves may come in a variety of different lengths, diameters, wall thicknesses and different resistances and may include handles or loops at either end. The user will select the appropriate length and resistance for the exercises they wish to perform. A user may initially begin exercising with a low resistance band and progressively change to resistance bands of higher resistance as they gain strength.

During an exercise routine, the user will grasp the handles in either hand and stretch the resistance band, or they may hold part of the resistance band using one or both feet, or they may pass the resistance band around a substantially immovable object, such as a pole or a support for a piece of heavy gym equipment. They may, alternatively, anchor one end of the resistance band by tying it off to a pole or fitness equipment support.

If a person is performing a variety of different exercises it may be desirable to use a different resistance for each different exercise. Repeatedly having to swap out the resistance band for different exercises can be frustrating and time-consuming.

SUMMARY

There is still a need in the art for an improved system which helps a user to exercise a number of different parts of the body effectively and which uses resistance bands instead of weights as a way to increase the intensity of the workout as the user gets fitter.

The system disclosed herein includes a fitness station which may act as an anchor and an improved resistance band assembly for use with the fitness station. The system may be used in a gym or in an outdoor fitness area and the resistance band assembly is readily adjustable to change the resistance provided by the assembly. A user may therefore readily exercise their whole body and the system provides a way for progressively increasing the intensity of the workout.

Thus, a fitness station and a resistance band assembly for performing exercises therewith along with a method of using the same is disclosed herein.

The fitness station includes a base; a support extending upwardly from the base; a first arm extending outwardly from the support a distance vertically above the base; and a plurality of attachment members provided on one or more of the base, the support or the first arm. The resistance band assembly is selectively engageable with one of the attachment members and is operable to apply a resistive force during a performance of an exercise. The resistance band assembly includes a housing that is at least partially rigid and at least a first resilient member for providing the resistive force provided within the housing. The resistance band assembly is such that a user is able to grasp the housing thereof in a single hand and readily attach the assembly to the fitness station; even to attachment members on the fitness station that are located a distance above the user's head. The rigidity of the housing helps ensure that this easy engagement of the assembly to the fitness station is possible.

The method of using the fitness station and resistance band assembly may include attaching the resistance band assembly to one of the attachment members on the fitness station, applying a pulling motion on the resistance band assembly during the performance of an exercise therewith; and generating a resistive force within the resistance band assembly in response to the applied pulling motion.

In a first aspect, the invention may provide a resistance band assembly comprising a housing having a first end, a second end and a longitudinal axis extending therebetween; a bore defined in the housing, said bore extending from proximate the first end of the housing to proximate the second end thereof; a first attachment assembly provided at the first end of the housing; a second attachment assembly provided at the second end of the housing; a first resilient member extending through the bore from adjacent the first end of the housing to adjacent the second end thereof.

In a second aspect, the invention may provide a resistance band assembly wherein the first attachment assembly is adapted to selectively attach the first end of the housing to a workout accessory engaged by a user; and the second attachment assembly is adapted to selectively attach the first end of the housing to a piece of exercise equipment.

In a third aspect, the invention may provide a resistance band assembly wherein the housing thereof is tubular and rigid.

In a fourth aspect, the invention may provide a resistance band assembly including a housing with a first end, a second end and a longitudinal axis extending therebetween; a first disc proximate the first end defining a plurality of holes arranged in a pattern and extending through the first disc; a second disc stacked adjacent the first disc along the longitudinal axis, the second disc defining a plurality of holes arranged in a similar pattern to that of the first disc, where the holes in the second disc are axially aligned with the holes in the first disc; a connection plate proximate the second end of the housing; and a first resilient member engaged with the connection plate at a second end and extending through aligned holes in the first and second discs and being engaged with the first disc at a first end.

In a fifth aspect, the invention may provide a resistance band assembly comprising: a first end defined by a rotatable adjustment member; a second end defined by one or more hooks; a tubular housing extending longitudinally between first and second ends; a first resilient member extending between the first and second ends; wherein the first resilient member provides a first resistance level to the resistance band assembly; and a second resilient member that is selectively engageable as disposed between first and second ends; and wherein the engagement of the second resistance band provides a second resistance level to the resistance band assembly and the second resistance level is greater than the first resistance level.

In a sixth aspect the invention may provide a resistance band assembly having a housing with first and second ends and a longitudinal axis extending therebetween; a bore defined by the housing; a first resilient member having a first end and a second end; a connector disposed within the bore of the housing; a first disc disposed within the bore of the housing; wherein the first resilient member extends between the first disc and the connector; and wherein the first resilient member is selectively detachably engageable with the connector.

In a seventh aspect, the invention may provide a method of using a variable resistance band assembly including the steps of rotating an adjustment member about an assembly axis extending longitudinally through a center of a variable resistance band assembly; engaging a radially extending pin on the adjustment member to select a single disc or a plurality of discs; and moving the selected single disc or plurality of discs along the assembly axis.

In an eighth aspect, the invention may provide an exercise device comprising a housing having a first end and a second end; wherein the first end is adapted to be engaged by a user; a first hook and a second hook defining a portion of the second end of the housing; and wherein the first and second hooks are adapted to releasably attach the exercise device to a separate exercise structure.

In a ninth aspect the invention may provide a method of attaching an exercise device to an exercise structure, said method comprising the steps of providing an attachment member on the exercise structure, wherein the attachment member defines an aperture; providing an attachment assembly at one end of the exercise device; where the attachment assembly includes a top member with a first hook extending outwardly therefrom such that a first space is defined between the top member and a free end of the first hook; positioning the attachment member in the first space between the free end of the first hook and the top member; rotating the exercise device to engage the attachment member in a passageway defined beneath an arcuate section of the first hook and the top member; and engaging the attachment member with a concave surface of the first hook, where the concave surface is positioned opposite the top member.

In a tenth aspect, the invention may provide a method of attaching an exercise device to a separate exercise structure comprising the steps of providing an exercise device having two inverted J-hooks at one end, where the J-hooks are spaced apart and define a vertical gap between them, and further defining a transverse passageway beneath arcuate portions of the J-hooks; moving the J-hooks in a first direction to dispose a ring attached to the exercise structure in the vertical gap; rotating the J-hooks about an longitudinal axis of the exercise device; and moving the J-hooks in a second direction opposite the first direction to engage the arcuate portion of the J-hooks with the ring such that the ring extends through the transverse passageway.

In an eleventh aspect the invention may provide a method of varying a resistive force applied by exercise equipment, said method comprising providing a resistance band assembly for providing resistive force during the performance of an exercise; where the resistance band assembly includes a housing having a first end, a second end, and a longitudinal axis extending therebetween; a bore defined in the housing; a connector provided in the bore, said connector having a first surface and opposed second surface; a hole defined in the connector and extending between the first and second surfaces; a disc provided in the bore, said disc having a first surface and opposed second surface; an aperture defined in the disc and extending between the first and second surfaces of the disc, where the hole and the aperture are longitudinally aligned with each other; providing a first resilient member; providing a second resilient member; and engaging the first resilient member with the resistance band assembly to provide a first resistive force during the performance of an exercise.

In a twelfth aspect, the invention may provide a resilient member for a resistance band assembly which is used to apply resistance during the performance of an exercise; said resilient member comprising an elongate and resilient shaft having a first end and a second end; a first enlarged area provided adjacent the first end; a second enlarged area provided adjacent the second end; and a limiting element provided within the shaft and operable to limit a degree to which the shaft stretches.

In a thirteenth aspect, the invention may provide an insert for use with a resilient member in a resistance band assembly, where the resilient member includes a shaft having a first end and a second end; a base; an aperture bounded and defined by a face of the base; and a friction-reducing material provided on the face; said friction-reducing coating being adapted to contact the shaft of the resilient member when the shaft extends through the aperture.

In a fourteenth aspect, the invention may provide an insert for an exercise device comprising a disc member having a first surface, a second surface, and a side surface extending between the first and second surfaces; wherein said disc member is adapted to be inserted within the bore of a tubular housing of an exercise assembly; and an aperture defined in the disc member and extending between the first and second surfaces; said aperture being bounded and defined by a face that extends between the first and second surfaces; and wherein a friction-reducing material is provided on the face.

In a fifteenth aspect, the invention may provide an exercise device comprising a housing having a first end and a second end and a longitudinal axis extending therebetween; a bore defined in the housing and extending between the first and second ends; a disc member located within the bore and between the first and second ends thereof; said disc member having a first surface and a second surface which are oriented at right angles to the longitudinal axis of the housing; and the disc member further includes a side surface extending between the first and second surfaces, said side surface being generally parallel to the longitudinal axis; and an aperture is defined in the disc member and extends between the first and second surfaces; said aperture being bounded and defined by a face that extends between the first and second surfaces; and wherein a friction-reducing material is provided on the face; and a first resilient member extending between the first and second ends of the housing and passing through the aperture.

In a sixteenth aspect, the invention may provide an insert for an exercise device comprising a disc member having a first surface, a second surface, and a side surface extending between the first and second surfaces; wherein said disc member is adapted to be inserted within the bore of a tubular housing of an exercise assembly; an aperture defined in the disc member and extending between the first and second surfaces; said aperture being bounded and defined by a face that extends between the first and second surfaces; and wherein a friction-reducing material is provided on the face.

In a seventeenth aspect the invention may provide an exercise device for attachment to a fitness station; said exercise device comprising a housing having a first end and a second end, and having a longitudinal axis extending from the first end to the second end; a bore defined in the housing and extending from proximate the first end of the housing to proximate the second end thereof; an insert fabricated from a friction-reducing material provided within the bore of the housing; wherein the insert has a first surface and a second surface oriented at right angles to the longitudinal axis of the housing, and has a peripheral surface extending between the first and second surfaces; and a first aperture defined in the insert and extending from the first surface of the insert to the second surface thereof.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

A variable resistance exercise band assembly and a strength training and stretching system in accordance with an aspect of the present invention is depicted in FIGS. 1-46. In the following description, the variable resistance band assembly is generally referred to herein as assembly 30 and the strength training and stretching system is generally referred to herein as fitness station 510. Assembly 30 is shown in FIGS. 1-36 and fitness station 510 is shown in FIGS. 37-45. Assembly 30 is shown engaged with fitness station 510 in FIG. 46. Assembly 30 is selectively engaged with fitness station 510 in order to perform a wide variety of resistance type exercises. A pulling force is applied to a first end of assembly 30 and a resistive force is generated in response to that pulling motion by one or more resilient members 44 which are located within a housing of the assembly 30.

In the following description, the structure and operation of assembly 30 will be described in greater detail using FIGS. 1-36 as a reference. Subsequently, the structure and operation of fitness station 510 will be described in greater detail using FIGS. 37-45 as a reference. FIG. 46 will then be used to describe how assembly 30 is engaged with fitness station 510 and how the combination is then used to perform an exercise.

Figures 1, 2:
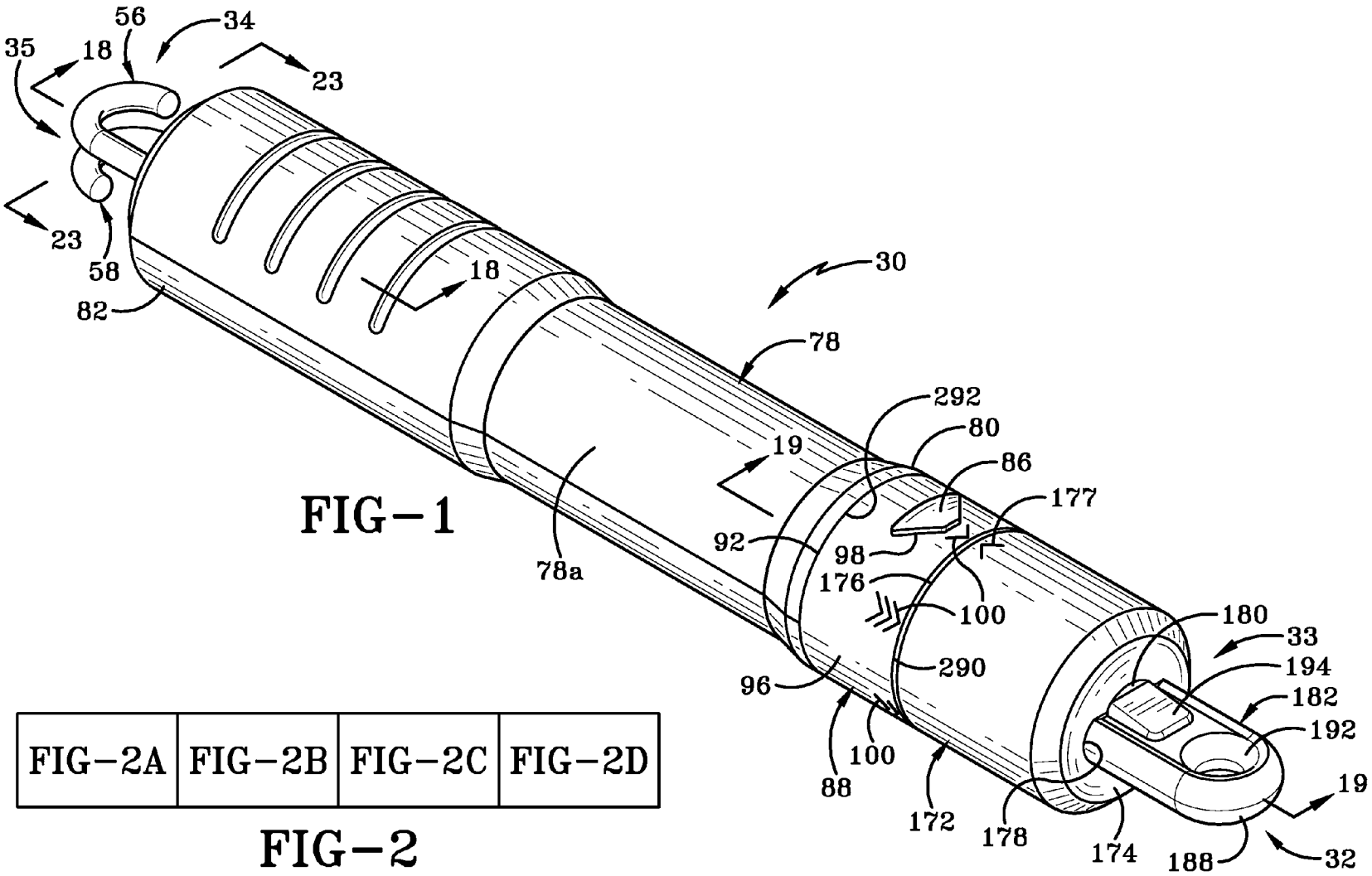
FIG. 1 is an isometric perspective view of the variable resistance exercise band assembly of the present invention.
FIG. 2 is a schematic representation indicating that elements respectively depicted in FIG. 2A, FIG. 2B, FIG. 2C, and FIG. 2D should be aligned left to right.
Figure 2A:
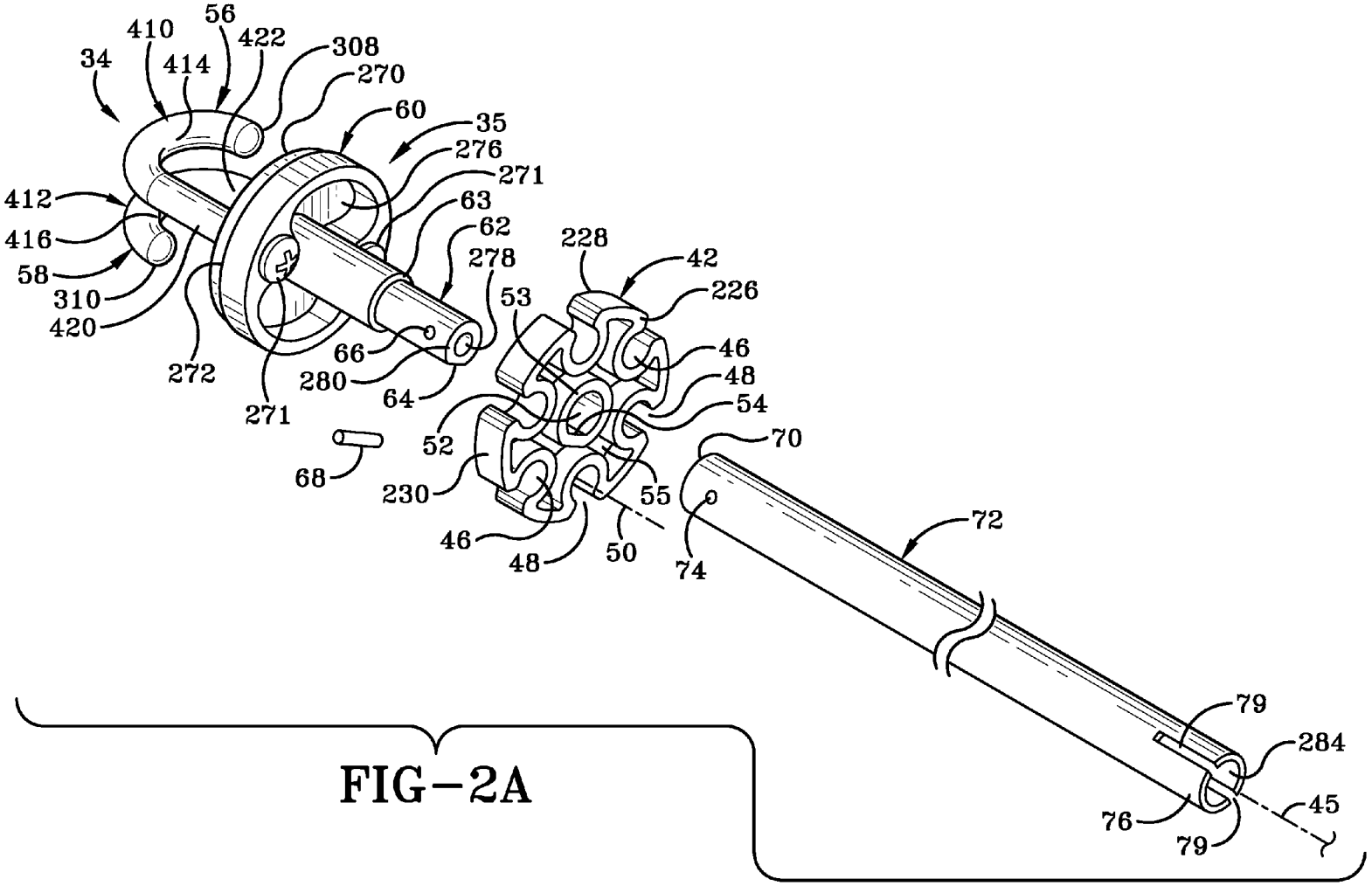
FIG. 2A is an exploded isometric view of some components of the variable resistance exercise band assembly.
Figure 3:
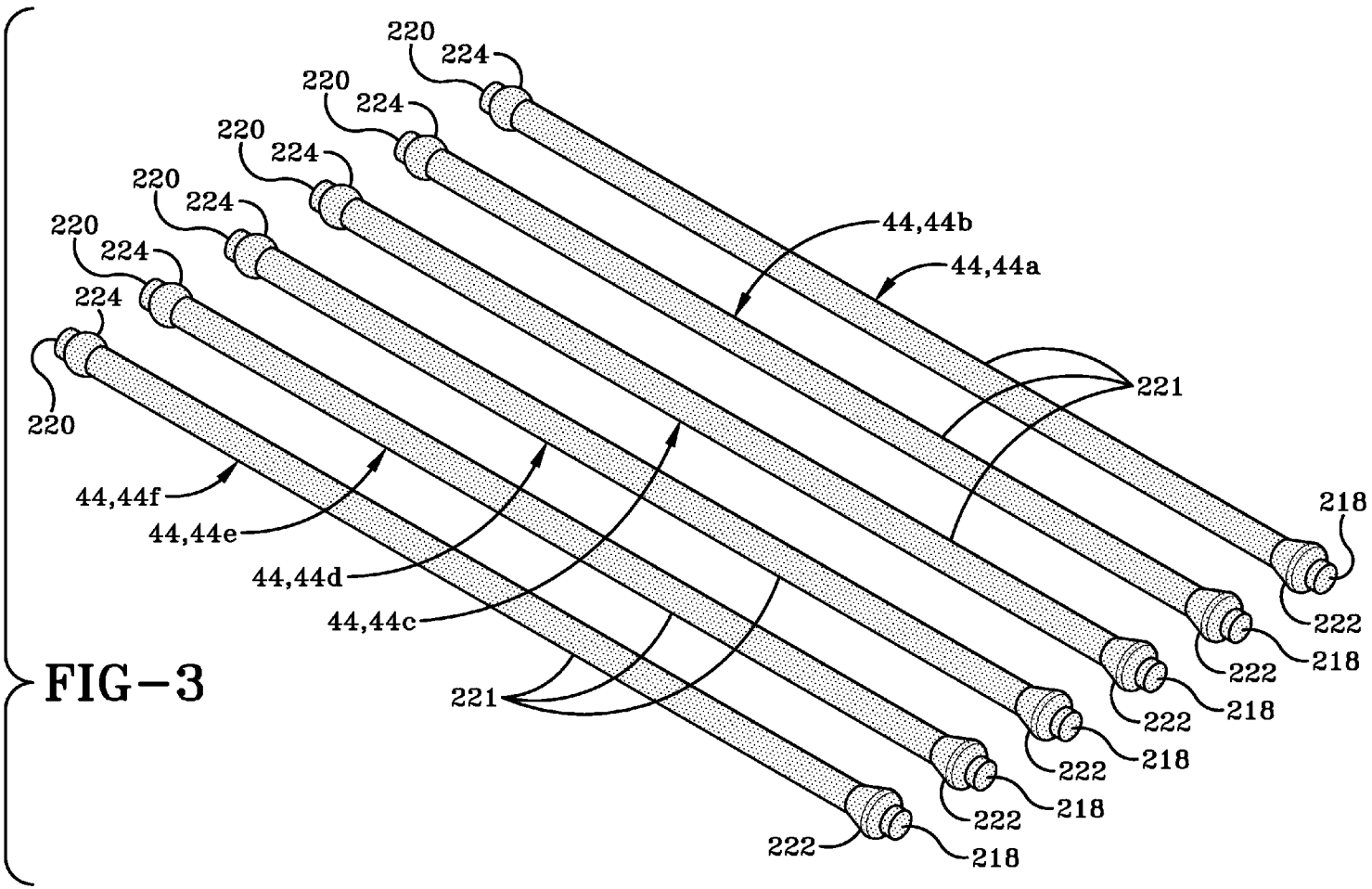
FIG. 3 is an isometric view of six resilient members or elastic bands utilized in the variable resistance exercise band assembly.
Figure 4:
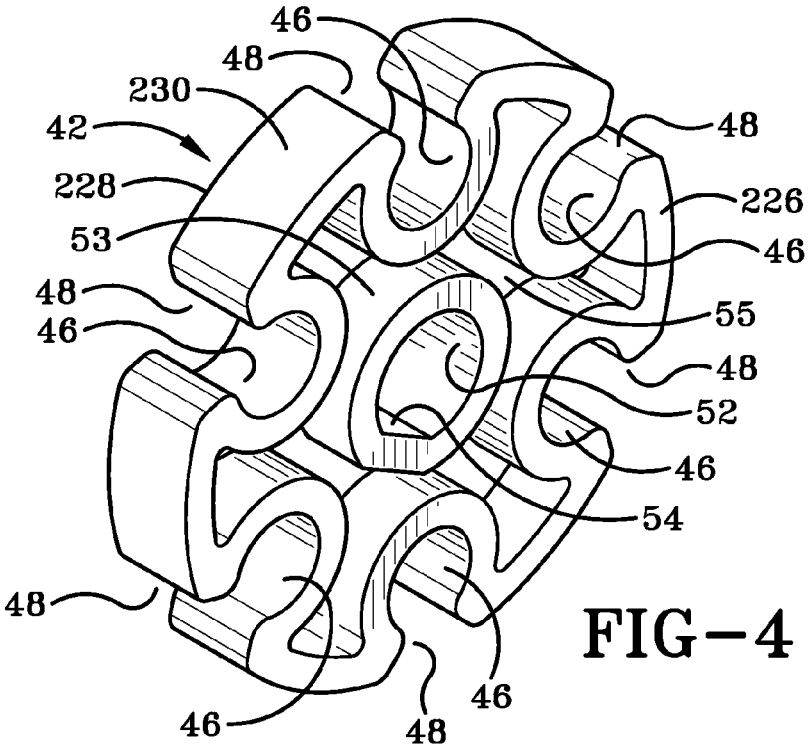
FIG. 4 is an isolated isometric view of a connection plate utilized in the variable resistance exercise band assembly.
Figure 5:
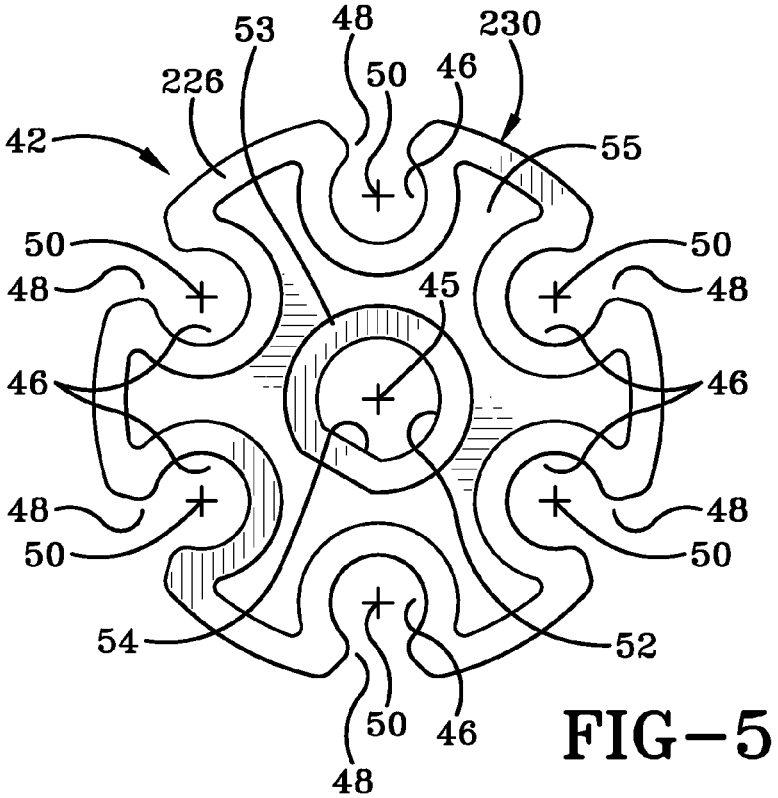
FIG. 5 is a top view of the connection plate.
Figure 6:
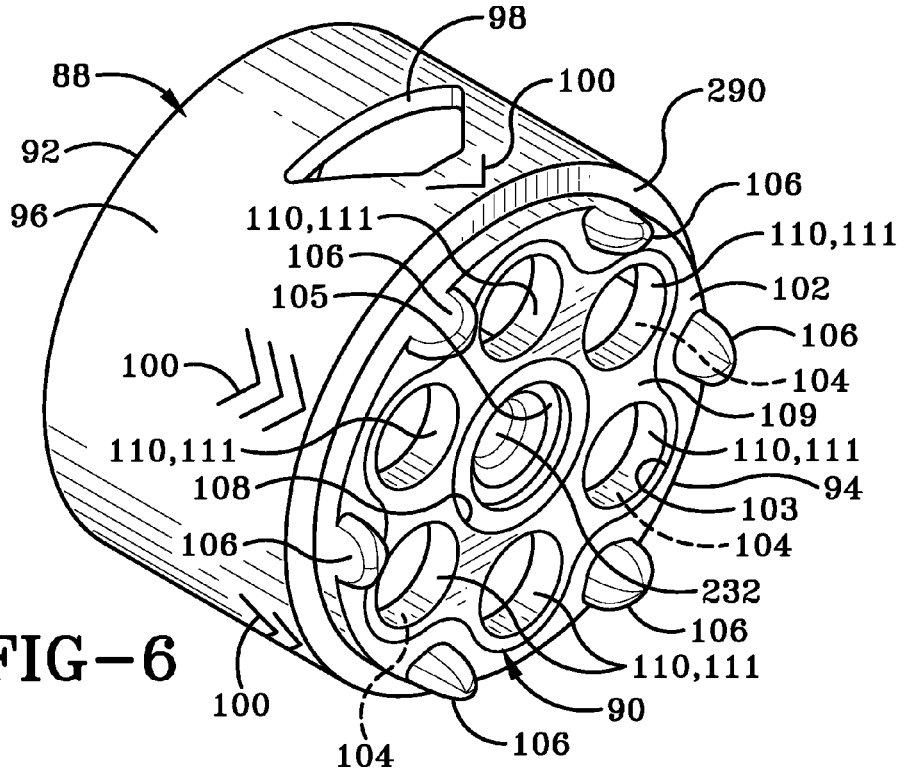
FIG. 6 is an isolated isometric view of a collar and an insert connected thereto which are utilized in the variable resistance exercise band assembly.
Figure 7:
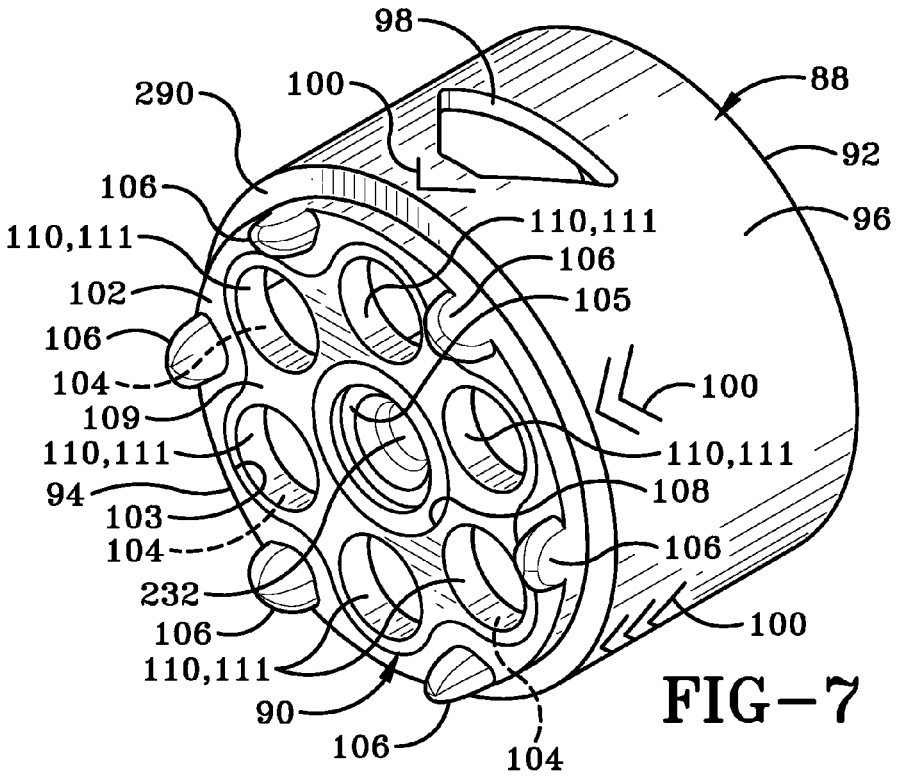
FIG. 7 is an isometric view opposite to that shown in FIG. 6.
Figure 8:
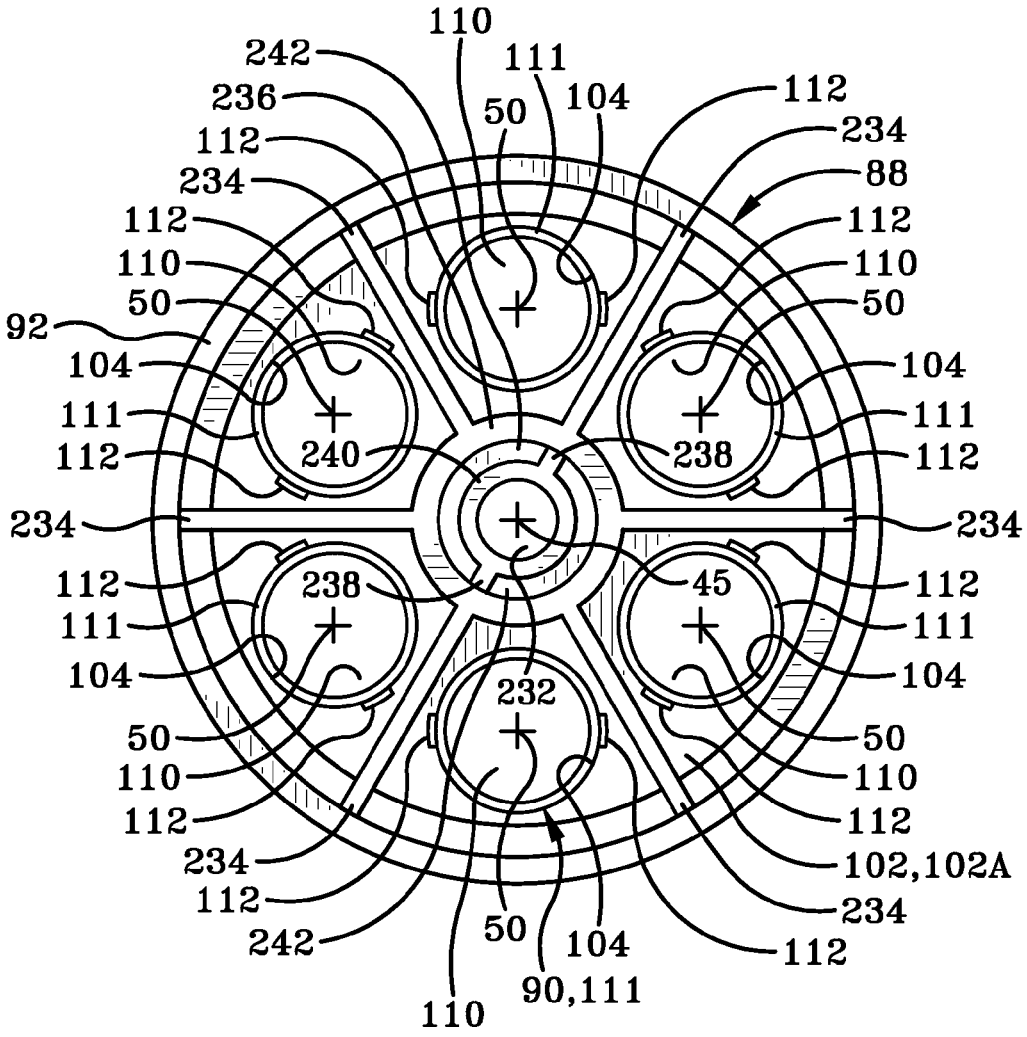
FIG. 8 is an isolated bottom view of the collar and connected insert of FIG. 6.
Figure 9:
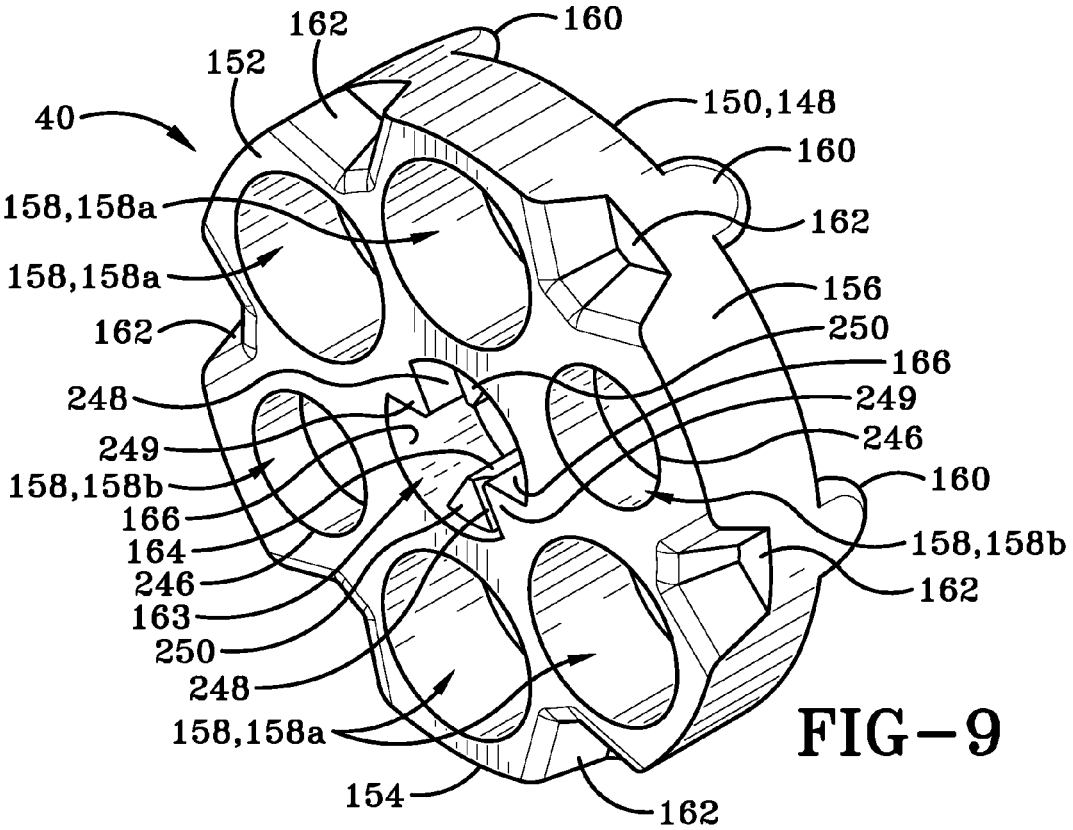
FIG. 9 is an isolated bottom isometric view of a third disc utilized in the variable resistance exercise band assembly.
Figure 10:
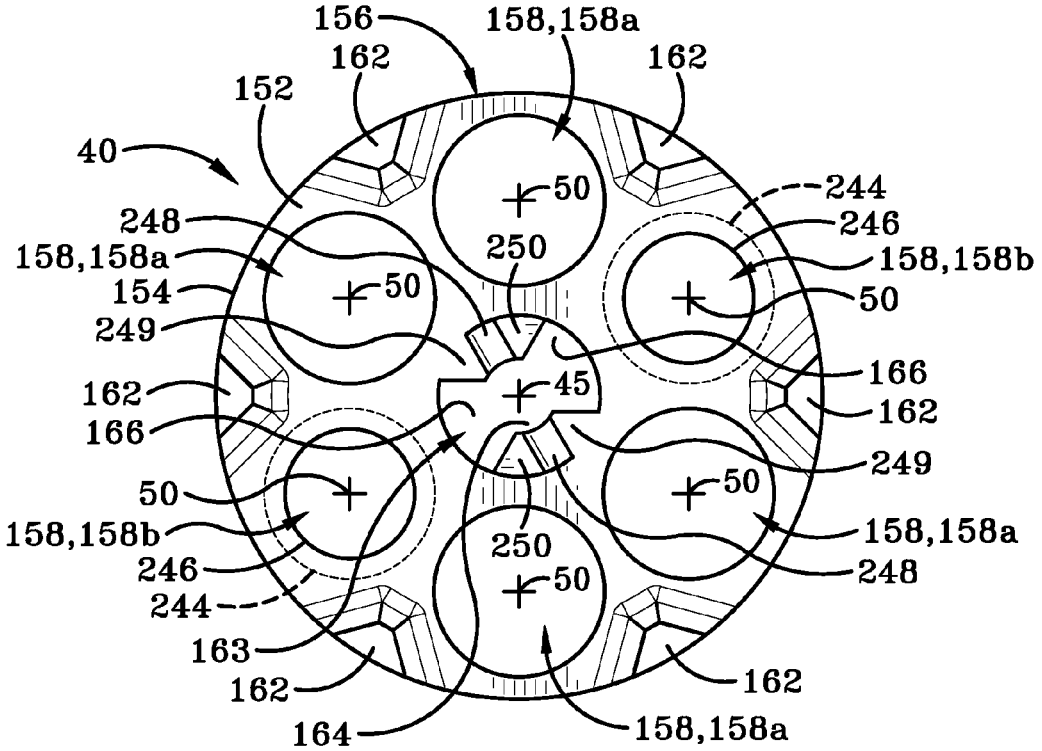
FIG. 10 is a bottom view of the third disc.
Figure 11:
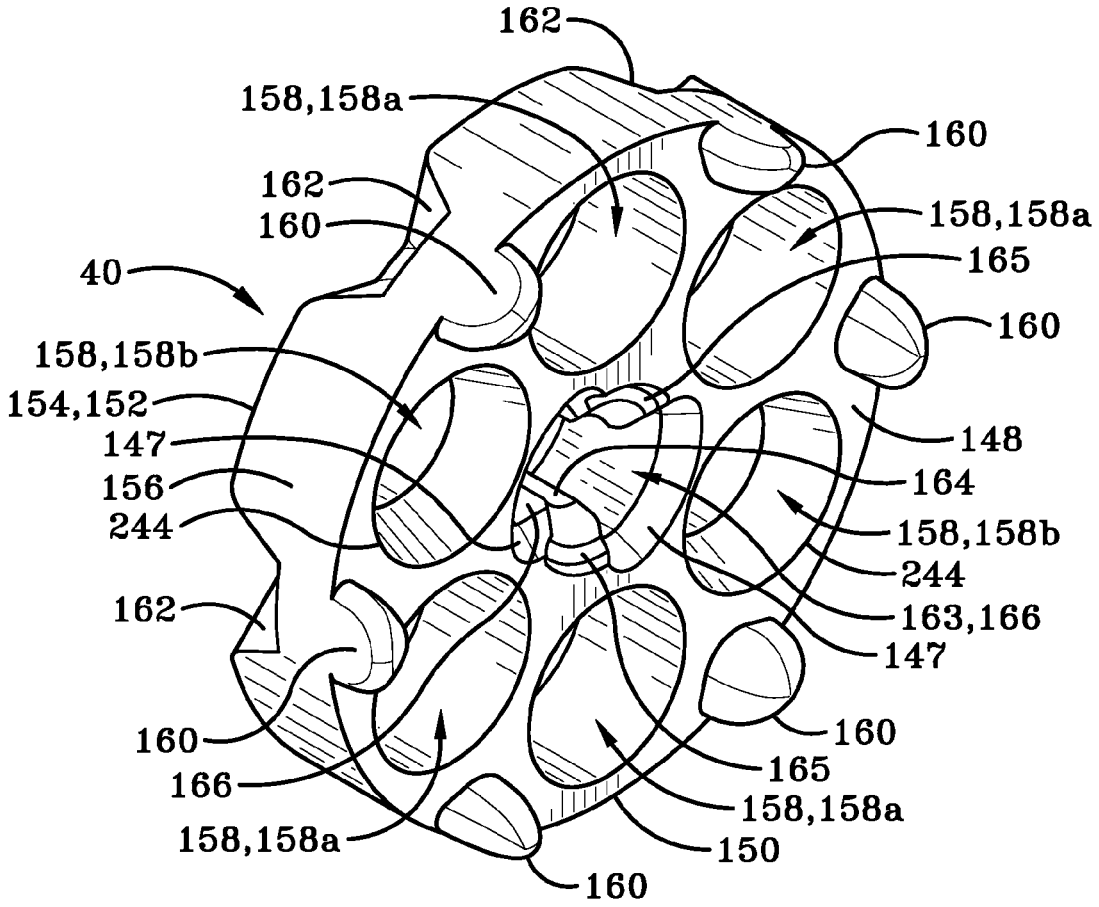
FIG. 11 is an isolated top isometric view of the third disc.
Figure 12:
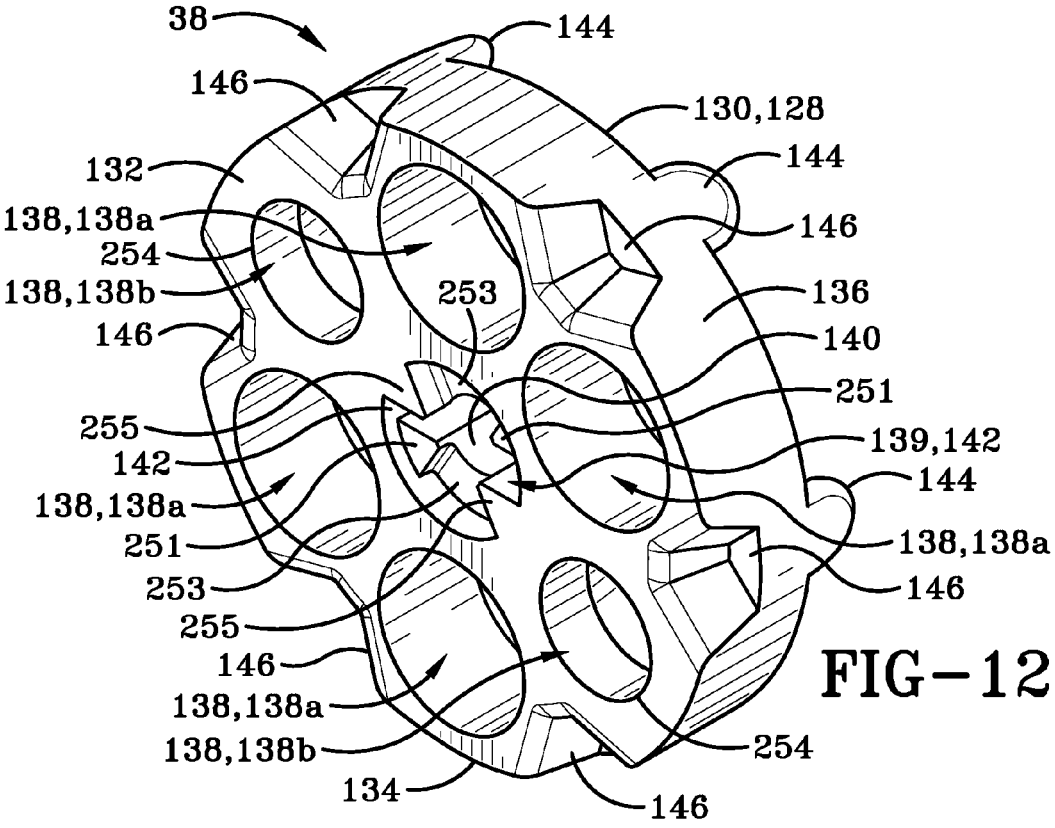
FIG. 12 is an isolated bottom isometric view of a second disc utilized in the variable resistance exercise band assembly.
Figure 13:
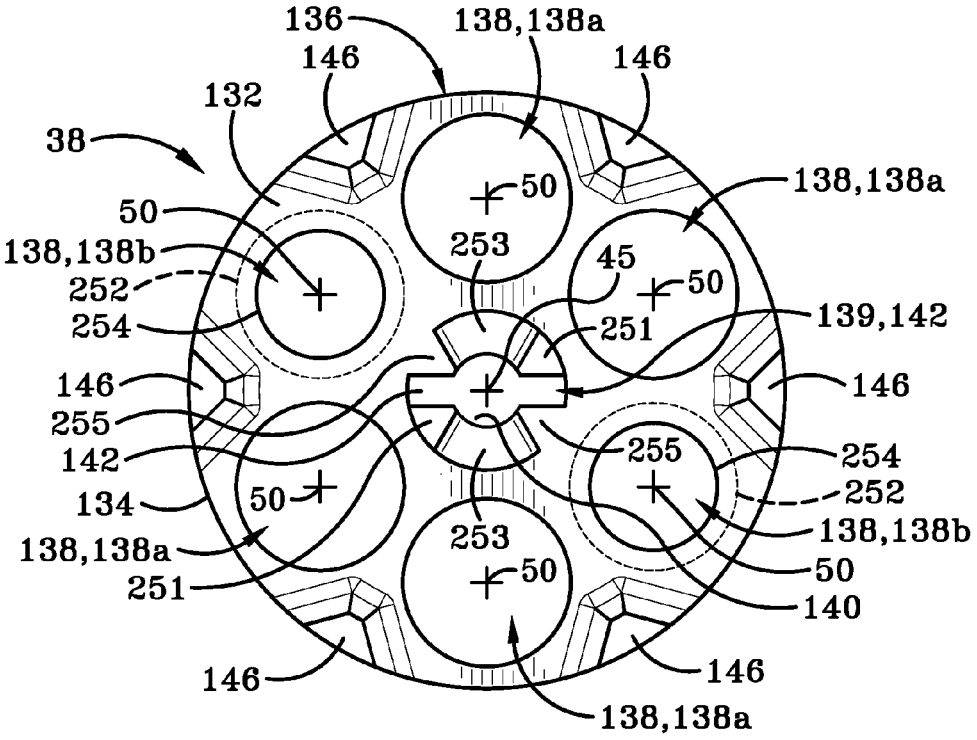
FIG. 13 is a bottom view of the second disc.
Figure 14:
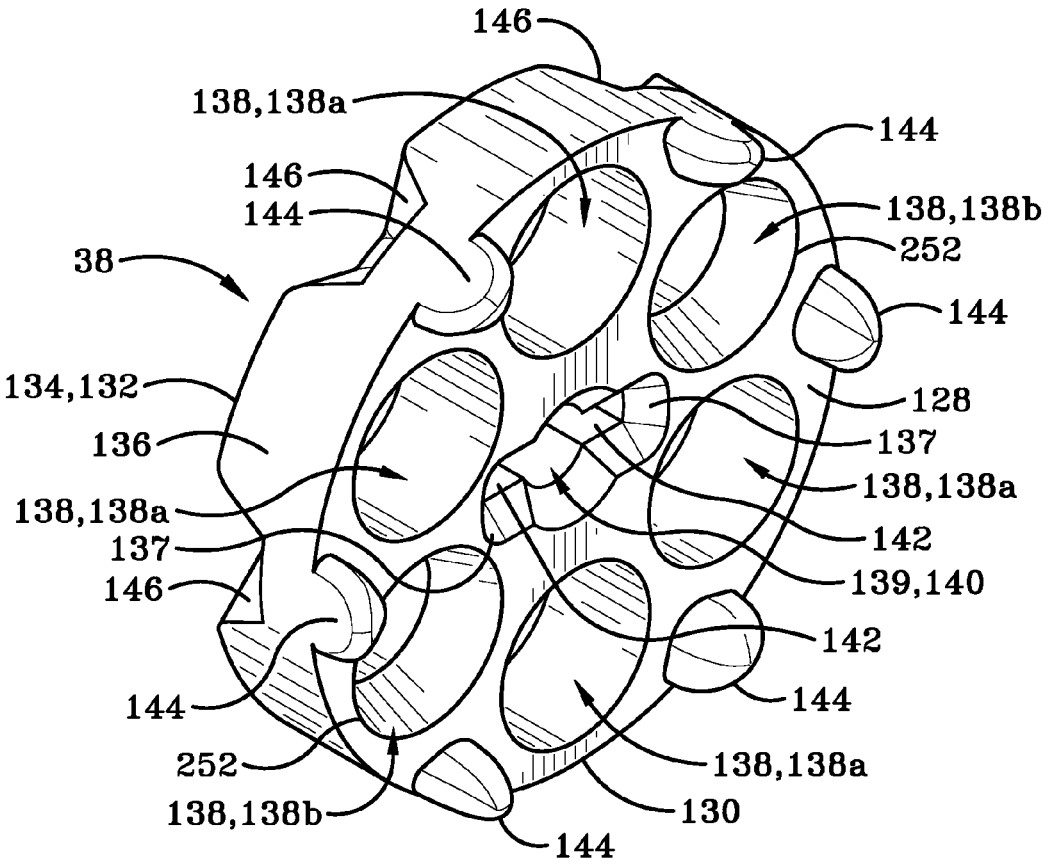
FIG. 14 is an isolated top isometric view of the second disc.
Figure 15:
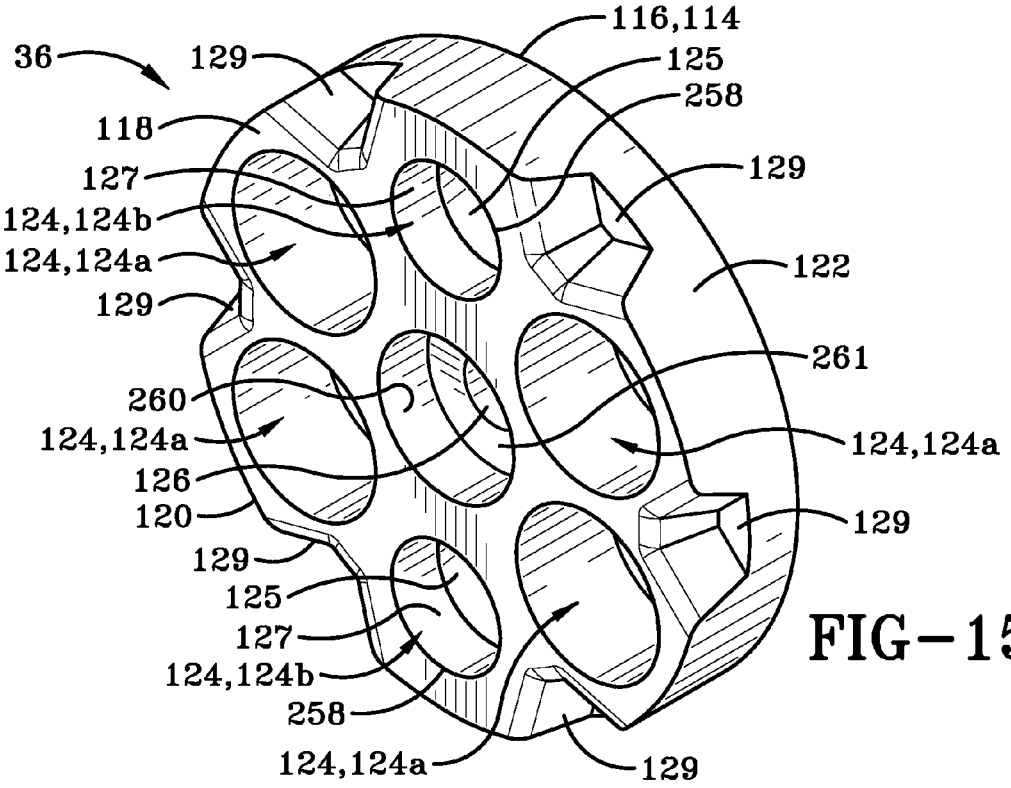
FIG. 15 is an isolated bottom isometric view of a first disc utilized in the variable resistance exercise band assembly.
Figure 16:
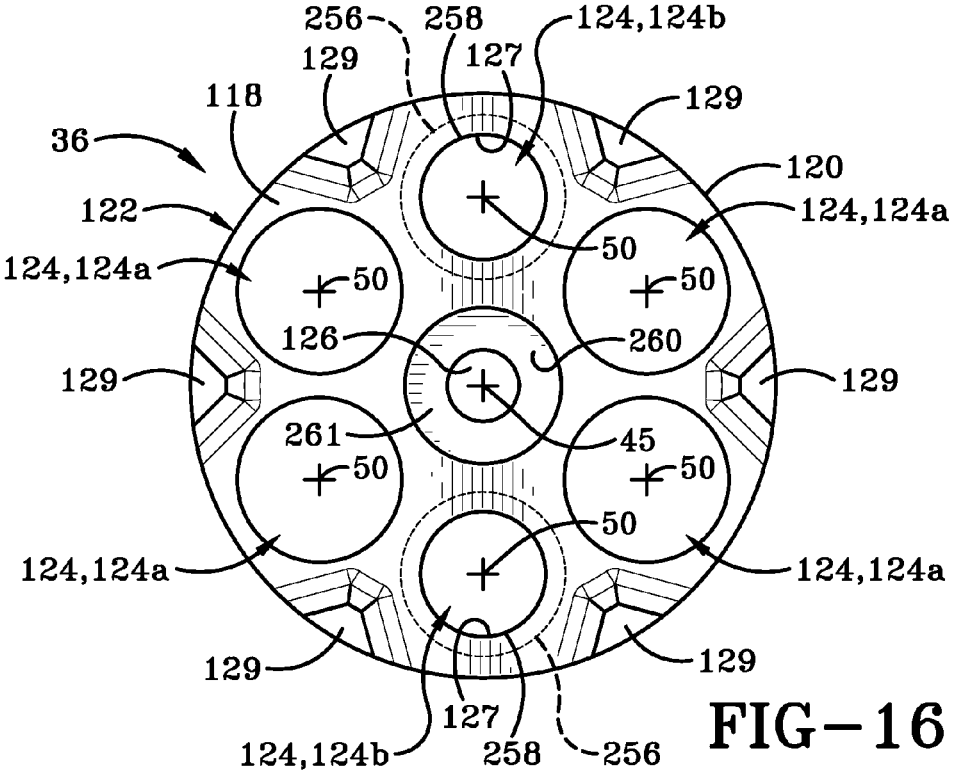
FIG. 16 is a bottom view of the first disc.
Figure 16A:
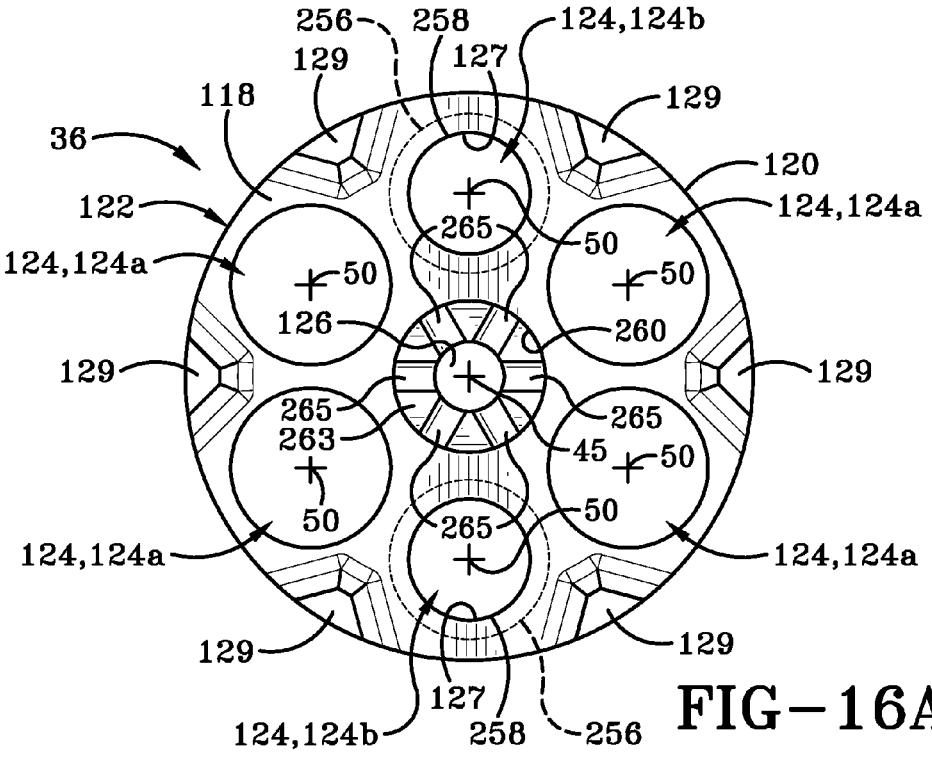
FIG. 16A is a bottom view of a second embodiment of the first disc.
Figure 17:
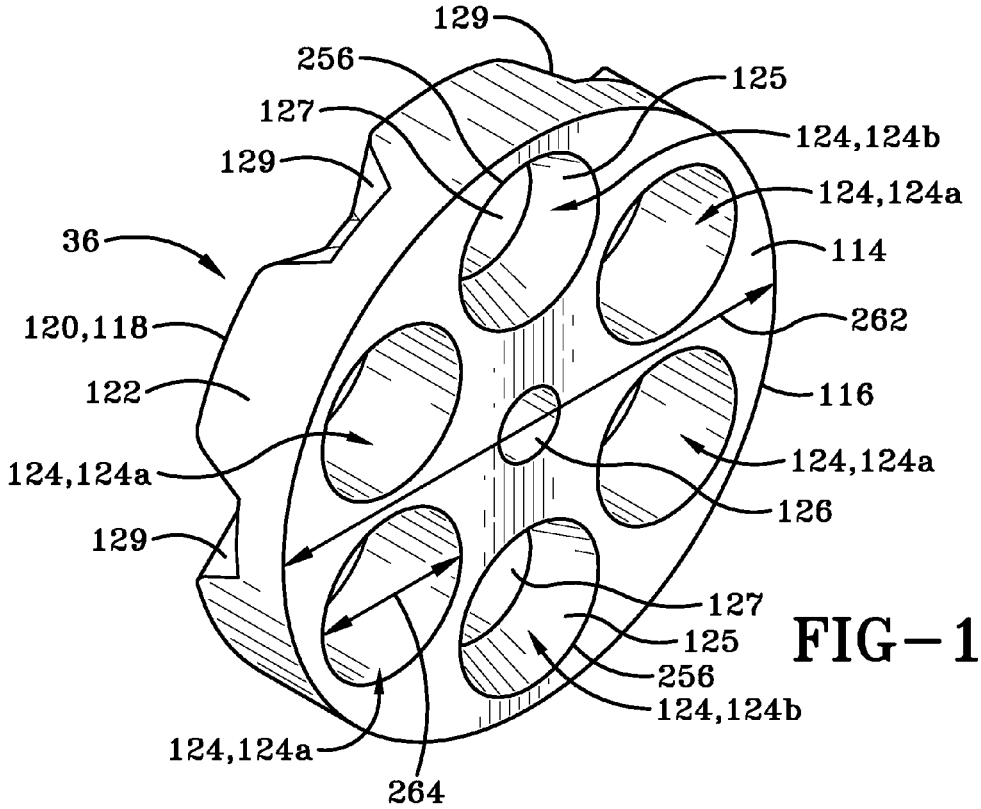
FIG. 17 is an isolated top isometric view of the first disc.

FIG. 2 schematically depicts the various elements of assembly 30 in FIG. 2A, FIG. 2B, FIG. 2C, and FIG. 2D which should be aligned left to right as pictographically indicated in FIG. 2. FIG. 2E shows an alternative embodiment of one of the discs utilized in assembly 30. FIGS. 3-17 show individual elements of assembly 30 in isolation. FIG. 3 illustrates the resilient or elastic band members 44 which provide the resistance generated by assembly 30. FIGS. 4-5 show a connection plate 42 used to engage one end of resilient members 44. Connection plate 42 is referred to as a "connection plate" because all of resilient members 44 provided in assembly 30 are engaged therewith. FIGS. 6-8 show a sleeve member through which resilient members 44 are threaded. FIGS. 9-11 show a third disc through which resilient members 44 are threaded. FIGS. 12-14 show a second disc through which resilient members 44 are threaded. FIGS. 15-17 show a first disc through which resilient members 44 are threaded. (As indicated previously FIG. 16A shows an alternative embodiment of the first disc. FIGS. 18-23 show the various elements of assembly 30 assembled together. FIGS. 24-36 show assembly 30 in operation.

Referring to FIGS. 1-3, assembly 30 includes a tubular housing having a first end 32 and a second end 34. A first attachment assembly 33 is provided at first end 32 of the tubular housing and a second attachment assembly 35 is provided at second end 34 thereof. The housing includes a base member 78 (FIGS. 1 and 2B), a sleeve member 88, and a collar 172 which are oriented in end-to-end relationship. A bore is defined by the tubular housing and this bore extends from first end 32 through to second end 34. It will be understood that instead of the tubular housing being comprised of separate but operatively engaged components (base member 78, sleeve member 88 and/or collar 172), the tubular housing may be a single, monolithic, and unitary component. The tubular housing may be rigid along its entire length from first end 32 to second end 34 thereof. Alternatively, only a portion of the tubular housing may be rigid. So, for example, only base member 78 may be rigid. Still further, the exterior tubular housing may be rigid but one or more components located within the interior of the tubular housing may be rigid. This rigidity or partial rigidity enables a user to reach up and hook resistance band assembly 30 to a piece of exercise equipment that is located a distance above the user's head or out of the user's reach in another direction. The rigidity or partial rigidity of the tubular housing or components within the interior of the tubular housing also enables the user to grasp and manipulate resistance band assembly 30 in a single hand. This feature makes it quick and easy for a user to engage or disengage resistance band assembly 30 with a fitness station or with a workout accessory, as will be later described herein.

As indicated above, assembly 30 may include a base member 78 (FIGS. 1 and 2B) with a sleeve member 88 extending longitudinally outwardly from a first end 80, and collar 172 extending longitudinally outwardly from an end of sleeve member 88. First attachment assembly 33 (FIG. 2A) is provided at first end 32 of the tubular housing. First attachment assembly 33 includes an adjustment assembly 170 which extends partially outwardly through an opening at one end of collar 172. A second attachment assembly 35 (FIG. 2A) is provided at second end 34 of the tubular housing, specifically adjacent second end 82 of base member 78. First and second attachment assemblies 33, 35 enable assembly 30 to be selectively secured to workout accessories, exercise structures or exercise machines so that a range of exercises may be performed therewith.

A plurality of resilient members 44 (FIG. 3) is provided within a bore of the tubular housing, where the bore of the housing is comprised partially of bore 84 (FIG. 2B) of base member 78, various apertures 104 (FIG. 2C) defined in sleeve member 88, and a cavity 284 (FIG. 2D) defined in collar 172. Resilient members 44 will be described in greater detail later herein. Resilient members 44 are threaded through apertures in first, second and third discs 36, 38, 40 (FIG. 2C), through apertures in an insert 90, through apertures in sleeve member 88 and are then removably engaged with connection plate 42 (FIG. 2A). The tapered end 222 of each resilient member 44 is not able to pass through the associated aperture in the discs 36, 38, 40 with which the resilient member is engaged. Thus, resilient members 44 extend through the bore of the tubular housing from proximate first end 32 to proximate second end 34. The discs 36, 38, 40 are selectively engageable with first attachment assembly 33 provided at second end 32 of assembly 30, specifically with adjustment assembly 170. First attachment assembly 33 is used to engage resistance band assembly 30 with workout accessories as will be further described herein.

Figure 2B:
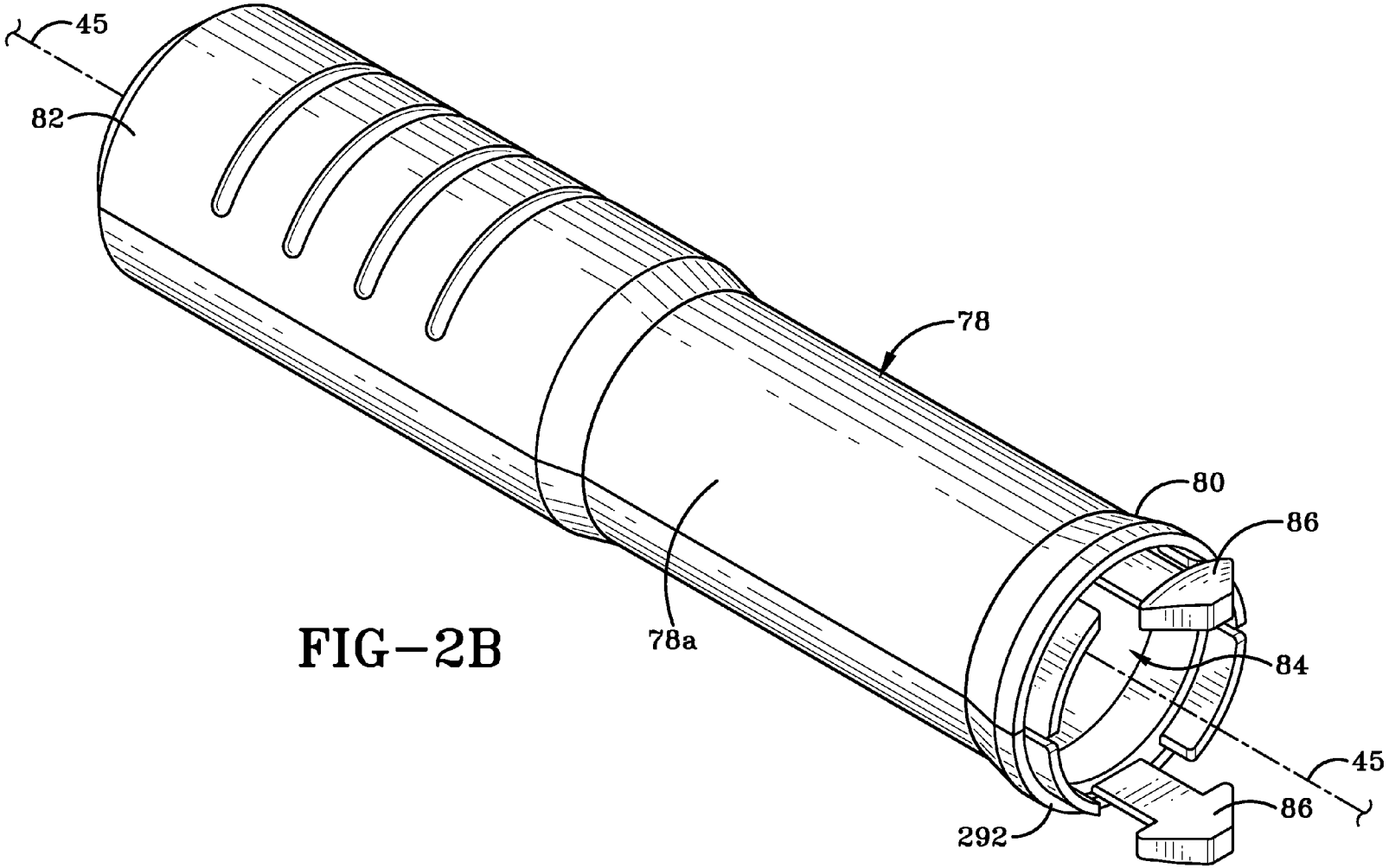
FIG. 2B is an exploded isometric view of some components of the variable resistance exercise band assembly.

Referring to FIGS. 1 and 2B, base member 78 is a tubular housing that may be fabricated entirely or partially from a strong, rigid material. Base member 78 may be comprised of two semi-circular cylinder halves which are mated together by any suitable means, such as heat-welding. Instead of being fabricated from two separate halves which are joined together, base member 78 may, alternatively, be a generally rigid, integrally formed, monolithic, or unitary member. Rigid base member 78 may be a self-supporting structure which allows a user to reach out and extend a distance without assembly 30 becoming limp. This self-supporting feature is advantageous inasmuch as it allows a user to reach an attachment member 578 (FIG. 35) that may be provided on some type of overhead exercise structure and which would be difficult to engage assembly 30 thereto if base member 78 was not self-supporting.

The material used to fabricate base member 78 may be substantially waterproof or impervious, opaque, and/or non-transparent to ultra-violet (UV) light. The latter characteristic tends to ensure that resilient members 44 located within bore 84 of housing are protected from UV exposure if assembly 30 is used in conjunction with an outdoor exercise structure. The materials used for base member 78 therefore aid in prolonging the life of both the base member 78 and resilient members 44. Base member 78 may also provide ozone protection.

Alternatively, instead of the tubular housing being rigid to accomplish the advantages of the present invention, base member 78, sleeve 88 and collar 172 may be fabricated so as to be flexible in nature and a rigid rod 72 used within the interior of the tubular housing may instead comprise the portion of resistance band assembly that is rigid. The rigid rod 72 may enable a user to reach upwardly, holding onto base member 78 or sleeve 88 or collar 172 and hook the second attachment assembly 35 to an overhead piece of exercise equipment with a single hand as described above.

Dimensionally, in one embodiment base member 78 may be approximately sixteen inches long from end of tab 86 to second end 82 and bore 84 diameter is approximately 2¾", but clearly alternative dimensions are entirely possible, such as a base member 78 length in a range from about six inches to about thirty six inches, forty eight inches, or sixty inches. Furthermore, when base member 78 is about sixteen inches, the overall assembly 30 from first end 32 to second end 34 thereof is about twenty four inches. This length will be longer or shorter depending on length of base member 78 used therein.

Referring still to FIGS. 1 and 2B, base member 78 has a first end 80, a second end 82 and a longitudinal axis 45 extending therebetween. Bore 84 of base member 78 extends from first end 80 to second end 82. Base member 78 may comprise a first section, second section, and a third section. First section is proximate first end 80 and the third section is proximate second end 82. The second section is intermediate the first and third sections. Second section is of a first diameter and the first and second sections are of a larger second diameter. An angled transition surface is provided between the second section and each of the first and third sections. The difference between the first and second diameters may extend only to the exterior surface of housing or may extend additionally to the internal diameter of bore 84. One or both of the first and third sections of base member 78 may be provided with ridges or grooves on an exterior surface thereof to aid in the gripping of assembly 30 during use thereof.

Figure 19:
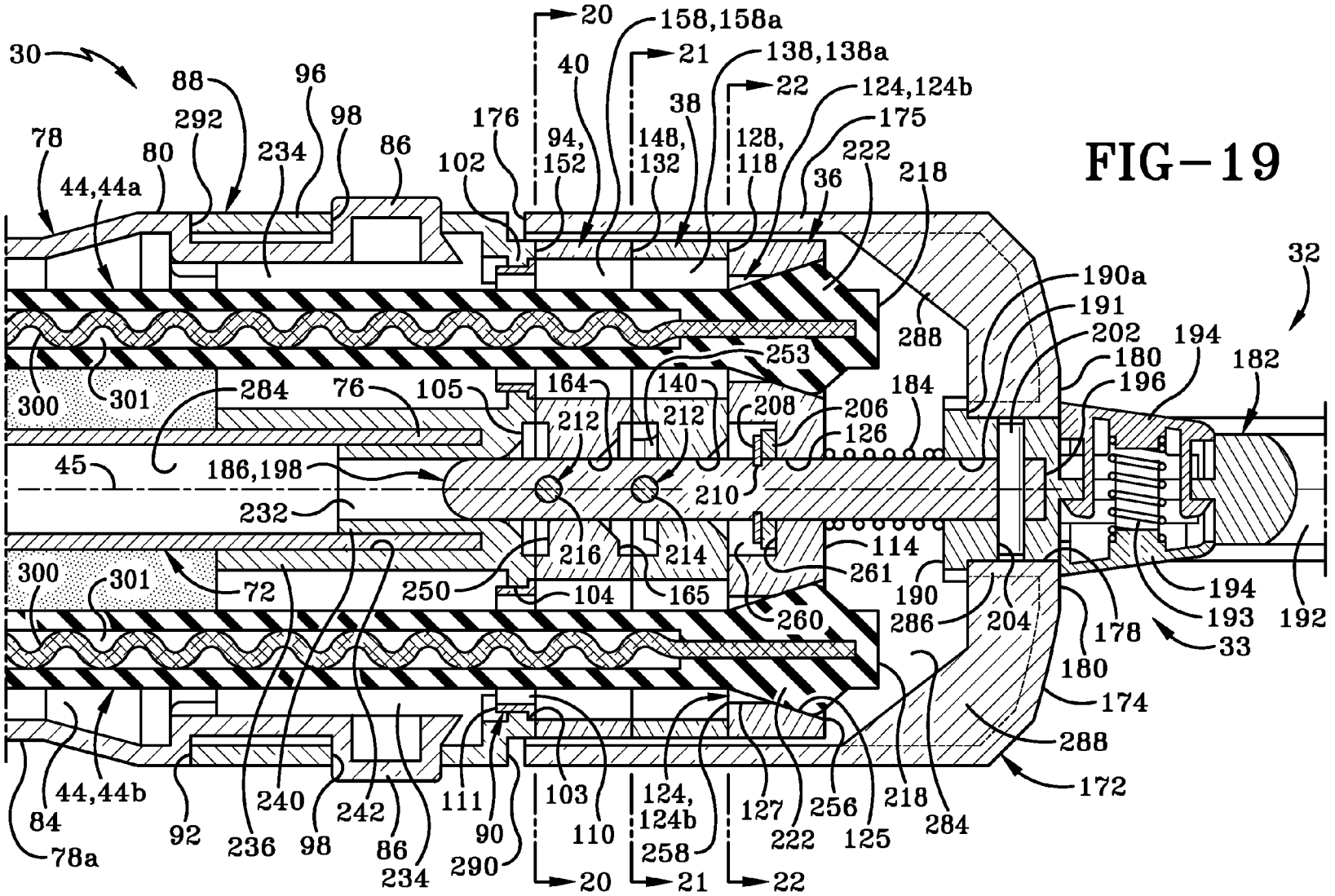
FIG. 19 is a cross-section view of the first end of the variable resistance exercise band assembly taken along line 19-19 in FIG. 1.

One or more tabs 86 extend outwardly from first end 80 of base member 78 and along an outer circumference thereof. As shown in FIGS. 1 and 19, tabs 86 releasably connect base member 78 to sleeve member 88. Base member 78 snaps onto sleeve member 88 by way of tabs 86 and housing is thereby piloted over the outer diameter of sleeve member 88. Tabs 86 permit easy engagement with sleeve member 88 and easy removal of base member 78 from sleeve member 88. Thus, tabs 86 act as a "quick connect" or a "quick-disconnect" element. This quick connect and quick disconnect feature aids in making it easy for a user to replace resilient members 44 in order to change the resistive force delivered by resistance band assembly 30. The feature is also useful if a resilient member 44 becomes damaged and needs to be replaced.

Figure 18:
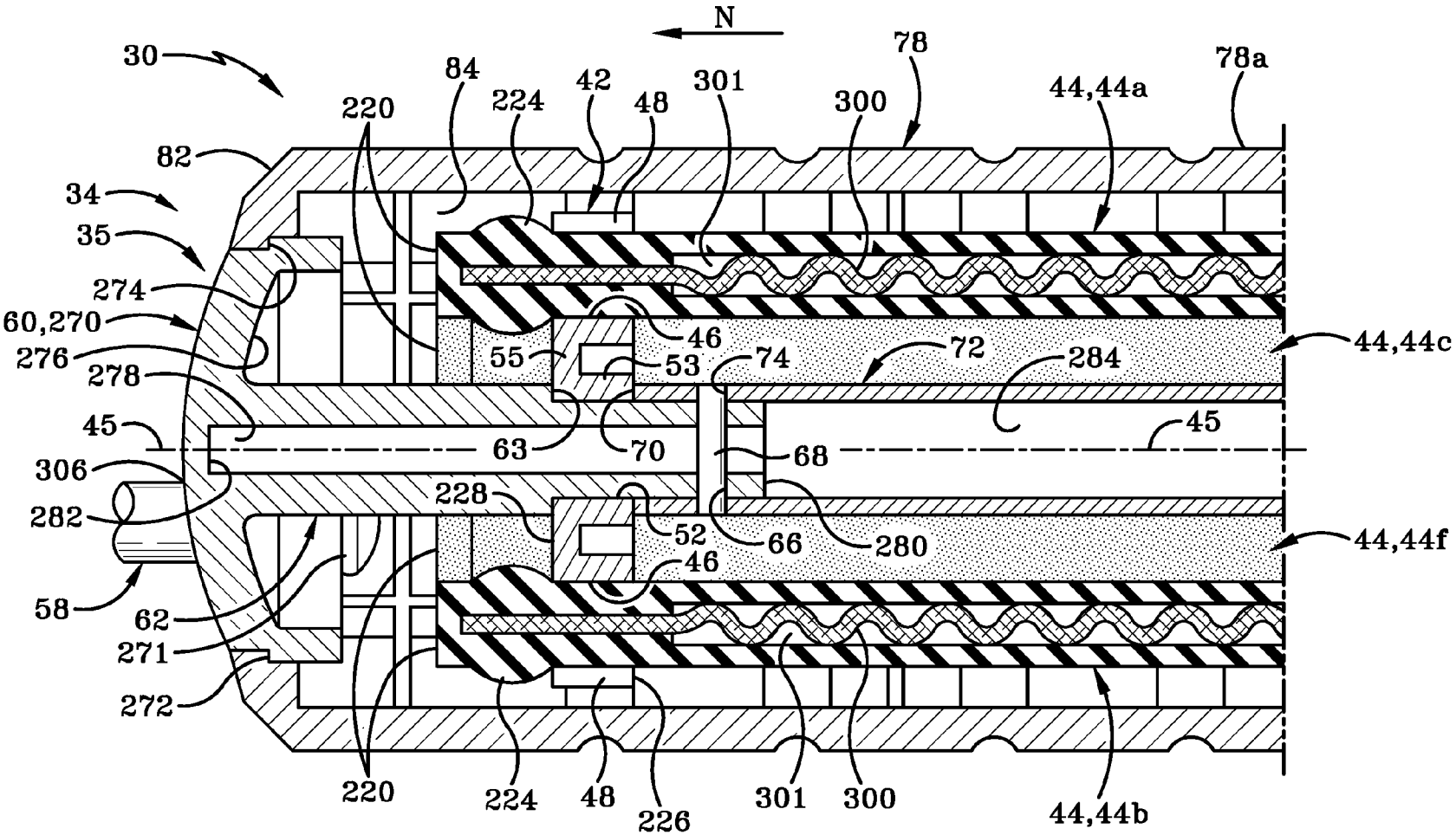
FIG. 18 is a cross-section view of the second end of the variable resistance exercise band assembly taken along line 18-18 in FIG. 1.

Referring to FIGS. 1 and 2A, second attachment assembly 35 is operatively engaged with second end 82 of base member 78. Second attachment assembly 35 includes a hook connector 60. As shown in FIG. 18, second end 82 of base member 78 is provided with a lip 274 for engagement with hook connector 60. Referring again to FIGS. 1 and 2A, hook connector 60 has at least one and preferably two hooks extending outwardly from outer surface 270 thereof. In particular, a first hook 56 and a second hook 58 extend outwardly from outer surface 270 in a first direction. A pin portion 62 extends inwardly from an inner surface 276 of hook connector 60 in a second direction. Convex outer surface 270 is generally hemispherical in shape and is symmetric about longitudinal axis 45 when viewed in cross-section. An annular cut-out defining an edge rabbet 272 is formed in outer surface 270. Rabbet 272 is located adjacent lip 274 on second end 82 of base member 78 when resistance band assembly 30 is assembled. This second end 34 of resistance band assembly 30 is illustrated in FIG. 18.

Pin portion 62 is integrally formed in a unitary manner with inner surface 276 of hook connector 60. Inner surface 276 (FIGS. 2A & 18) is a convex surface facing first end 32 and spaced opposite first surface 270. Pin portion 62 is a tubular structure which extends inwardly from inner surface 276 and towards first end 32 of assembly 30. Pin portion 62 defines a hollow bore 278 that is concentric about longitudinal axis 45. Bore 278 extends from a pin end 280 outwardly towards inner surface 276 of hook connector 60 and terminates at an end 282 (FIG. 18) located between first and second surfaces 270, 276. Pin portion 62 is of a first diameter proximate hook connector 60 and is of a second diameter proximate pin end 280. A shoulder 63 is formed in pin portion 62 between the first diameter and second diameter regions. The region of pin portion 62 having the second diameter is also provided with a flat wall 64. A hole 66 is defined in the non-flattened portion of this second diameter region and hole 66 passes completely through pin portion 62. The region of pin portion 62 which includes flat wall 64 is received through central aperture 52 of connection plate 42. The flat wall 64 aligns with the flat wall 54 of connection plate 42, thereby orienting pin portion 62 and connection plate 42 and aiding in preventing rotation of connection plate 42 about longitudinal axis 45.

Pin portion 62 (FIGS. 2A and 18) extends outwardly from hook connector 60, through central aperture 52 of connection plate 42 and into a bore 284 of rod 72. First end 70 of rod 72 fits over the end of pin portion 62 and abuts face 226 of connection plate 42. A hole 74 is defined in the exterior surface of rod 72. When rod 72 is engaged with the second diameter region of pin portion 62, holes 66 and 74 are aligned with each other and a pin 68 passes through these aligned holes 66, 74 and secures rod 72 to pin portion 62 and thereby secures connection plate 42 to second attachment assembly 35.

Figure 23:
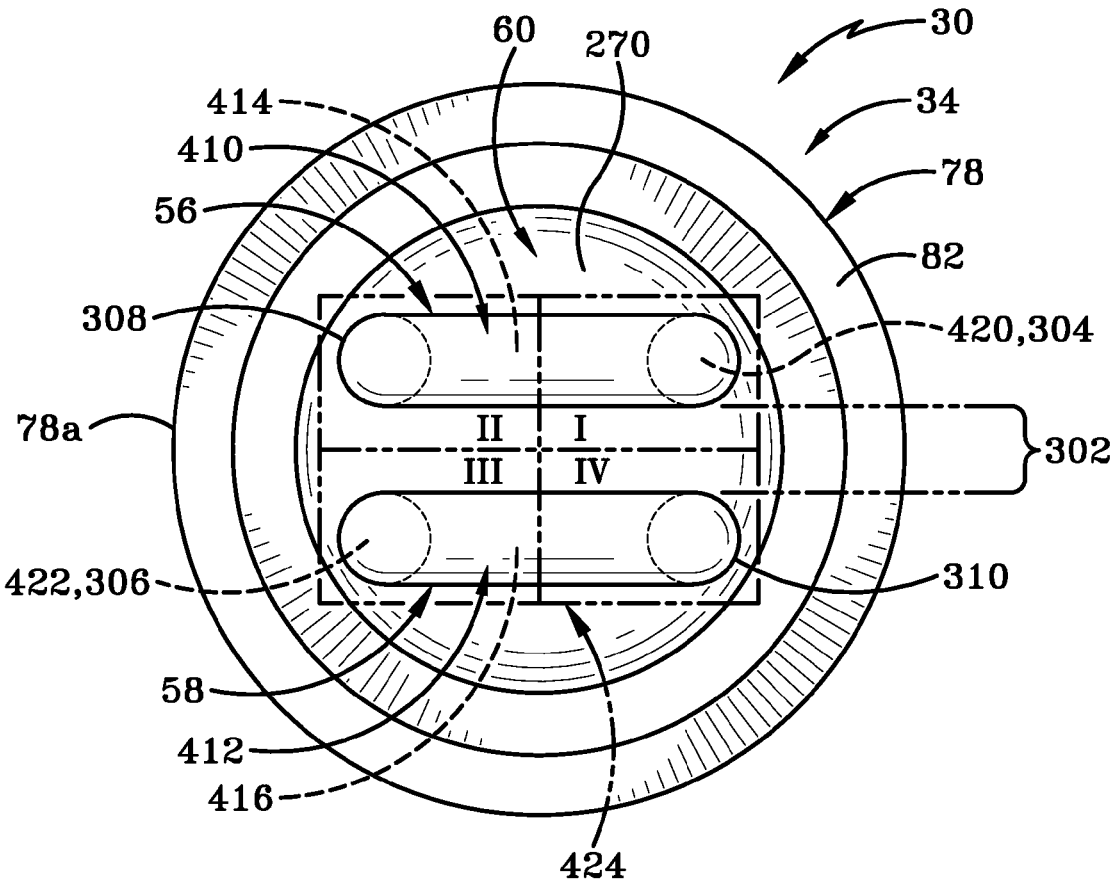
FIG. 23 is an end view of the variable resistance exercise band assembly taken along line 23-23 in FIG. 1 depicting a first and second hook defining the second end.

Referring to FIGS. 2A and 23, first and second hooks 56, 58 extend outwardly from outer surface 270 of hook connector 60. First and second hooks 56, 58 may be uniform, monolithic members constructed of metal or other suitably strong material that may selectively revolve in unison about longitudinal axis 45. The term "revolve" refers to the fact that hooks 56, 58 are both offset from longitudinal axis 45. Each of the first and second hooks 56, 58 may be J-shaped. First hook 56 extends upwardly and outwardly from a rigid connection 304 with upper surface 270 of hook connector 60 to form an inverted "J" terminating at a tip 308. Second hook 58 extends upwardly and outwardly from a rigid connection 306 with upper surface to form an inverted "J" terminating at a tip 310. Each of first and second hooks 56, 58 may extend through an aperture defined in upper surface 270 and into a pocket formed in the hook connector 60. The hooks 56, 58 and the pockets they fit into may have flattened regions on them similar to the flat walls 64/54. These flattened regions aid in keeping first and second hooks 56, 58 from rotating about the axis of the screw 271 used to secure them to hook connector 60.

Figure 24:
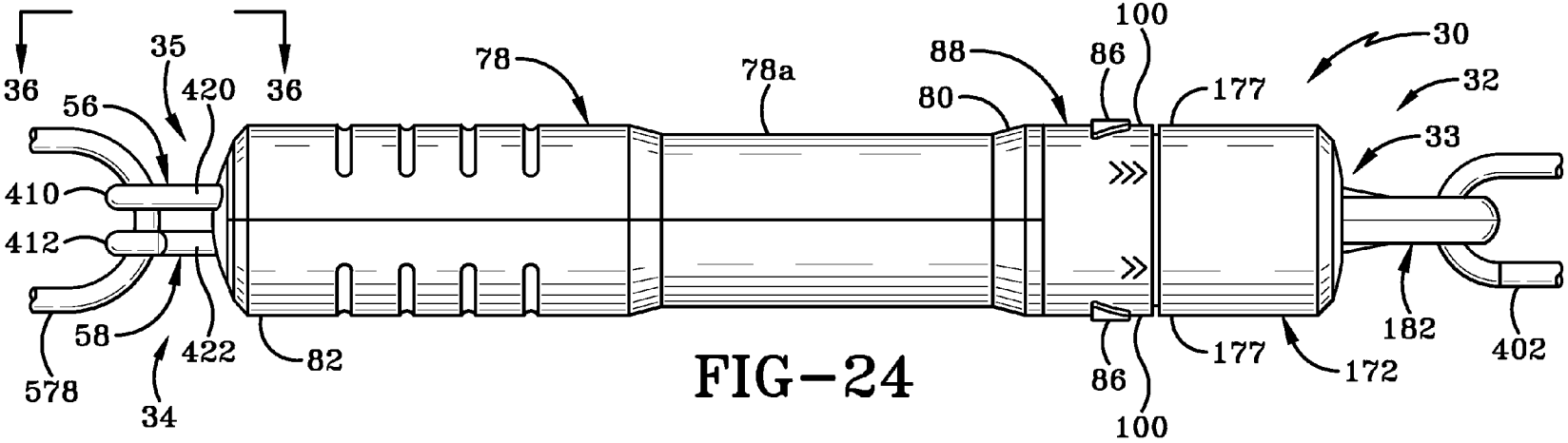
FIG. 24 is an operational side view of the variable resistance exercise band assembly.
Figure 25:
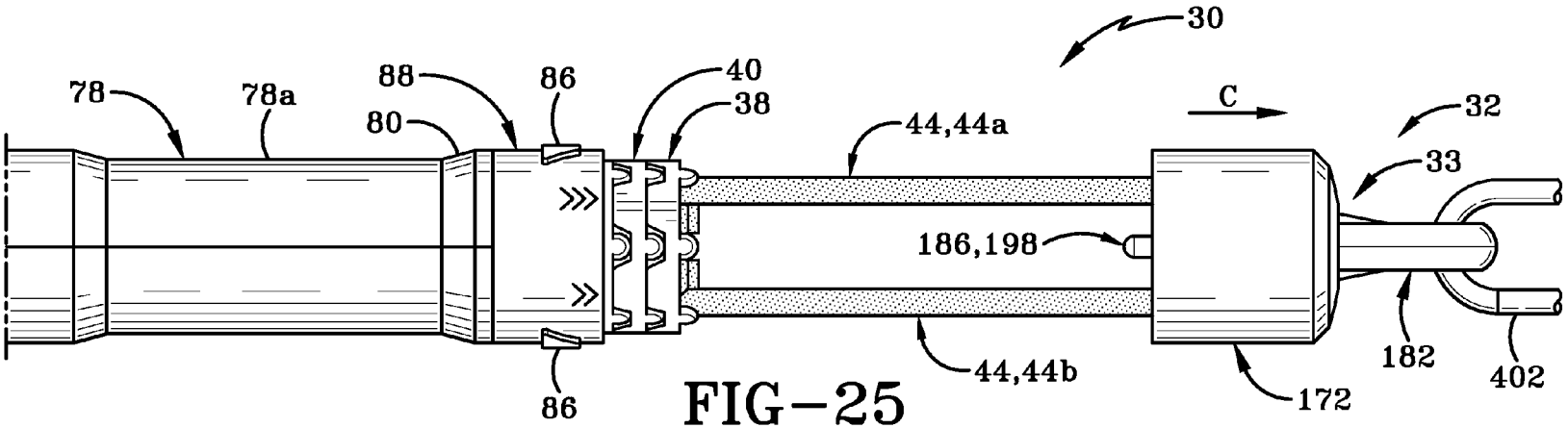
FIG. 25 is an operational side view of the variable resistance exercise band assembly depicting two resilient members stretched during an exercise movement.

When viewed from a side, first hook 56 curves in one direction from base 304 to tip 308 and second hook 58 curves in the opposite direction from base 306 to tip 310. Hooks 56, 58 may further respectively include longitudinal base or leg portions 420, 422, respectively, extending from the respective connections 304, 306, in a cantilevered manner (as best shown in FIG. 24). Hook 56 further includes a first arcuate section 410 and hook 58 includes a second arcuate section 412. First arcuate section 410 defines a concave surface 414 and second arcuate section 412 defines a concave surface 416. A first radius of curvature is associated with first arcuate section 410 on first hook 56 and a second radius of curvature is associated with the second arcuate section 412 on second hook 58. First and second radii of curvature may be equal.

First hook 56 is laterally spaced apart from second hook 58 such that a gap 302 (FIG. 23) is defined between them. Gap 302 is partially defined between first arcuate section 410 and second arcuate section 412. Gap 302 is in a range of from about ¼ inch to about 2 inches or more. An arbitrary rectangular perimeter 424 relative to first and second hooks 56, 58 may be projected on second end 34 to define four equally sized quadrants when viewing second end 34 from above. This is illustrated in FIG. 23. The four quadrants are identified by Roman Numerals I, II, III, and IV, respectively. A base portion 420 and connection 304 of first hook 56 may be in a first quadrant I. Tip 308 of first hook 56 may be in a second quadrant II. A base portion 422 and connection 306 of second hook 58 may be in a third quadrant III. Tip 310 of second hook 58 may be in a fourth quadrant IV. The first quadrant I is 180 degrees from the third quadrant III. From this arrangement, it can be seen that the first connection 304 and the second connection 306 may be spaced apart 180 degrees from each other on diametrically opposite sides of longitudinal axis 45 when viewing second end 34 from the end as in FIG. 23. There may further be a first offset distance measured from first connection 304 to longitudinal axis 45 and a second offset distance measured from second connection 306 to longitudinal axis 45. The absolute values of the first and second offset distances may be substantially equal. Relative to gap 302, tip 308 and tip 310 are catty-cornered to each other (i.e., diagonally offset) such that if a first imaginary line is drawn from J-tip 308 to J-tip 310 and a second imaginary line is drawn from connection 304 to connection 306, the intersecting first and second lines would form an X-like pattern or X-shaped configuration when viewed from second end 34 of assembly 30. Tips 308, 310 may be spherical and are oriented in such a way so as to face first end 32 of assembly 30.

A transverse through-passageway 418 (FIG. 36) is defined between upper surface 270 and concave surfaces 414, 416. Passageway 418 is adapted to receive an attachment member 578 of a separate exercise structure such as the fitness station 510 illustrated in FIGS. 37-46. A first space is defined between tip 308 of first hook 56 and upper surface 270 of assembly 30; and a second space is defined between tip 310 of second hook 58 and upper surface 270. The first and second spaces allow entry of attachment member 578 into passageway 418. One or both of first and second hooks 56, 58 may be utilized to engage attachment member 578. First and second hooks 56, 58 are substantially parallel to each other as may be seen in FIG. 23. Attachment member 578 is initially engaged by one or the other of hooks 56, 58 and then assembly 30 is twisted so that the other of the hooks 56, 58 engages attachment member 578. Attachment member 578 is thus engaged by both hooks 56, 58 and because hooks are oppositely oriented and parallel to each other, attachment member 578 will become trapped by hooks 56, 58. Attachment member 578 will not be easily accidentally released from hooks 56 and 58 unless and until a rotational-type motion on assembly 30 is utilized to disengage hooks 56, 58 from attachment member 578.

Referring to FIGS. 2A, 4 and 5, connection plate 42 is provided within bore 84 of base member 78. Connection plate 42 comprises a generally rigid member that may be circular or disc-like in shape, although other shapes may be utilized such as an oval or elliptical shape. (It will be understood that any desired shape of connection plate 42 may be utilized in assembly 30). Connection plate 42 has a thickness extending between a first surface 226 and a second surface 228 thereof. First surface 226 faces first end 32 and second surface 228 faces second end 34 and connection plate 42 is generally at right angles to longitudinal axis 45. A cylindrical circumferential wall 230 extends between first and second surfaces 226, 228 and has inner and outer surfaces.

A plurality of radial apertures 46 interrupt circumferential wall 230 of connection plate 42 and extend inwardly for a distance toward a central aperture 52 defined by connection plate 42. Apertures 46 are generally C-shaped when viewed from the front (FIG. 5); where the front is considered to be from first end 32. Circumferential wall 230 is interrupted by openings 48, each of which permits access to one of apertures 46. Openings 48 extend longitudinally from first surface 226 to second surface 228 of connection plate 42. A longitudinal axis 50 (FIGS. 2A and 5) extends through each aperture 46. Axis 50 is oriented generally parallel to longitudinal axis 45 of assembly 30 and is spaced eccentrically relative thereto. Apertures 46 are positioned in a satellite orientation around central aperture 52 and around longitudinal axis 45.

Central aperture 52 is aligned along longitudinal axis 45 and is defined by a generally cylindrical wall 53 which extends outwardly from an interior face 55 of second surface 228. Wall 53 includes the aforementioned flat section 54 (FIG. 5). Central aperture 52 is thus generally D-shaped when viewed from the front. Resilient members 44 are detachably engageable with connection plate 42. Each resilient member 44 subsequently extends through bore 84 of base member 78 and is engaged with at least one of first, second and third discs 36, 38, 40.

As depicted in FIG. 3, six resilient members 44*a*, 44*b*, 44*c*, 44*d*, 44*e*, and 44*f* are utilized in assembly 30. Resilient members 44 comprise elongate tubular resilient or elastic bands. These bands are longitudinally stretchable and are engaged with components within assembly 30 in order to be able to impart a resistance when stretched during the performance of an exercise motion. Each resilient member 44 includes a shaft 221 having a first end 218 spaced apart and longitudinally opposite a second end 220. Each resilient member 44 is located within the tubular housing such that shaft 221 thereof will be aligned along an axis 50 (FIG. 2A or 2C) that is eccentric from longitudinal axis 45 and is generally parallel thereto.

The shafts 221 of resilient members 44*a-f* may all be of the same length and diameter and wall thickness and thus provide the same resistive force. Alternatively, the various resilient members 44*a-f* may be of different lengths, diameters, and/or wall thicknesses and therefore provide different resistive forces. The resistive force capable of being applied by any one resilient member 44 is dependent upon the length, diameter and wall thickness of shaft 221 thereof. So, if a user wishes to customize resistance band assembly 30 for their own personal use, the user may select specific resilient members 44 which can provide the variety of resistive forces the user desires. The user may therefore select resilient members 44 which are all of the same length, diameter or wall thickness or the user may select resilient members 44 having different lengths, diameters or wall thicknesses. Apart from length, diameter and wall thickness, another way in which the resistance values of resilient members 44 may vary is if resilient members are made from different materials. A user may therefore purposefully replace a resilient member 44 fabricated from a first material with a resilient member fabricated from a second different material with a different elastic characteristic. These resilient members fabricated from different materials may also vary in length, diameter and wall thickness.

Thus, in accordance with an aspect of the invention, the resistive force which may be applied by resistance band assembly 30 may be customized to suit the exercise goals of the user. The customization may be accomplished by the user selectively removing some or all of the resilient members from the housing and inserting other resilient members into the housing; where the replacement resilient members are capable of providing a different resistive force than the resilient members which were removed from assembly 30. So, for example, the user may remove one or more resilient members 44 that have an outer diameter of shaft 221 that is of a first size and insert replacement resilient members having larger or smaller diameter shafts 221.

Each resilient member may have a generally conical, frustoconical or tapered plug 222 provided adjacent first end 218 of the elongate shaft 221. Plug 222 is configured to be at least partially complementary to an aperture in one of the first, second, and third discs 36, 38, 40 and is sized to become engaged or wedged therein, as will be hereinafter described. Plug 222 may be a rigid member shaped like a conventional cork-stop; however other shapes are entirely possible. For example, plug 222 may be spherical and still be able to be retained in one of the tapered apertures defined in discs 36, 38, 40. As is evident from the above, plug 222 is not able to pass through the associated aperture in the associated disc 36, 38, 40 and is thereby engaged with the associated disc.

Each resilient member is further provided with a bulbous member 224 adjacent second end 220 of shaft 221. Bulbous member 224 is spaced longitudinally from tapered plug 222 and is configured to nest within an aperture defined in connection plate 42, as will be further discussed herein. Bulbous member 224 may be a rigid spherical member but other shapes of bulbous member 224 are contemplated. For example, bulbous member 224 may be a tapered cork-stop shape like plug 222. Tapered plug 222 and bulbous member 224 may be stretchably engaged and secured to shaft 221 or may be integrally formed therewith as illustrated in FIGS. 18 and 19. Each of the tapered plug 222 and bulbous member 224 includes a region that is of a greater diameter than the diameter of shaft 221.

Bulbous member 224 is of a larger diameter than the diameter of aperture 46 in connection plate 42. The diameter of bulbous member 224 is, however, smaller than the diameter of the apertures in discs 36, 38, 40 and insert 90. Bulbous member 224 is therefore able to pass through the apertures in first, second, and third discs 36, 38, 40 but is unable to pass through aperture 46 in connection plate 42. In order to engage resilient member 44 with connection plate 42, shaft 221 of resilient member 44 is inserted through opening 48 in circumferential surface 230 of connection plate 42 and is moved radially inwardly into aperture 46. This brings bulbous member 224 into abutting contact with surface 228 of connection plate 42, thereby detachably engaging resilient member 44 thereto. Resilient member 44 is disengaged from connection plate 42 by moving shaft 221 radially outwardly from the associated aperture 46 and through opening 48, thus moving bulbous member 224 out of contact with connection plate 42.

The elongate shafts 221 of each resilient members 44 may be hollow and define a longitudinal bore or lumen 301 (FIG. 19) therein which extends from proximate first end 218 of shaft 221 to proximate second end 222 thereof. (Bulbous member 224 and tapered plug 222 may be rigid members releasably secured within lumen 301 under the elastic pressure of resilient member 44.) A length limiter 300 may extend through lumen 301 and be connected with each of first and second ends 218, 222. In one embodiment, limiting member 300 connects to tapered plug 222 adjacent first end 218 of shaft 221 of the resilient member and extends to bulbous member 224 adjacent second end 220. Limiting member 300 may be fabricated from a substantially flexible material so that member 300 it is able to compress longitudinally when the resilient member 44 is in a non-stretched state. Limiting member 300 is of a longer length than shaft 221 of resilient member 44 in an un-stretched state but is of a shorter length than the length to which shaft 221 could be stretched if limiting member 300 was not provided therein. Thus, when resilient member 44 is stretched to a stretched state during an exercise motion, limiting member 300 substantially prevents resilient member 44 from being overstretched. (Repeated overstretching resilient member 44 could cause resilient member 44 to wear out prematurely.) The limiting action provided by limiting member 300 substantially reduces the risk of damage to resilient member 44 or possible injury to a user if resilient member 44 breaks during use. In one particular embodiment, limiting member 300 may be fabricated from a Kevlar® cord or string. It will be understood that materials other than Kevlar® may be utilized for this purpose. (Kevlar® is a registered trademark of E. I. DU PONT DE NEMOURS AND COMPANY).

Figure 19A:
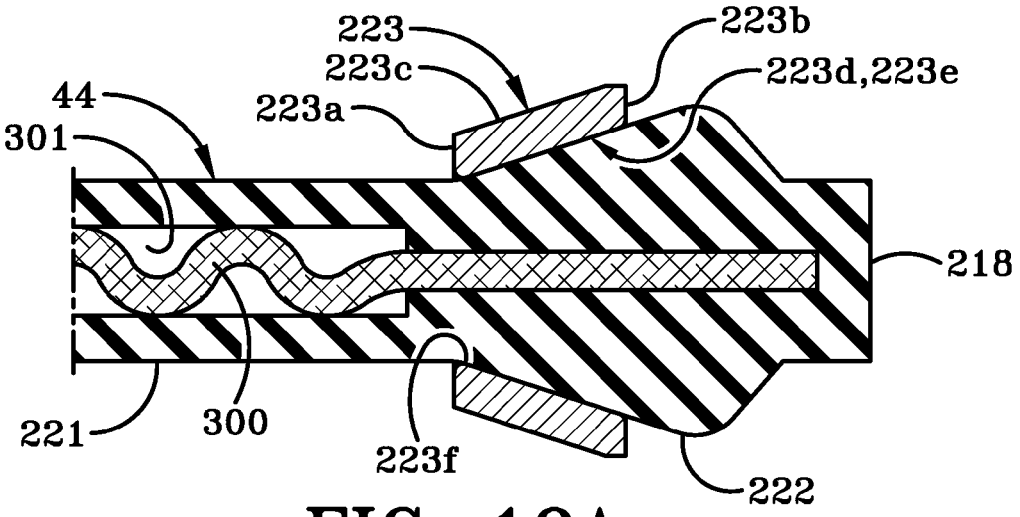
FIG. 19A is an enlarged cross-section of the first end of one of the resilient bands showing a separate adjustment cone engaged therewith.
Figure 19B:
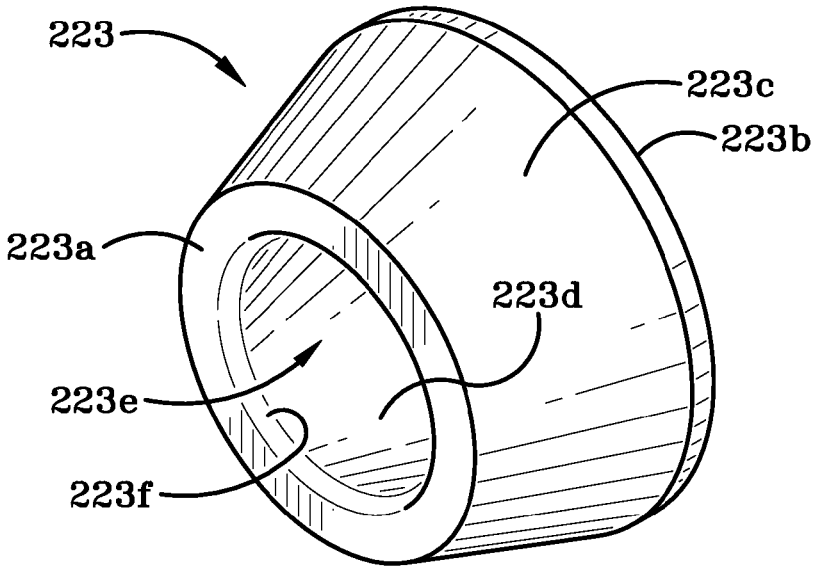
FIG. 19B is an enlarged perspective view of the adjustment cone shown in FIG. 19A.

One or both ends 218, 220 of resilient member 44 may be circumscribed by an aperture adjustment member 223 (FIGS. 19A and 19B). In particular, aperture adjustment member 223 may be applied around the exterior surface of at least part of tapered plug 222 to enable the same to become wedged in an aperture of one of discs 36, 38, 40. Aperture adjustment member 223 has a first end 223*a*, a second end 223*b*, an exterior surface 223*c*, and an interior surface 223*d*. Interior surface 223*d* bounds and defines a bore 223*e* which extends from proximate the first end 223*a* to the second end 223*b*. An opening 223*f* to bore 223*e* is defined in first end 223*a*. Shaft 221 of resilient member 44 extends through bore 223*e* and through opening 223*f*. At least a portion of the face of aperture adjustment member 223 which bounds and defines opening 223*f* and/or bore 223*e* includes a friction-reducing material that allows shaft 221 of resilient member 44 to pass therethrough. The tapered plug 222 of resilient member 44 is engaged in bore 223*e* of aperture adjustment member 223 as illustrated in FIG. 19A. Aperture adjustment member 223 may be sized and shaped to be engaged in one of the apertures in one of the first, second or third discs 36, 38, 40 and thereby prevent the associated tapered plug 222 from being drawn through that aperture. Aperture adjustment member 223 is particularly adapted to be sized and shaped so as to become at least partially wedged in one of the apertures in first, second or third discs (i.e., one of 124*b* in first disc 36; 138*b* in second disc 38, or 158*b* in third disc 40) when engaged around the tapered plug 222. When aperture adjustment member 223 is wedged in the aperture and the associated disc is moved, then aperture adjustment member 223 and therefore that end of resilient member 44 will move in unison with the moving disc.

Aperture adjustment member 223 may, itself, be conical or frustoconical in shape as illustrated in FIG. 19B. Resilient member 44 may engage aperture adjustment member 223 in such a way that the latter will not tend to slip off resilient member 44 when that resilient member is inverted. The entire aperture adjustment member 223 may be fabricated from a non-stick or friction-reducing material such as Teflon® to reduce the likelihood of friction-induced wear of the elastic material forming resilient member 44. (Teflon® is a registered trademark of E. I. DU PONT DE NEMOURS AND COMPANY). The materials of the aperture adjustment member 223 and discs 36, 38, 40 are of types where the static and dynamic coefficients of friction thereof are close enough that you don't get into a stick/slip situation. Additionally, the material used for aperture adjustment member 223 has a low coefficient of friction so that it is slippery and does not cause much resistive force on the outer diameter of resilient member 44. The terms "non-stick" or "friction-reducing" used herein should be considered to cover any and all materials which may be used to fabricate or coat exterior surfaces of components used in resistance band assembly 30 which allow those components to move easily relative to each other and which reduce frictional wear on those components.

Aperture adjustment members 223 may be utilized by a user when customizing assembly 30. Aperture adjustment members 33 are useful in the situation where the apertures within first, second and third discs 36, 38, 40 are larger than the tapered plug on the selected resilient member. This might occur if the resilient member in question has a shaft 221 that is of a smaller diameter and thereby has a tapered plug of smaller dimensions than a standard resilient member 44. In other instances, it may be advantageous to engage a separate aperture adjustment member around an exterior of an existing tapered plug 222 or even a bulbous member 224 that is integrally formed with the elongate resilient member or already engaged therewith so as to increase the overall diameter of the resilient member proximate first end 218 or second end 222.

Referring now to FIG. 2C and FIGS. 6-8, sleeve member 88 is engaged with first end 80 of base member 78 and extends longitudinally outwardly therefrom. Sleeve member 88 is a generally cylindrical member with first and second ends 92, 94 and a cylindrical side wall 96 extending therebetween. Side wall 96 defines two apertures 98 therein configured to receive tabs 86 which extend outwardly from base member 78. Apertures 98 are complementary to at least part of tabs 86. As illustrated in FIGS. 6 and 7, apertures 98 may be a generally truncated-triangular shape and tabs 86 on base member 78 may have the appearance of an arrow-head. First end 92 of sleeve member 88 is positioned adjacent first end 80 of base member 78. Apertures 98 in the sleeve member 88 receive tabs 86 from base member 78 in a selectively releasable spring-locking manner, thereby creating a releasable connection between base member 78 and sleeve member 88.

Second end 94 of sleeve member 88 is configured to engage insert 90 (FIG. 20) and collar 172, as will be later described herein. Sleeve member 88 includes a plurality of indicia or markings 100 disposed circumferentially around an exterior surface of sidewall 96 and adjacent second end 94 thereof. Thus, the indicia 100 will be positioned adjacent collar 172 when sleeve member 88 is engaged therewith. This is illustrated in FIG. 1.

Sleeve member 88 includes an end wall 102 (FIGS. 2C, 8 and 19) which defines a central aperture 232 and a plurality of satellite apertures 104 therein. Apertures 104 are spaced in a satellite configuration around central aperture 232 and eccentric with respect to longitudinal axis 45. The pattern or configuration of central aperture 232 and apertures 104 is substantially similar to apertures 52 and 46 of connection plate 42. Apertures 104 are uniform apertures meaning that they are of a constant shape and diameter from proximate a first surface of end wall 102 to proximate a second surface 102*a* (FIG. 8) thereof. These uniform apertures 104, which have planar walls when viewed in cross-section, allow one of resilient members 44 to pass therethrough when resilient members 44 are stretched and releasably attached to their respective discs 36, 38, 40, as will be later described herein. Central aperture 232 is not a uniform aperture in that aperture 232 is defined by a rounded, inverted cone-shaped wall. Sleeve member 88 further includes a pin-receiving ledge 105 (FIG. 6) which is concentric with central aperture 232 and extends outwardly for a distance beyond the surface of end wall 102 which faces first end 32 of assembly 30. FIG. 6 shows that pin-receiving ledge 105 is recessed relative to end wall 102.

A plurality of lobes 106 extend outwardly from the surface of end wall 102 which faces first end 32. Lobes 106 extend beyond an outer edge 290 of second end 94 of sleeve member 88. Lobes 106 are provided at intervals around the circumference of end wall 102. End wall 102 further defines a shallow recess 103 which is located inwardly of lobes 106 and is configured to be complementary to insert 90. Insert 90 is received in recess 103.

A bottom view of sleeve member 88 (FIG. 8) shows a plurality of ribs 234 extend radially inwardly from an inner surface of sidewall 96 and towards an outer circular support member 236. Ribs 234 provide structural support to sleeve member 88 when subjected to forces produced by resilient members 44 during use of assembly 30. A pair of central ribs 238 diametrically opposed to each other is connected to and extends outwardly from a circular inner support 240. Circular inner support 240 is concentric with outer circular support 236 and is located inwardly therefrom. Ribs 238 extend radially from inner circular support 240 to outer circular support 236 and are connected to each of supports 240 and 236. A gap 242 is defined between inner circular support 240 and outer circular support 236. When sleeve member 88 is engaged with second attachment assembly 35, ribs 238 act as a tongue-and-groove type attachment with slots 79 defined in first end 76 of rod 72 of second attachment assembly 35. Ribs 238 slide into and are captured by slots 79 when first end 76 of rod is received in gap 242 of sleeve member 88. This engagement between sleeve member 88 and rod 72 is illustrated in FIG. 19. When ribs 238 are slidably received within slots 79, the nibs 238 tend to restrict rotation of rod 72 about longitudinal axis 45.

Figure 2C:
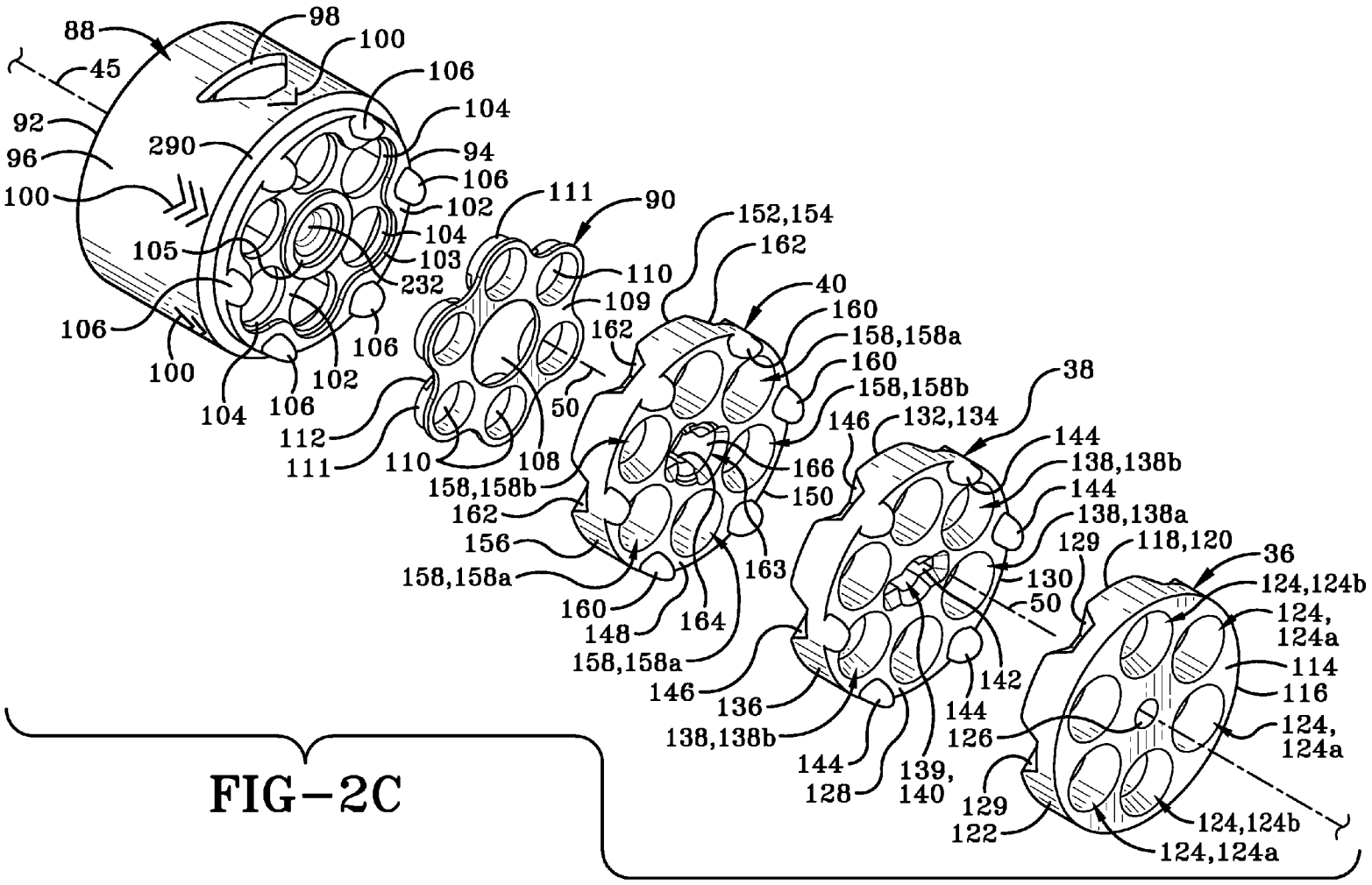
FIG. 2C is an exploded isometric view of some components of the variable resistance exercise band assembly.

Insert 90 is shown in FIGS. 2C, 6 and 7. Insert 90 is engageable in sleeve member 88 and with third disc 40. Insert 90 includes a first wall 109 and a plurality of additional walls 111 of differing diameters. Walls 111 extend outwardly and rearwardly from the circumference of first wall 109. The configurations of walls 111 and of the circumference of first wall 109 are complementary to the shape of recess 103 defined in sleeve member. As illustrated herein, both the recess 103 and circumference of walls 109 and 111 may have the appearance of a daisy-type flower. A plurality of tabs 112 extend outwardly from the peripheral surface of walls 111.

First wall 109 of insert 90 defines a central aperture 108 therein which is aligned along longitudinal axis 45 and is positioned to be in a complementary location to central aperture 232 of sleeve member 88. A plurality of satellite apertures 110, eccentric to central aperture 108, are defined in first wall 109 and are arranged in a pattern substantially similar to that of the apertures 104 of sleeve member 88. Apertures 110, on insert 90, may be dimensionally sized relatively equal in size to each other and may be smaller than central aperture 108.

FIGS. 6-8 show insert 90 engaged with end wall 102 of sleeve member 88. Insert 90 is configured to snap-fittingly engage with sleeve member 88 by means of tabs 112 traveling through the associated apertures 104 and interlockingly engaging with rear surface 102*a* of wall 102 on sleeve member 88. When insert 90 is connected to sleeve member 88 and snapped into place via tabs 112, insert 90 occupies recess 103 in sleeve member 88 and wall 109 of insert 90 is substantially flush with the surface of wall 102 which faces first end 32. Additionally, central aperture 108 on insert 90 is longitudinally aligned with central aperture 232 on sleeve member 88 and satellite apertures 110 on insert 90 are longitudinally aligned with satellite aperture 104 on sleeve member 88. Lobes 106 on sleeve member 88 project outwardly beyond first wall 109 of insert and are positioned outwardly of the circumferential surface of insert 90.

As indicated above and illustrated in FIG. 2C, assembly 30 includes a first disc 36, a second disc 38 positioned adjacent first disc 36 along longitudinal axis 45, and a third disc 40 positioned adjacent second disc 38 along longitudinal axis 45. Second disc 38 is in direct contact with each of the first and third discs 36, 40. Preferably, no gaps are defined between first disc 36 and second disc 38 and between second disc 38 and third disc 40. Third disc 40 is located between insert 90 and second disc 38 and first disc 36 is located between second disc 38 and an interior surface of collar 172 proximate first end 32 of assembly 30.

Each of first, second, and third discs 36, 38 40 defines a plurality of apertures therein. The apertures are arranged on each disc 36, 38, 40 in a substantially similar pattern to the configuration of apertures on connection plate 42, sleeve member 88 and insert 90. The pattern illustrated herein includes the provision of a central aperture which is concentric with longitudinal axis 45 and a plurality of satellite apertures located around the central aperture and eccentric from longitudinal axis 45. The central apertures on the three discs 36, 38, 40 are all aligned along longitudinal axis 45. Similarly, each of the plurality of satellite apertures on any one of the discs 36, 38, 40 is aligned with identically positioned satellite apertures on the other of the discs 36, 38, 40 and with satellite apertures in connection plate 42, sleeve member 88, and insert 90 (FIG. 6). An axis 50 that is eccentric to longitudinal axis 45 extends through each group of aligned satellite apertures. An example of one such eccentric axis 50 is shown in FIG. 2C. Thus the three central apertures are axially aligned (along longitudinal axis 45) and each group of three satellite apertures is axially aligned (along one of the axes 50). A shaft 221 of one of resilient members 44 is threaded through each aligned groups of the satellite apertures.

The first, second and third discs 36, 38, 40 will now be described herein in that order, even though third disc 40 is located adjacent insert 90 described above.

Referring to FIG. 2C and FIGS. 15-17, first disc 36 is a generally rigid cylindrical member positioned closest to first end 32 of assembly 30 relative to second disc 38 and third disc 40. First disc 36 has a first surface 114 bounded by a circumferential edge 116, a second surface 118 partially bounded by edge 120 and a cylindrical sidewall 122 extending between first and second surfaces 114, 118. First and second surfaces 114, 118 are oriented substantially at right angles to longitudinal axis 45. First and second surfaces 114, 118 of first disc 36 define a central aperture 126 and a plurality of satellite apertures 124 therein. Satellite apertures 124 are eccentrically spaced about central aperture 126 and longitudinal axis 45. In the illustrated embodiment, six apertures 124 are spaced symmetrically about central aperture 126 and longitudinal axis 45. Apertures 124 extend completely through disc 36 from first surface 114 to second surface 118 thereof.

Of these apertures 124, four apertures are labeled by reference number 124*a*. These 124*a* apertures are cylindrically shaped and are of a substantially constant diameter between first and second surfaces 114, 118. One or more of the apertures 124 is labeled by reference number 124*b*. Apertures 124*b* are bounded and defined by a frustoconical sidewall that tapers inwardly towards axis 50 which runs through the center of each aperture 124*b*. With primary reference to FIG. 15, FIG. 16, and FIG. 17, first disc 36 has an upper aperture edge 256 spaced apart from a lower aperture edge 258 and tapered aperture 124*b* is defined between them. Upper aperture edge 256 has a larger diameter than lower aperture edge 258 and the wall extending therebetween therefore tapers inwardly towards axis 50 from first surface 114 to second surface 118. In particular, tapered aperture 124*b* is bounded by a tapered frustoconical wall 125 which connects to a cylindrical wall 127 (depicted in cross-section FIG. 19). Wall 125 may be uniformly angled or tapered. Aperture 124*b* is configured to receive therein the complementary-shaped frustoconical or tapered plug 222 provided on one of resilient members 44.

Central aperture 126 extends through disc 36 from first surface 114 to second surface 118 and is aligned along longitudinal axis 45 of assembly 30. A washer receiving area 260 may be formed in the second surface 118 of first disc 36 surrounding central aperture 126. Washer receiving area 260 may include a washer receiving surface 261 which is concentric with central aperture 126. Central aperture 126 is alignable with annular regions 140 and 164 in second and third discs 38 and 40, respectively.

First disc 36 further defines a plurality of notches 129 that interrupt bottom edge 120 of disc 36 and are arranged circumferentially on disc 36. Notches 129 extend inwardly from second surface 118 towards first surface 114. Notches 128 are configured to receive complementary shaped tabs or projections which extend outwardly from second disc 38 as will be described hereafter.

With primary reference to FIG. 17, the first surface 114 of first disc 36 has a diameter 262 measured from edge 116 and extending through longitudinal axis 45. Diameter 262 of first disc 36 may be approximately two and a half inches. The upper edges defining apertures 124 all have the same diameter 264 at the first surface 114 regardless of whether the aperture is a uniform aperture 124*a* or a tapered aperture 124*b*. Diameter 264 extends through central axis 50 of the satellite apertures 124*a*. The approximate surface area of first surface 114 of first disc 136 may be found by first calculating the overall area of first surface and subtracting the area of the six satellite apertures 124*a*. This method may also provide a ratio of surface area to total aperture area. With an overall outer diameter 262 of 2.5 inches and six apertures 124 with diameters of 0.75 inches (¾ of an inch) the total surface area of 114 is approximately 4.9 $in^2$. The sum of the aperture 124 areas is found by finding the area of a single aperture 124, which is 0.44 $in^2$ and multiplying this by six holes; which is 2.64 $in^2$. That is the total surface area of first surface 114 is approximately 4.9 $in^2$ minus 2.6 $in^2$, which is roughly 2.27 $in^2$. A total sum of aperture area to surface area is generally about 1:1. Stated otherwise, the ratio of aperture area is about 2.64 $in^2$ and the surface area of first surface 114 is 2.27 $in^2$, which is about a ratio of 1:1. In accordance with an aspect of the present invention, while the ratio shown is about 1 to 1, it is contemplated that a sum of aperture area relative to surface area could be in the range of 0.5:1 to about 2:1.

Referring to FIG. 2C and FIGS. 12-14, second disc 38 is described in greater detail. Second disc 38, like first disc 36, is a generally rigid member that is cylindrically shaped and is disposed between first disc 36 and third disc 40. Second disc 38 includes a first surface 128 bounded by circumferential edge 130 spaced opposite a second surface 132 bounded by bottom circumferential edge 134. A cylindrical sidewall 136 extends between first and second surfaces 128, 132. Second disc 38 is stacked adjacent first disc 36 and is aligned along longitudinal axis 45. First and second surfaces 128, 132 are disposed substantially at right angles to longitudinal axis 45.

First and second surfaces 128, 132 of second disc 38 define a central aperture 139 and a plurality of satellite apertures 138 therein which extend through disc 38 from first surface 128 to second surface 132. Central aperture 139 has a central annular region 140 therein that is aligned along longitudinal axis 45 and is further aligned with central aperture 126 of first disc 36. Central annular region 140 and central aperture 126 thereby define a common hole or passageway through a portion of assembly 30. Disc 38 further defines two pin passageways 142 (FIGS. 13 and 14) integrally formed with annular region 140 and extending radially outwardly therefrom and from longitudinal axis 45. Pin passageways 142 are aligned with each other and are diametrically opposed to each other. Passageways 142 and a portion of annular region 140 create a narrow passage through second disc 38, the purpose of which will be later described herein. A chamfer 137 (FIG. 14) is defined in first surface 128 around at least a portion of central annular region 140 and pin passageways 142. Chamfer 137 angles inwardly from first surface 128 and toward central axis 45 and second surface 132.

As best seen in FIGS. 12 and 13, the two pin passageways 142 are separated from each other by two opposed projections which extend inwardly toward central annular region 140. Each projection includes a protrusion 251 and a protrusion 255 which are separated from each other by a pin receiving area 253. The two protrusions 251 are located opposite each other; the two protrusions 255 are located opposite each other; and the two pin receiving areas 253 are located opposite each other. FIG. 12 shows that the two protrusions 255 terminate substantially flush with second surface 132 and that the two protrusions 251 terminate a distance inwardly from second surface 132, thereby creating a gap between protrusions 251 and second surface 132. Pin receiving areas 253 are located a further distance inwardly from second surface 132 relative to protrusions 251.

When second disc 38 is stacked adjacent first disc 36, chamfers 137 on second disc 38 are located proximate the surface which defines washer receiving area 260 in first disc 36.

When second disc 38 is stacked adjacent third disc 40, the gap between protrusions 251 and second surface 132 together with a gap defined between pin ledges 165 and first surface 148 of third disc 40 creates a space within which pins 214 on selector rod 186 may travel during engagement and disengagement of second disc by selector rod 186. This space may be seen in FIG. 19.

Satellite apertures 138 are located eccentrically relative to central aperture 139 and longitudinal axis 45 and are positioned to align with apertures 124 in first disc 36 and thereby define a common hole, aperture or bore through a portion of assembly 30. Four of the apertures, depicted by reference number 138*a*, are uniform apertures which are similar to apertures 124. Two of the apertures, depicted by the reference number 138*b*, are defined by frustoconical sidewalls that taper inwardly towards the center of each respective aperture 138*b* from first surface 128 towards second surface 132. Apertures 138*b* are similarly configured to apertures 124*b* and are configured to receive a tapered plug 222 of one of resilient members 44 therein. Second disc 38 includes an upper edge 252 and a lower edge 254 of tapered aperture 138*b*. Upper edge 252 includes or has a larger diameter than lower edge 254, with the sidewall of aperture 138*b* tapering inwardly towards axis 50 from first surface 128 toward second surface 132.

Second disc 38 further defines a plurality of protrusions 144 located adjacent to circumferential edge 130 and which extend outwardly and forwardly therefrom. Protrusions 144 are spaced at intervals that are generally equivalent to the intervals between notches 129 on second surface 118 of first disc 36. Protrusions 144 are generally complementary to notches 129 and are receivable therein, thereby interlockingly engaging first disc 36 and second disc 38 together. Furthermore, when protrusions 144 nest in notches 129, the alignment of these two components ensures that apertures 124 in first disc 36 will align with apertures 138 in second disc 38. As indicated above, this arrangement creates a series of bores through first and second discs 36, 38 through which shafts 221 of resilient members 44 extend.

Second disc 38 further defines a plurality of recesses 146 in the second surface 132 thereof. Recesses 146 are spaced around the circumference of second surface 132 in a manner similar to protrusions 144. In other words, recesses 146 are spaced at regular intervals around the circumference of second surface 132 and are substantially in longitudinal alignment with protrusions 144.

Referring now to FIG. 2C and FIGS. 9-11, third disc 40 is described in greater detail. Third disc 40 includes a first surface 148 defined by a circumferential edge 150 spaced opposite a second surface 152 bounded by a circumferential edge 154. Third disc 40 is stacked between insert 90 and second disc 38 and in such a way that first and second surfaces 148, 152 of third disc 40 are generally at right angles to longitudinal axis 45. A cylindrical sidewall 156 extends between edges 150 and 154.

Third disc 40 is a generally cylindrical member generally similar to second disc 38 but with some minor differentiating features (which will be described hereafter).

Third disc 40 defines a central aperture 163 aligned along longitudinal axis 45. Central aperture 163 includes a small annular region 164 with two opposed passageways 166 extending radially outwardly from annular region 164. FIG. 10 shows that the two opposed passageways 166 generally resemble a hyperbola. The shape of arcuate pin receiving area 253 in second disc 38 is similar to the hyperbolic shape of hyperbolic passageway 166 in third plate 40 but pin receiving area 253 is rotatably shifted about thirty degrees relative to longitudinal axis 45.

Passageways 166 in third disc 40 are separated from each other by a pair of opposed projections which extend inwardly toward annular region 164. Each projection includes a protrusion 249 and a protrusion 250 which are separated from each other by a radially extending pin receiving area 248. The two protrusions 249 are aligned and opposite each other; the two protrusions 250 are aligned an opposite each other; and the two pin receiving areas 248 are aligned an opposite each other. As best seen in FIG. 9, both of the protrusions 249 terminate substantially flush with second surface 152 and both of the protrusions 250 terminate a distance inwardly from second surface 152 such that a gap is created between protrusions 250 and second surface 152. Pin receiving areas 248 each have a surface that is located a distance further inwardly from second surface 152 relative to protrusions 250.

It should also be noted that protrusions 250 on third disc 40 may be positioned about 60 degrees apart from protrusions 251 on second disc 38. Additionally, each pin receiving surface 253 on second disc 38 may be about 60 degrees wider than each pin receiving area 248 on third disc 40. This "misalignment" between these components on second and third discs 38, 40 aids in ensuring that additional rotation of collar 172 has to be undertaken to engage in order to additionally engage third disc 40 when second disc 38 is already captured by selector rod 186.

When third disc 40 is positioned adjacent sleeve 88 and insert 90, the gap between protrusions 250 and second surface 152, together with a gap defined between recessed pin receiving ledge 105 on sleeve 88 and end wall 102 thereof, creates a space within which pins 216 of selector rod 186 may travel when third disc 40 is being engaged or disengaged by selector rod 186 during use. This space can be seen in FIG. 19.

FIG. 11 shows that first surface 148 of third disc 40 defines a pair of opposed pin ledges 165 which are each recessed a distance inwardly from first surface 148. A pair of opposed chamfers 147 is defined in first surface 148 with each chamfer 147 extending between pin ledges 165. Chamfers 147 angle downwardly from first surface and inwardly toward central axis 45 and second surface 152. When third disc 40 is positioned adjacent second disc 38, chamfers 147 and pin ledges 165 on third disc 40 are positioned opposite pin-receiving area 253 on second disc 38.

Third disc 40 further defines a plurality of satellite apertures 158 therein. Six apertures 158 are arranged in an orbital satellite orientation eccentric relative to central aperture 163 and longitudinal axis 45. Satellite apertures 158 include four uniform apertures indicated by reference number 158*a* which extend from first surface 148 through to second surface 152; and two frustoconical or tapered apertures indicated by reference number 158*b* which are each configured to receive a tapered plug 222 at one end of one of resilient members 44. Referring still to FIG. 9 and FIG. 10, tapered aperture 158*b* is defined between a top aperture edge 244 and a bottom aperture edge 246. Top aperture edge 244 diameter is larger than bottom aperture edge 246. Thus, aperture 158*b* tapers inwardly towards center axis 50.

Third disc 40 further defines a plurality of protrusions 160 circumferentially spaced about, adjacent and interrupting outer edge 150 thereof. Protrusions 160 extend outwardly from first surface 148. These protrusions 160 are complementary to recesses 146 defined in second surface 132 of second disc 38 and ensure a releasable mating relationship between second and third discs 38, 40. When second and third discs 38, 40 are so mated, the central apertures 139 and 163 are aligned with each other and the satellite aperture 138 and 158 are aligned with each other.

Third disc 40 further defines recesses 162 in second surface 152 thereof and interrupting outer circumference edge 154. Recesses 162 are shaped to be complementary to lobes 106 which extend outwardly from surface 102 of sleeve member 88. The mating relationship between lobes 106 on sleeve member 88 and recesses 162 on third disc 40 ensures the alignment of apertures 158 in third disc 40 with apertures 104 in sleeve member 88, and apertures 110 in insert 90.

A friction-reducing ring or a non-stick coating (such as ceramic or Teflon®) may be applied directly to part or all of insert 90 and possibly to the first, second, and third discs 36, 38, and 40 provided in assembly 30. Alternatively, the entire insert 90 or discs 36, 38, 40 may be fabricated from this friction-reducing material. If the friction-reducing material is applied to only part of insert 90 or discs 36, 38, 40, it may be applied to a face which bounds and defines the apertures therein that are configured to receive resilient members 44 therethrough. The central apertures in insert 90 and discs 36, 38, 40 which do not receive resilient members 44 therethrough may be free of the friction-reducing material. The friction-reducing material may coat the face or other surfaces of insert 90 and/or discs 36, 38, 40 and/or may be bonded thereto. Alternatively, the friction-reducing coating may be provided as a washer, or be provided on a washer that is inserted into or is located adjacent to the aperture. If a washer is utilized, then the surface of the washer which will contact resilient member 44 will include the friction-reducing material. The entire washer may be fabricated from the friction-reducing material. The friction-reducing material is utilized to materially reduce friction within assembly 30. Without insert 90, the expected life of resilient members 44 utilized in assembly 30 may be reduced by approximately 50%. Thus, inclusion of insert 90 greatly improves the useful life of resilient members 44.

Referring now to FIG. 19, resilient members 44 are threaded through the aligned satellite apertures of one or more of first disc 36, second disc 38, and third disc 40, through insert 90, sleeve 88, and are then secured to connection plate 42. Tapered plug 222 of each resilient member 44 in the assembled device is configured to fit within one of the substantially complementary-shaped frustoconical satellite apertures of the associated one of the first, second or third discs 36, 38, or 40. In accordance with an aspect of the present invention, tapered plug 222 of resilient member 44*a* fits within frustoconical aperture 124*b* of first disc 36. Tapered plug 222 of resilient member 44*b* fits within frustoconical aperture 124*b* of first disc 36. Tapered plug 222 of resilient member 44*c* fits within frustoconical aperture 138*b* of second disc 38. Tapered plug 222 of resilient member 44*d* fits within frustoconical aperture 138*b* of second disc 38. Tapered plug 222 of resilient member 44*e* fits within frustoconical aperture 158*b* of third disc 40. Tapered plug 222 of resilient member 44*f* fits within frustoconical tapered aperture 158*b* of third disc 40.

At this point it is noteworthy that the respective tapered apertures 124*b*, 138*b*, and 158*b*, do not line up with each other. This ensures that the tapered plug 222 on any resilient member 44 does not pass through two tapered holes in adjacent discs. Stated otherwise, tapered aperture 124*b* aligns with uniform aperture 138*a* and uniform aperture 158*a*. Uniform aperture 124*a* aligns with tapered aperture 138*b* and is aligned with uniform aperture 158*a*. Additionally uniform aperture 124*a* is aligned with uniform aperture 138*a* and is aligned with tapered aperture 158*b*.

As indicated previously herein, tubular housing includes a base member 78, sleeve 88 and collar 172. Referring to FIGS. 1, 2D, 19, and 34, collar 172 may be a generally rigid, cup-shaped member. Collar 172 has a first end 174 and a second end 176 with a tubular wall 175 extending therebetween. First end 174 and tubular wall 175 bound and define a cavity 284 (FIG. 19). First end 174 is substantially continuous and is disposed opposite an opening to cavity 284, where the opening is defined by second end 176. A circumferential wall 286 (FIG. 34) on first end 174 defines a through-aperture 178 which is in communication with cavity 284. Aperture 178 is configured to receive part of adjustment assembly 170 (FIG. 2D) therethrough as will be described below. A pair of opposed receiving surfaces 180 are provided on an exterior surface of first end 174 adjacent aperture 178. One or more ribs 288 (FIGS. 19 and 34) are provided on first end 174 of collar 172. Ribs 288 extend radially outwardly from circumferential wall 286 and then for a distance along tubular wall 175. Ribs 288 are provided to strengthen top end 174 of collar 172. Collar 172 further includes an indicator 177 provided on an exterior surface tubular wall 175. Indicator 177 is selectively positionable to align with indicia 100 on sleeve member 88 when assembly 30 is used.

Figure 2D:
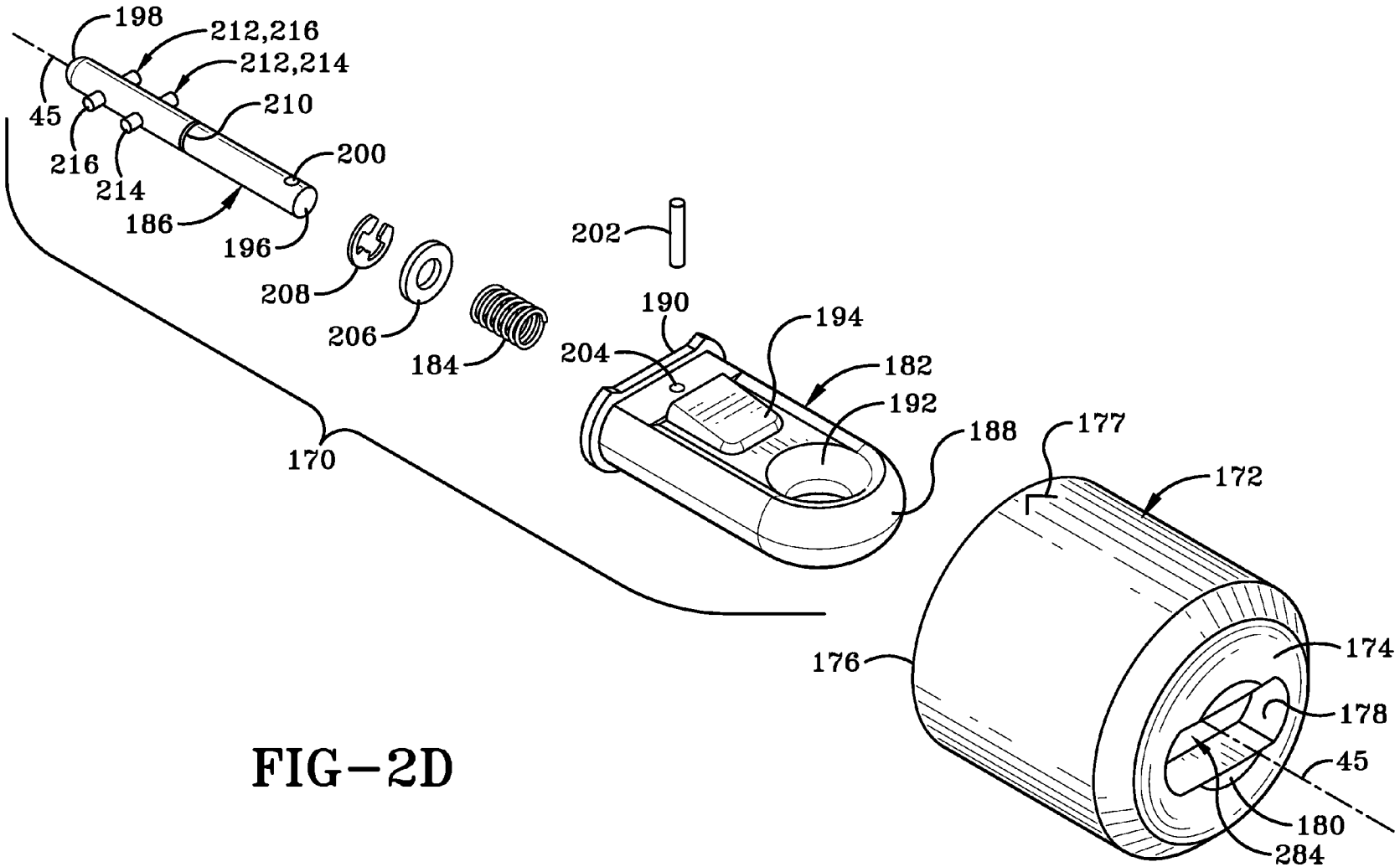
FIG. 2D is an exploded isometric view of some components of the variable resistance exercise band assembly.
Figure 2E:
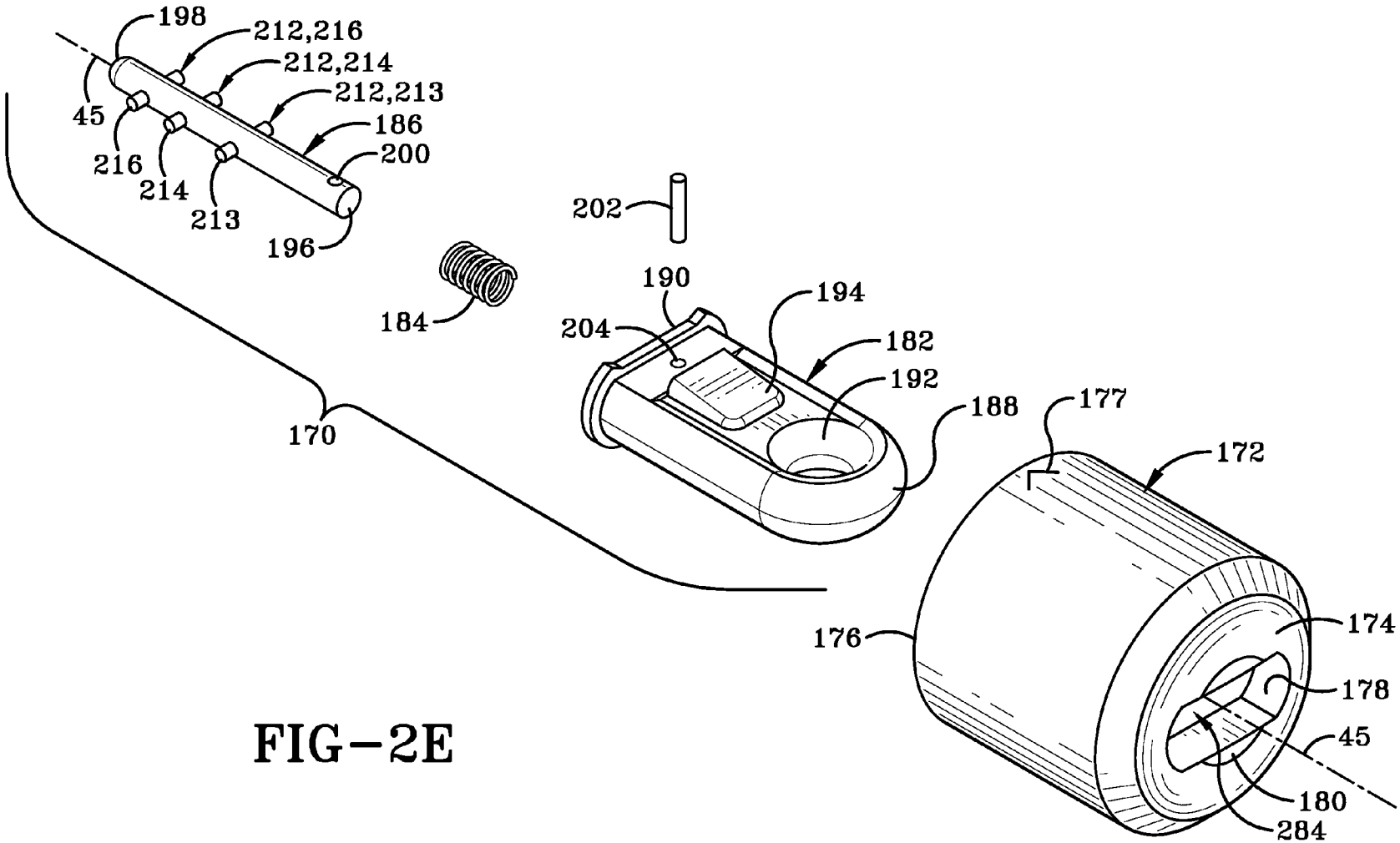
FIG. 2E is an exploded isometric view of an alternative embodiment of the adjustment assembly which forms at least a part of the first attachment assembly.
Figure 34:
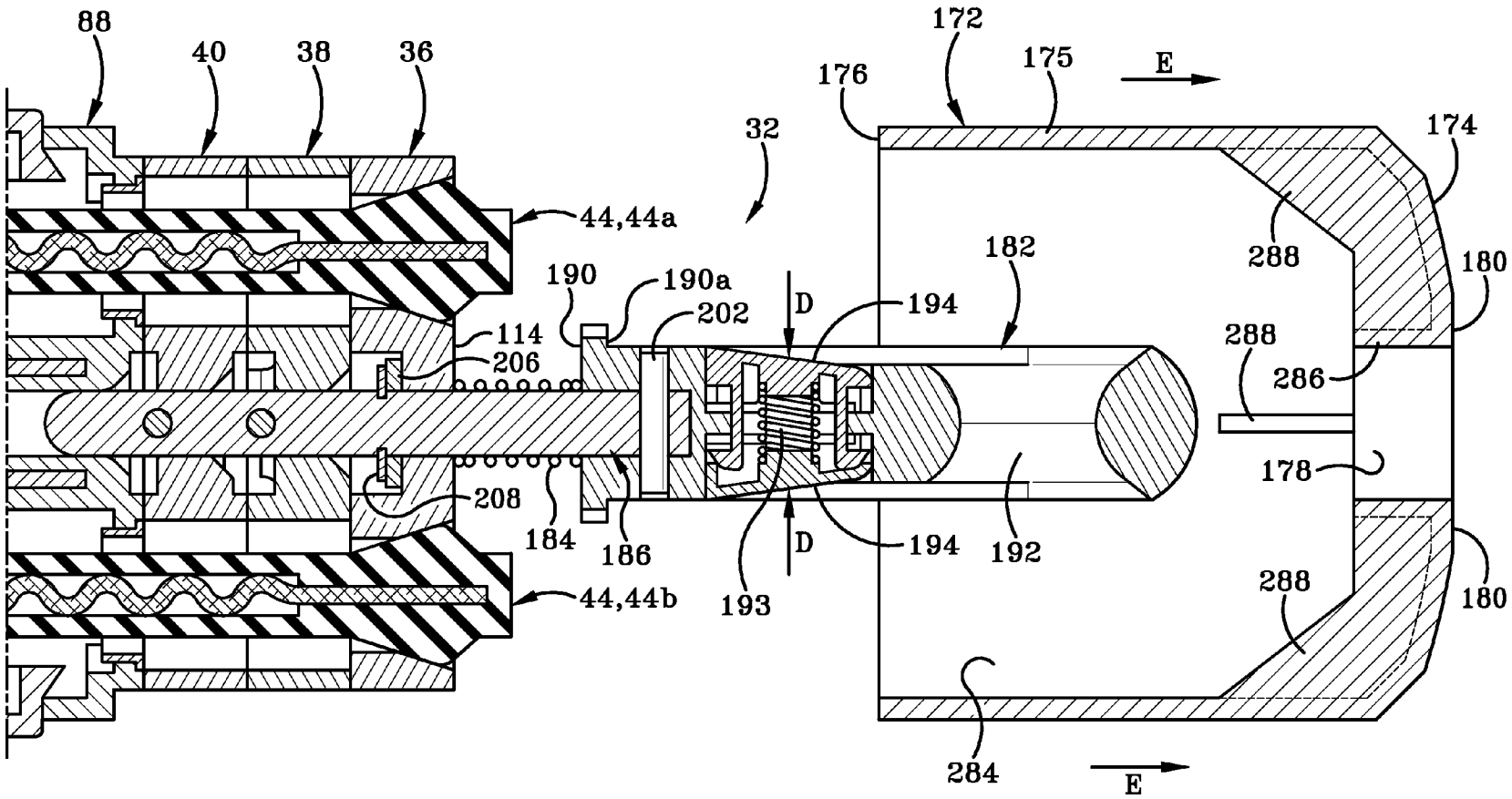
FIG. 34 is a cross-sectional view similar to that of FIG. 19 depicting a pair of spring tabs compressed inwards to remove a collar.

Adjustment assembly 170 is described in greater detail hereafter with reference being had to FIGS. 2D, 19 and 34. Adjustment assembly 170 includes an upper member 182, a compression coil spring 184, and a selector rod 186. Upper member 182 may be a generally U-shaped rigid member that has a first end 188 and a second end 190. An aperture 192 is defined in upper member 182 adjacent upper end 188. Aperture 192 is adapted to receive a carabiner clip or other connection device therethrough in order to secure resistance band assembly 30 to a workout accessory or other piece of exercise equipment. A pair of retention tabs 194 is provided on opposing side surfaces of upper member 182. Retention tabs 194 are biased outwardly by a spring 193 (FIG. 19) located within a bore of upper member 182. Retention tabs 194 are operatively engaged with spring 193 and are biased away from each other by spring 193. Tabs 194 may be depressed toward each other in the direction of arrow "D" (FIG. 34) to compress spring 193. Retention tabs 194 are moved toward each other when upper member 182 is to be passed through aperture 178 in collar 172. Once retention tabs 194 are released, tabs 194 will move away from each other under force of spring 193 returning to its original shape and position. When tabs 194 are depressed toward each other in the direction of arrow "D" (FIG. 34) and upper member 182 is moved in the direction of arrow "E", upper member 182 slides through aperture 178 in collar 172. Once the tabs 194 clear first end 174 on collar 172, the tabs 194 move in the opposite direction to arrow "D" and a portion of each tab 194 slides onto receiving areas 180. Retention tabs 194 thereby become engaged with receiving area 180 on collar 172 and prevent upper member 182 from being moved in the opposite direction of arrow "E" unless and until tabs 194 are depressed toward each other once again. It should also be noted that a shoulder 190*a* on upper member 182 engages an inner surface of first end 174 and prevents further movement of upper member 182 in the direction of arrow "D". Thus, retention tabs 194 detachably engage collar 172 and attachment assembly 170 together. Collar 172 may be quickly and easily removed from assembly 30 by depressing tabs 194 in the direction of arrow "D" and then sliding collar 172 off upper member 182 in the direction of arrow "E"; and may be quickly and easily reconnected therewith by reversing these steps. This quick disconnect/reconnect feature enables a user to quickly and easily access the resilient members 44 within the interior of assembly 30.

Upper member 182 further defines a hole 191 (FIG. 19) in second end 190 thereof. Hole 191 is provided for engagement of selector rod 186 with upper member 182. Referring to FIGS. 2D, 19, and 34, selector rod 186 may be a generally rigid member that is cylindrical in shape and is oriented on upper member 182 so that rod 186 will extend along longitudinal axis 45 and be concentric therewith when assembly 30 is assembled for use.

While upper member 182 is shown and described herein as being a component that extends through aperture 178 in collar 172 and is of a relatively fixed orientation with respect to collar 172, it will be understood that upper member 182 may be differently configured. In particular, upper member 182 may be configured so that at least a portion of the upper member which extends outwardly from collar 172 is able to rotate or swivel about an axis extending along selector rod 186 (i.e., about an axis generally parallel to the longitudinal axis of the housing). Still further, the rotatable or swiveling portion of the upper member may be able to rotate or swivel through 360°. Alternatively, the swiveling portion may rotate or swivel through less than 360° if that is considered desirable. This swiveling upper member is selectively securable to a workout accessory and thus may provide additional freedom of movement of that workout accessory during the performance of an exercise using assembly 30.

Selector rod 186 includes a first end 196 spaced apart from a rounded tip 198. An annular recess 210 is defined approximately midway along the length of selector rod 186: A plurality of disc-selector pins 212 extends radially outwardly from the outer circumferential surface of selector rod 186. Pins 212 are located between tip 198 and annular recess 210. Pins 212 are oriented generally at right angles to a longitudinal axis of selector rod 186 and will therefore also be oriented generally at right angles to longitudinal axis 45 of assembly 30. As illustrated in FIG. 2D, pins 212 include upper selector pins 214 and lower selector pins 216.

Upper and lower selector pins 214, 216 comprise either a single pin which extends through a hole in selector rod 186 and outwardly for a distance beyond the circumferential surface thereof in one direction or two portions of the single pin may extend outwardly in two opposite directions from rod 186. Alternatively, a pair of individual pin ends which are secured to selector rod 186 may extend outwardly from the circumferential surface, being aligned with each other and located diametrically opposite each other. Either configuration will be referred to herein as a "pin". Pins 214 are engaged with selector rod 186 and extend from the circumferential surface thereof along the same plane but in different directions. Pins 216 are positioned between tip 198 and upper pins 214. Pins 216 extend outwardly from a location where they are secured to selector rod 186. Pins 216 comprise a pair of pin ends which are aligned with each other and are located diametrically opposite each other. Pins 216 extend from the circumferential surface of selector rod 186 along the same plane but in different directions. Upper pins 214 and lower pins 216 are longitudinally aligned with each other and are spaced a distance apart from each other along selector rod 186. This distance is approximately equal to the thickness of second plate 38. (The thickness of second plate 38 is measured between first and second surface 128, 132.) All pins 212 are generally circular in cross-section and are shaped to be complementary to pin passageways 142 and 166 in second and third discs 38, 40; and additionally to a portion of the pin-receiving areas 248 in third disc 40. Pins 212 are rigidly affixed to selector rod 186 and move in unison therewith. Pins 212 extend generally perpendicular to longitudinal axis 45.

During fabrication of resistance band assembly 30 an E-clip 208 is engaged in annular recess 210. First end 196 of selector rod 186 is passed through an aperture in a washer 206 and is then inserted through central aperture 126 of first disc 36. Washer receiving area 260 of first disc 36 receives washer 206 when selector rod 186 extends through the center of washer 206 and through central aperture 126 of first disc 36. When so engaged, selector rod 186 will be able to rotate within central aperture 126 while first disc 36 remains relatively stationary relative to longitudinal axis 45.

After exiting central aperture 126 of first disc 36, first end 196 of selector rod 186 is inserted through the center of a coil spring 184 and is then inserted into hole 191 defined in second end 190 of upper member 182. A diametrically extending aperture 200 formed in rod 186 adjacent first end 196 is aligned with a similarly oriented hole 204 in upper member 182. A locking pin 202 is inserted through the aligned hole 204 and aperture 200. Thus, selector rod 186 secures first disc 36 and upper member 182 together. As shown in FIG. 34, when first disc 36 and upper member 182 are secured together, spring 184 is located between first surface 114 of first disc 36 and second end 190 of upper member 182.

It should be noted that prior to inserting first end 196 of selector rod 186 through central aperture 126 of first disc 36, first end 196 may be inserted through the aligned central apertures 163 and 139 of third and second discs 40, 38, respectively. If this is the case, then third disc 40 and second disc 38 must be oriented so that pins 212 on selector rod 186 pass through the pin passageways 166 and 142, respectively.

Alternatively, after being secured to first disc 36, second end 198 of selector rod 186 may be passed through the central aperture 139 and pin passageways 142 of second disc 38 and then through central aperture 163 and pin passageways 166 of third disc 40. In this instance, selector rod 186 extends outwardly beyond washer-receiving surface 261 of first disc 36 and through annular region 140 and annular region 164 of second and third discs 38, 40 respectively. Passageways 142 and a portion of annular region 140 create a narrow passage through second disc 38 and through which pins 212 on selector rod 186 may pass. Pin passageways 142 are shaped complementary to pins 212 on selector rod 186. It will be understood that selector rod 186 has to be in a fairly precise orientation relative to passageways 142 in order for pins 212 to pass through said pin passageways 142. (It should be further noted that if only a single pin 212 extends outwardly in only one direction from selector rod 186 then only one passageway 142 will be provided in second disc 38.)

Third disc 40 includes pin ledge 165 adjacent annular region 164 for receiving upper pins 214 of selector rod 186 during rotation of collar 172. Passageways 166 in third disc 40 permit rotation of pins 216 extending radially from selector rod 186 therethrough even when rotated within a certain angle of rotation, as defined by the hyperbolic passageway. Passageways 166 on third disc 40, protrusions 249, 250 and pin receiving area 248 cooperate together to interact with bottom pins 216 to engage third disc 40 when selected by a user. When third disc 40 is not selected by a user, bottom pins 216 pass through passageways 166 and are rotatable within the arc length defined by hyperbolic shape of the passageway.

As indicated above and as shown in FIG. 19, selector rod 186 is configured to extend through the aligned central apertures 126 of first disc 36, 139 of second disc 38, and 163 of third disc 40. Spring 184 is positioned around selector rod 186 and is located between second end 190 of upper member 182 and first surface 114 of first disc 36. Second end 190 of upper member 182 acts as a first spring seat and first surface 114 of first disc 36 acts as a second spring seat for spring 184. Spring 184 is compressible along the longitudinal axis 45 during operation of assembly 30. The above-described configuration provides a receiving area in cavity 284 defined in collar 172 for the first end 218 of resilient members 44 to rest. This can be seen in FIG. 19.

Selector rod 186 further extends through central aperture 108 of insert 90 and into the rounded, inverted cone shape of central aperture 232 of sleeve member 88. In particular, the central aperture 232 is configured to receive spherical tip 198 of selector rod 186 therein. Tip 198, when contacting inverted rounded cone surface of aperture 232, permits a smooth transition of tip 198 through central aperture 232. Pin receiving ledge 105 (FIG. 6) on sleeve 88 is provided to receive bottom pins 216 of selector rod 186 during rotation of selector rod 186, particularly when third disc 40 is being engaged with selector rod 186 or disengaged therefrom, as will be further described herein. Chamfers 137 on second disc 38 and 147 on third disc 40 aid in guiding the rounded tip 198 of selector rod 186 into the adjacent central apertures 139 and 163, respectively, after first attachment assembly 33 has been moved from an at rest position (shown in FIG. 1) to a use position (shown in FIG. 29) and then back to the at rest position.

Turning back now to collar 172 as shown in FIG. 19; second end 176 of collar 172 terminates closely adjacent a first edge 290 of sleeve member 88 when assembly 30 is assembled. A small gap is defined between second end 176 of collar 172 and first edge 290 of sleeve member 88. This gap is sufficient to permit collar 172 to rotate with upper member 182 while allowing sleeve 88 to stay relatively stationary with respect to longitudinal axis 45. Still referring to FIG. 19, second edge 92 of sleeve member 88 contacts a lip 292 on first end 80 of base member 78 when tabs 86 are inserted through apertures 98 defined in sleeve member 88. Because first end 80 of base member 78 is secured to sleeve member 88 via tabs 86, base member 78 remains stationary with sleeve member 88 relative to longitudinal axis 45 when collar 172 is rotated about longitudinal axis 45. When assembly 30 is assembled, the tip 198 of selector rod 186 extends outwardly beyond second surface 152 of third disc 40 and beyond second end 176 of collar 172 and first edge 290 of sleeve 88. Tip 198 of selector rod terminates before second edge 92 of sleeve member 88 and first edge 292 of base member 78.

The components of assembly 30 depicted FIG. 18 are all generally affixed together and generally do not rotate about longitudinal axis 45 when assembly 30 is subjected to extension forces on resilient members 44 during use. Bulbous members 224 are releasably secured to connection plate 42 (FIG. 19) and are selectively detachable therefrom if base member 78 is released from its engagement with sleeve member 88. This disengagement of base member 78 from sleeve member 88 would occur if a user was customizing the resistance band assembly 30 or needed to replace a damaged resilient member 44.

With primary reference to FIG. 19, the cross-sectional view of first end 32 is depicted with first end 32 oriented in a first direction. The following description will be made with the understanding that first end 32 is facing in this first direction, however, the directional orientation used in this description will be understood to change relative to any subsequent changes in the orientation of first end 32.

Figure 20:
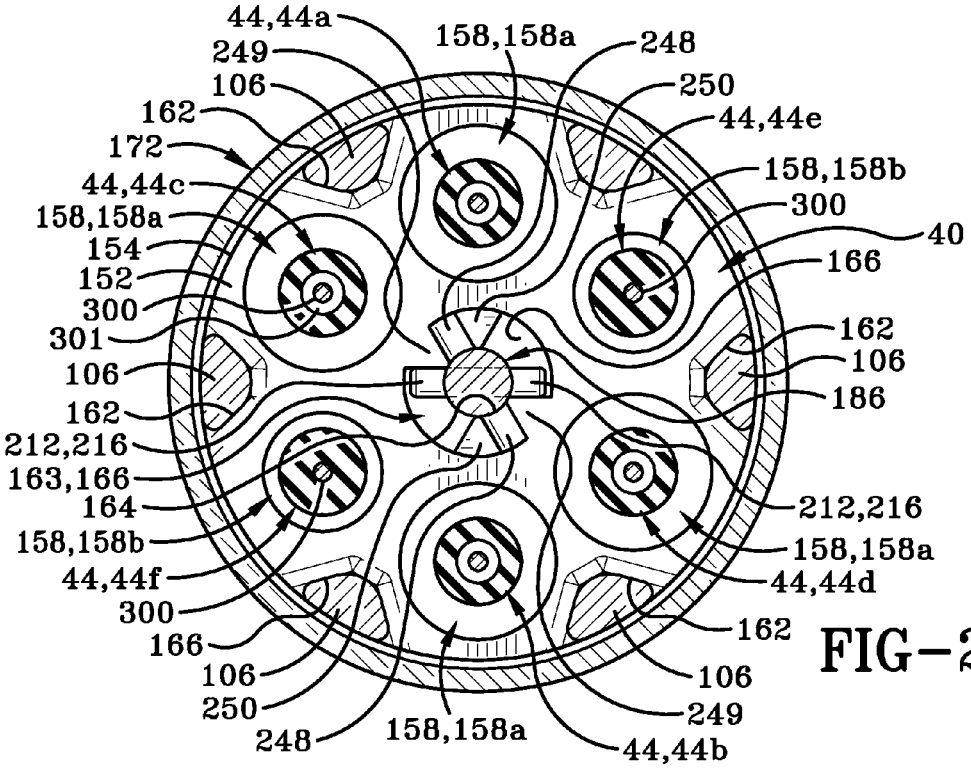
FIG. 20 is a section view taken along line 20-20 in FIG. 19 depicting the bottom of the third disc.

In an assembled position, first end 32 facing in the first direction, retention tabs 194 extend outwardly away from each other a distance greater than the diameter of aperture 178. Tabs 194 therefore make contact with landing surfaces 180 to lock collar 172 in place. This locking relationship ensures that collar 172 does not slide in the first direction during use of assembly 30 in the performance of an exercise movement. As previously discussed herein, collar 172 is an inverted cup-like member defining a cavity 284 configured to house selector rod 186, portions of resilient members 44, and the three disc plates 36, 38, and 40. As depicted in FIG. 20, passageways 166 in third disc 40 permit pin 216 to pass therethrough when the third disc 40 is not selected by a user. FIG. 20 shows a configuration where selector rod 186 is in a position where the rod 186 only lifts first disc 36 via washer 206 and clip 208 if first attachment assembly 33 is moved away from first end 32 of the tubular housing. Both of the second disc 38 and third disc 40 are not engaged by selector rod 186 when in the position illustrated in FIG. 20. In this position, selector rod 186 passes through annular region 164 and resilient members 44*a* and 44*b* are stretched through cylindrical apertures 158*a*.

Figure 21:
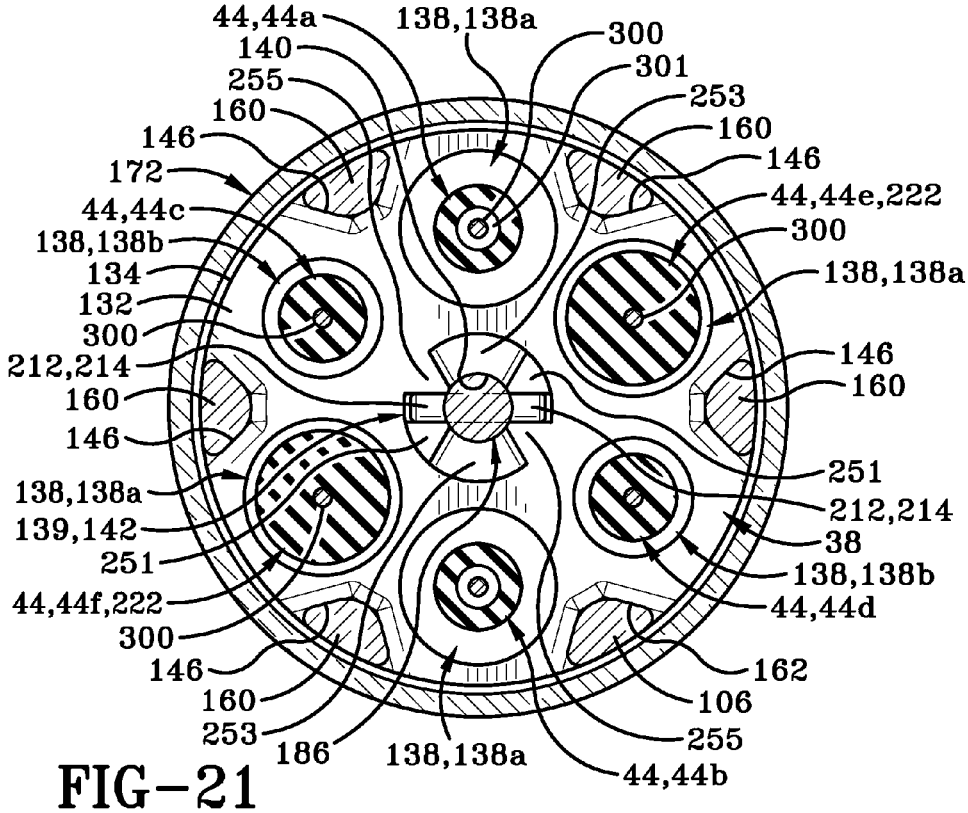
FIG. 21 is a section view taken along line 21-21 in FIG. 19 depicting the bottom of the second disc.

As depicted in FIG. 21, selector rod 186 and pins 214 are oriented in the same longitudinal plane as the orientation of pins 216 in FIG. 20. In this configuration, pins 214 pass through pin passageways 142 in second disc 38 (FIG. 2C) such that the second disc 38 is not engaged with rod 186.

Figure 22:
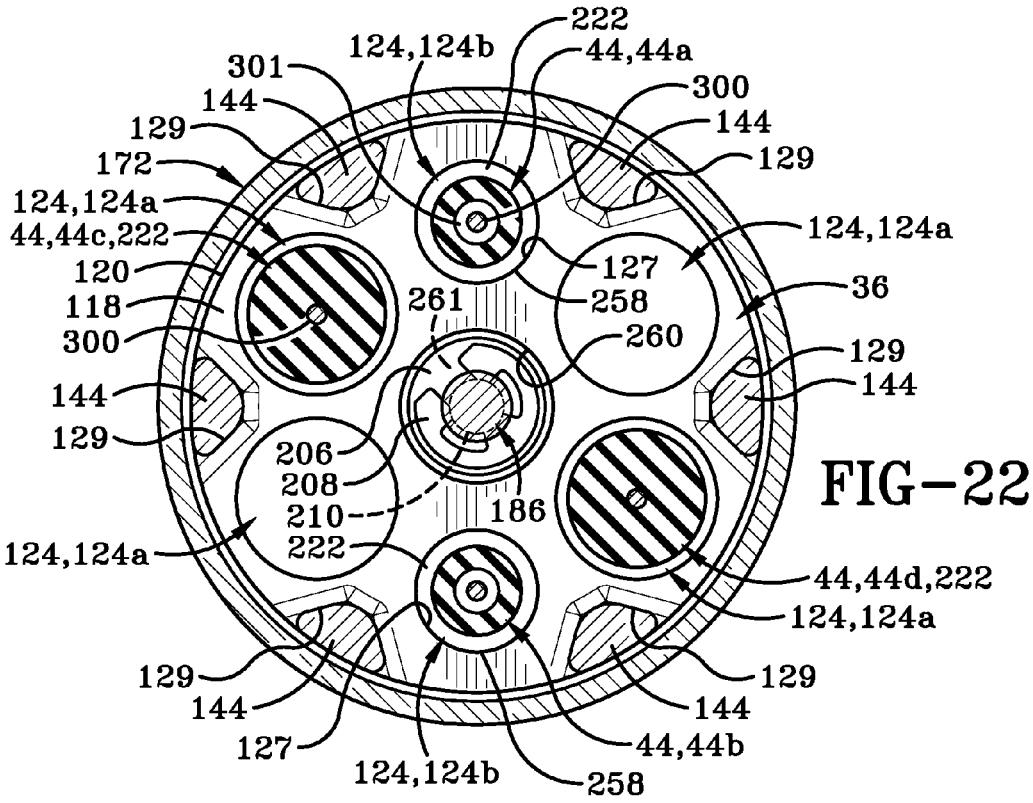
FIG. 22 is a section view taken along line 22-22 in FIG. 19 depicting the bottom of the first disc.

As depicted in FIG. 22, selector rod 186 is engaged with the bottom of first disc 36 by E-clip 208 and washer 210. It should be noted that resilient members 44*f* and 44*e* are not shown in the cross-section taken along line 22-22 in FIG. 19 because the tapered plugs 222 of resilient members 44C and 44*e* only extend in the first direction from second end to third disc 40.

Reference will now be made to the operation of assembly 30. To complete an exercise, the user has an option of selectively choosing a desired resistance value based on the number of resilient members 44*a-f* engaged in a pulling motion. In operation and with reference to FIG. 24 and FIG. 25, the user ensures the indicator 177 on collar 172 aligns with one chevron indicia 100 on sleeve member 88. This advises the user that only first disc 36 is selected with resilient members 44*a* and 44*b* connected thereto. Thus, the lowest level of resistance will be applied by assembly 30 to the exercise motion. An exemplary exercise structure is disclosed in the parent application, U.S. patent application Ser. No. 13/836,359, filed Mar. 15, 2013, wholly owned by the applicant and entitled "STRENGTH TRAINING AND STRETCHING SYSTEM", the entire specification of which is hereby incorporated by reference as if fully written herein. An additional exemplary exercise structure is further disclosed in FIGS. 37-46 herein.

Figure 37:
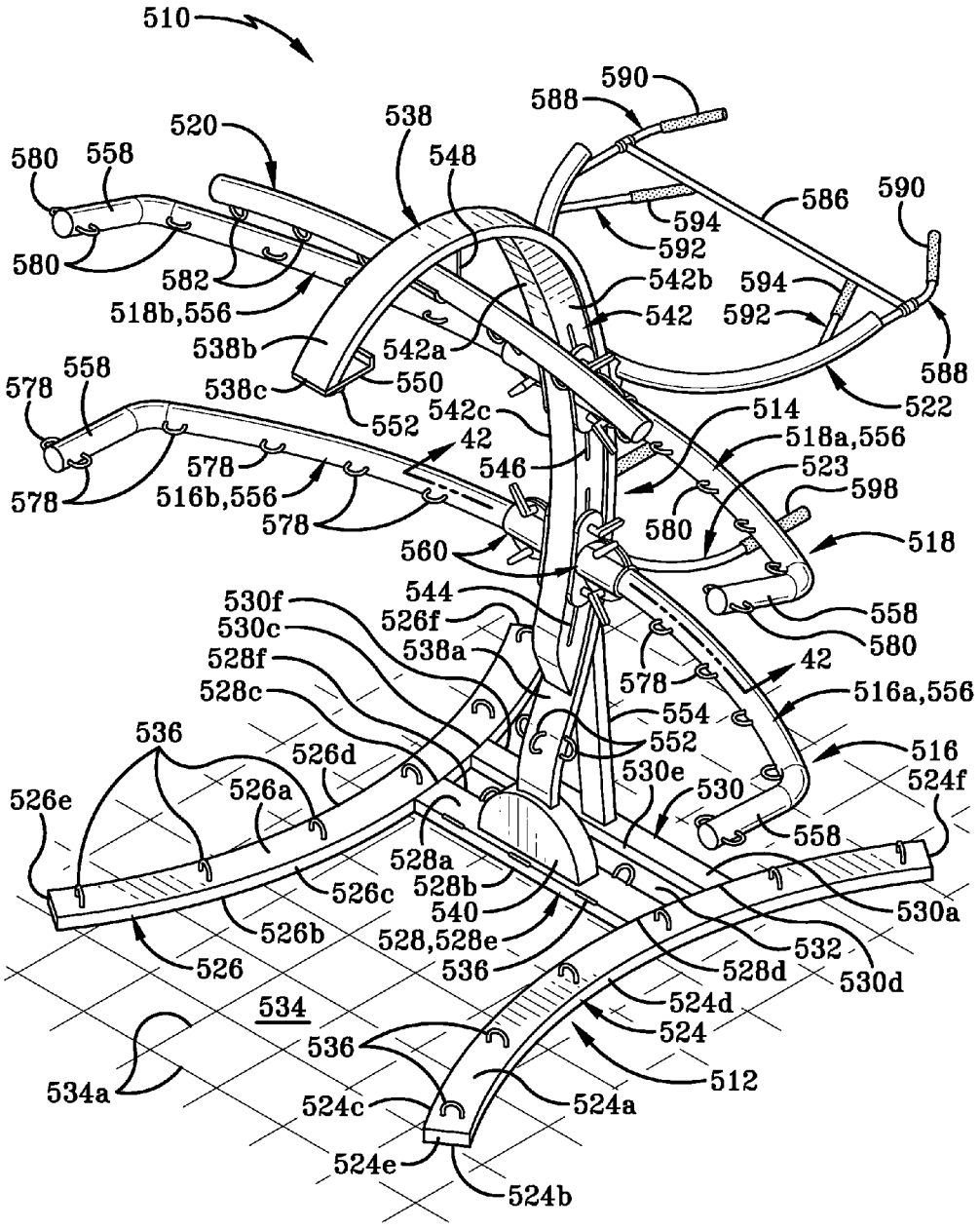
FIG. 37 is a perspective view of a fitness station in accordance with an aspect of the present invention.

Hooks 56, 58 on second attachment assembly 35 of assembly 30 enable attachment of assembly 30 to an attachment member 578 on the separate exercise apparatus 510 (FIG. 37). This is accomplished by sliding attachment member 578 through the gap 302 between hooks 56, 58 and manipulating hooks 56, 58 in a circular motion about longitudinal axis 45 to selectively latch hooks 56, 58 to the attachment member 578 on the exercise apparatus. Hooks 56, 58 may, alternatively, attach to an adapter engaged with attachment member 578.

Figure 33:
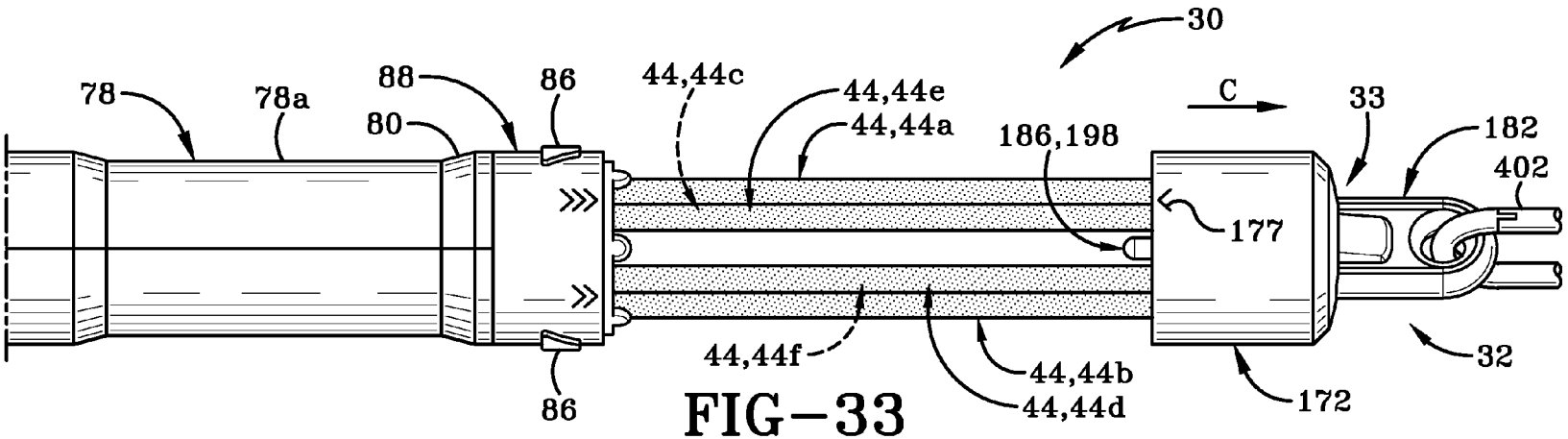
FIG. 33 is an operational side view of the variable resistance exercise band assembly depicting the selection of the third disc and four resilient members stretched during an exercise movement (note: two resilient members are not shown in this view for clarity, but all six resilient members are stretched when the third disc is selected for an exercise movement)

The user may impart an exercise motion to assembly 30 (which is now engaged to the exercise structure via attachment member 578) by pulling on first attachment assembly 33 in some way. This is most easily accomplished by engaging some type of workout accessory with first attachment assembly 33 at first end 32 of assembly 30. One such workout accessory 400 is illustrated engaged with first attachment assembly 33 in FIG. 35. When the user pulls on handle 400 to move the same in a direction longitudinally away from assembly 30, first attachment assembly 33, specifically engagement member 182, is caused to move in that longitudinal direction, depicted by arrow "C" (FIG. 33). As indicated previously, engagement member 182 is secured to collar 172 by tabs 94. Engagement member 182 is further secured at all times to first disc 36 and thereby to any resilient members 44 which are engaged with first disc 36 by their tapered ends 222 being wedged in the frustoconical apertures 124*b* defined therein. A resilient member resistance force vector associated with the resilient members 44 engaged with first disc 36 when stretched during an exercise movement occurs in a direction opposite that of arrow "C". The amount of force associated with first disc 36 during performance of the exercise movement is negligible relative to the resilient member resistance force vector. Stated otherwise, the actual weight or mass of first disc 36 provides very little resistive force to the exercise movement; most all of the resistive force to the exercise is provided by resilient members 44 engaged with first disc 36. (Similarly, it should be noted that the second and third discs 38, 40 are also of negligible or insubstantial weight/mass and do not provide any significant resistive force to the exercise performed with assembly 30. It is only the resistive force provided by stretching the resilient members 44 associated with second and third discs 38, 40 which generates the resistive force to any performed exercise.)

In order for only first disc 36 to be engaged with selector rod 186 and thereby with first attachment assembly 33, the indicator 177 on collar 172 must be aligned with the single chevron indicia 100 on sleeve 88. This position is illustrated in FIG. 1. When selector rod 186 is only engaged with first disc 30, pins 214 on selector rod 186 sit in pin passageways 142 of second disc 38 and pins 216 sit in passageways 166 of third disc. Thus, neither of second disc 38 and third disc 40 is operatively engaged with selector rod 186. Since pin passageways 142 are bounded on either side by one of protrusions 251 and one of protrusions 255, selector rod 186 is prevented from rotation in the clockwise direction (when viewed from below as in FIG. 21) by protrusions 255 preventing pins 214 from rotating in the clockwise direction. Furthermore, selector rod 186 is prevented from rotating in the counterclockwise direction by protrusions 251 preventing pins 214 from rotating in the counterclockwise direction.

Figure 26:
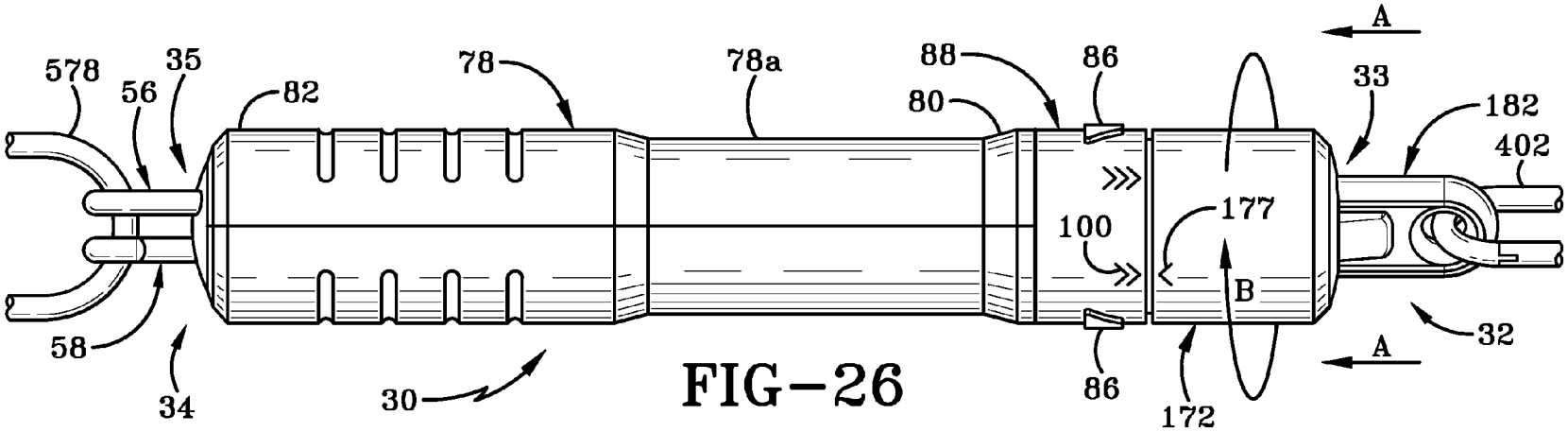
FIG. 26 is an operational side view of the variable resistance exercise band assembly depicting the rotation of an adjustment member to select the second disc.

If it is desired to increase the resistance level applied by assembly 30, then first attachment assembly 33 must be returned to the at rest position shown in FIG. 1 or 26. Chamfer 137 (FIG. 14) in first surface 128 of second disc 38 is provided to aid in guiding second end 198 of selector rod 186 into central aperture 139 when first attachment assembly 33 returns to its "at rest" position during the performance of an exercise using resistance band assembly 30 or when the resistance level is to be changed. Similarly, chamfer 147 (FIG. 11) in first surface 148 of third disc 40 aids in guiding second end 198 of selector rod 186 into central aperture 163 of third disc 40 when first attachment assembly 33 is returning to its rest position.

The user must then engage at least the second disc 38 as well as first disc 36 with selector rod 186. This is accomplished by the user grasping collar 172 and rotating the same in the direction indicated by arrow "B" (FIG. 26) to the location shown in FIG. 27. Because collar 172 is fixedly secured to engagement member 182 and thereby to selector rod 186, when collar is rotated in the direction indicated by arrow "B", then selector rod 186 will rotate within the bore of the tubular housing in the direction of arrow "B". This rotation of selector rod 186 causes the pins 214 and 216 to rotate in unison therewith.

Figure 27:
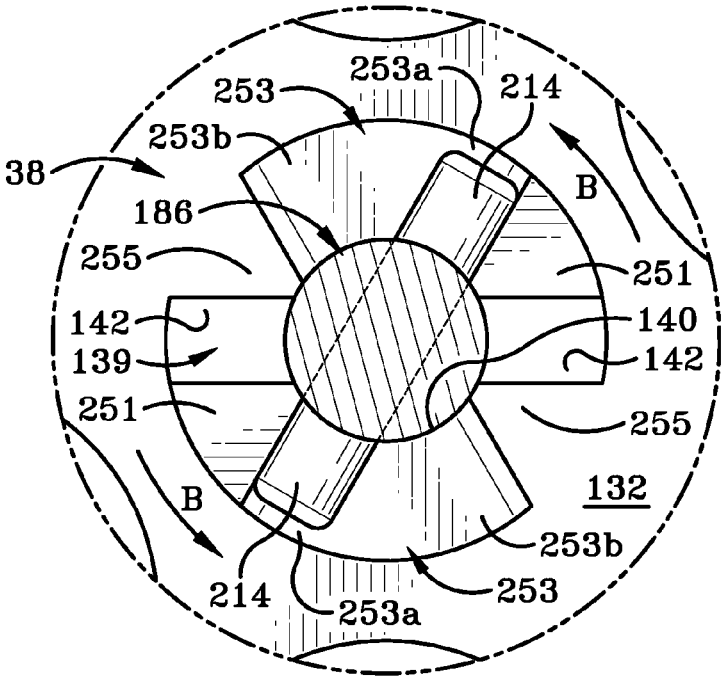
FIG. 27 is an enlarged bottom view of the second disc during the movement indicated in FIG. 26.
Figure 28:
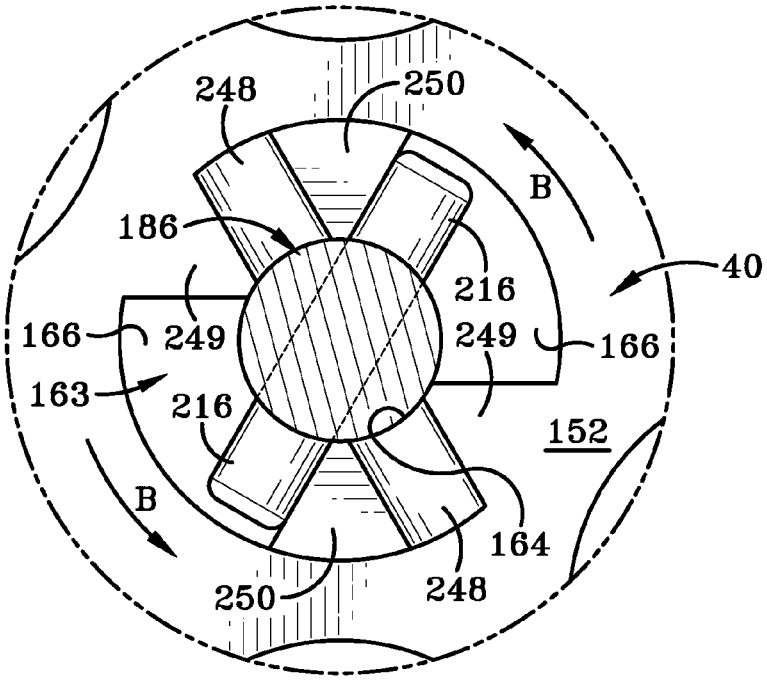
FIG. 28 is an enlarged bottom view of the third disc during the movement indicated in FIG. 26.

If the user rotates collar 172 until indicator 177 on collar 172 moves into alignment with the two chevron indicia 100 on sleeve 88, then the user is selecting a second level of resistance. FIG. 27 and FIG. 28 are bottom views of second disc 38 and third disc 40, respectively, showing the positioning of the components associated with the rotational movement depicted in FIG. 26. Aligning indicator 177 with the two chevron indicia 100 causes collar 172 to move slightly in the direction of arrow "A" (FIG. 26) when the pins 214 move in the direction of arrow "B" (FIG. 27) within the bore of assembly 30, out of pin passageways 142 and over recessed protrusions 251. Pins 214 slide over the recessed protrusions 251 and onto the further recessed pin receiving areas 253. This causes second disc 38 to be captured by selector rod 186. Second disc 38 is thus selected and engaged with selector rod 186. When the indicator 177 and indicia 100 are aligned, the user will feel and hear a "click" as selector rod 186 engages second disc 38. These "clicking" feelings and sounds will be physically experienced by the user whenever a disc is added or dropped during rotation of collar 172. This helps the user to know when they have actually added or removed resistance.

FIG. 28 shows the position of pins 216 when second disc 38 is engaged by selector rod 186. Pins 216 remain in passageways 166 in third disc 40 and are the third disc 40 is thus not engaged with selector rod 186. Clockwise rotation of selector rod 186 is prevented by pins 214 being prevented from rotating clockwise because of their engagement with protrusions 255 on second disc 38. Additionally, the rotation of selector rod 186 in a counterclockwise direction is prevented by protrusions 250 on the third disc 40 preventing pins 216 from moving in a counterclockwise direction.

Figure 29:
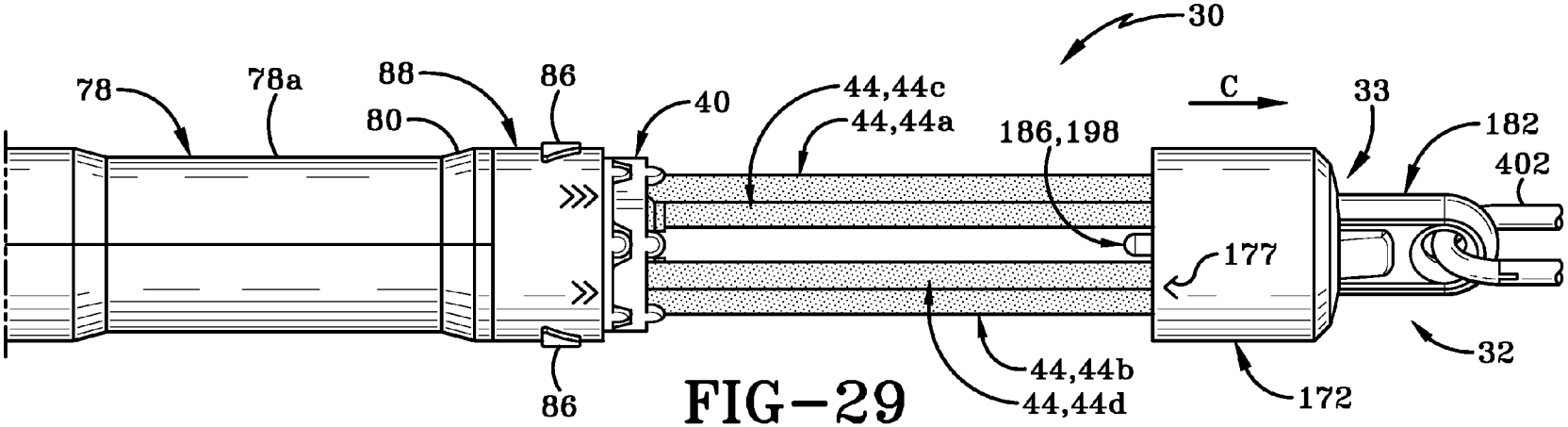
FIG. 29 is an operational side view of the variable resistance exercise band assembly depicting the selection of the second disc and four resilient members stretched during an exercise movement.

As shown in FIG. 29, when resistance band assembly 30 is in this second position with both the first and second discs 38, 40 engaged with selector rod 186, first attachment assembly 33 may be pulled longitudinally outwardly from second end 32 of the tubular housing in the direction of arrow "C" during the performance of an exercise. When the second disc 38 is selected, resilient members 44*a*, 44*b*, 44*c*, and 44*d* are stretched as first attachment assembly 33 moves in the direction of arrow "C" while resilient members 43*e* and 43*f*, which are attached to third disc 40, are not stretched. The multiple resilient members provided an increased resistive force to the pulling motion.

Figure 30:
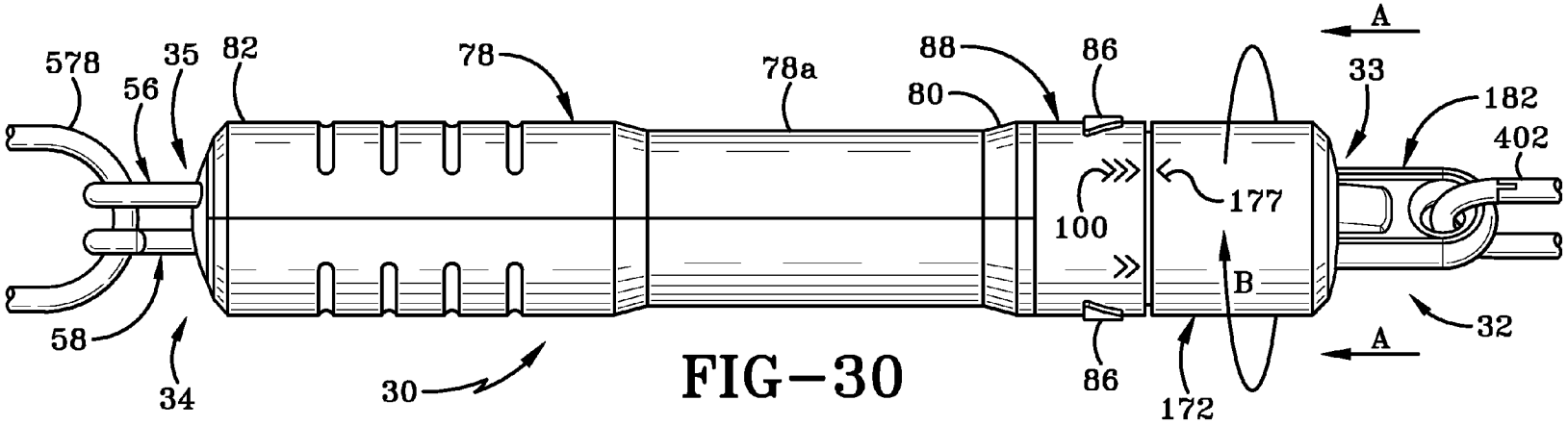
FIG. 30 is an operational side view of the variable resistance exercise band assembly depicting the rotation of an adjustment member to select the third disc.
Figure 31:
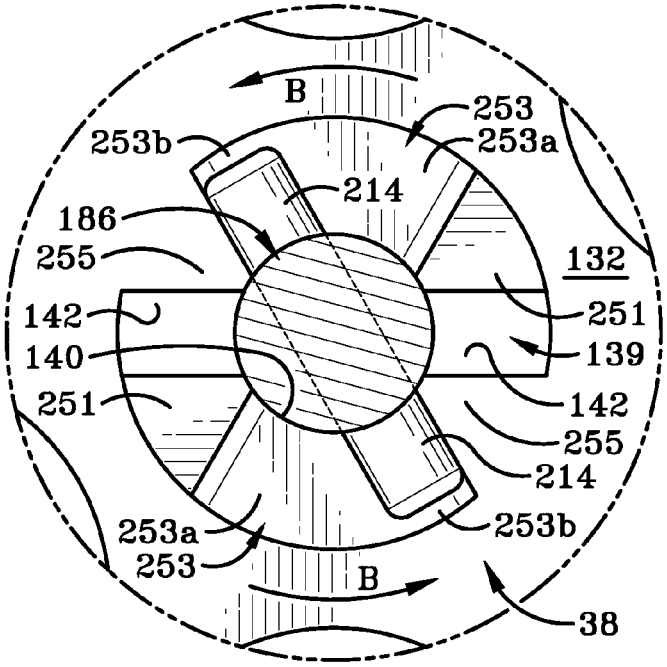
FIG. 31 is an enlarged bottom view of the second disc during the movement indicated in FIG. 30.
Figure 32:
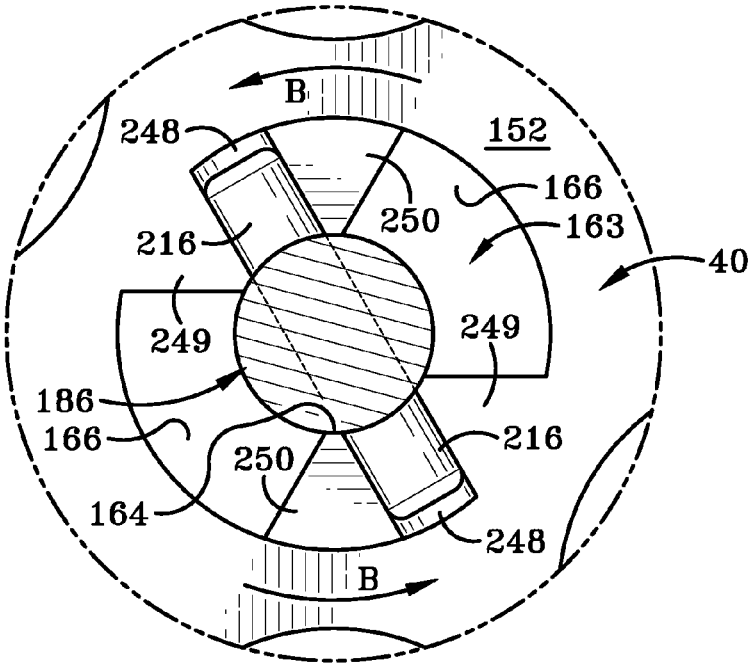
FIG. 32 is an enlarged bottom view of the third disc during the movement indicated in FIG. 30.

FIG. 31 and FIG. 32 show enlarged bottom views of second disc 38 and third disc 40, respectively, associated with the indicia alignment of FIG. 30. As depicted in FIG. 30, if the user desires to select an even greater resistive force, it is necessary to return first attachment assembly 33 to the at rest position. The user then rotates collar 172 to align indicator 177 on collar 172 with the three chevron indicia 100 on sleeve 88. This will cause third disc 40 to be captured by pins 216 of selector rod 186.

When collar 172 is rotated into this position and as shown in FIG. 32, pins 216 move through pin passageways 166 on third disc 40 and rotate until the pins 216 slide over the recessed protrusions 250 and into pin receiving areas 248. FIG. 31 shows that the rotation of collar 172 causes pins 214 to move from a first region 253*a* of pin receiving area 253 to a second region 253*b* thereof. Second disc 38 thus remains engaged with selector rod 186. Pin receiving area 253 in second disc 38 is thus configured to contact upper pins 214 on selector rod 186 when the second disc 38 is selected or when third disc 40 is selected. If only the first disc 36 is selected, both sets of pins 214, 216 will pass through pin passageway 142 during the use of assembly 30.

When collar 172 is in this third position, selector rod 186 is prevented from clockwise rotation by pin 216 abutting protrusion 250 on third disc 40; and selector rod is prevented from rotating counterclockwise by pins 216 abutting protrusions 249 on third disc 40. At this point, third disc is captured by selector rod 186 and all of the first, second and third discs 36, 38 40 are engaged with first attachment assembly 33 and the resistance provided by assembly 30 will involve the need to stretch all of resilient member 44*a*-44*f* within assembly 30.

Figure 22A:
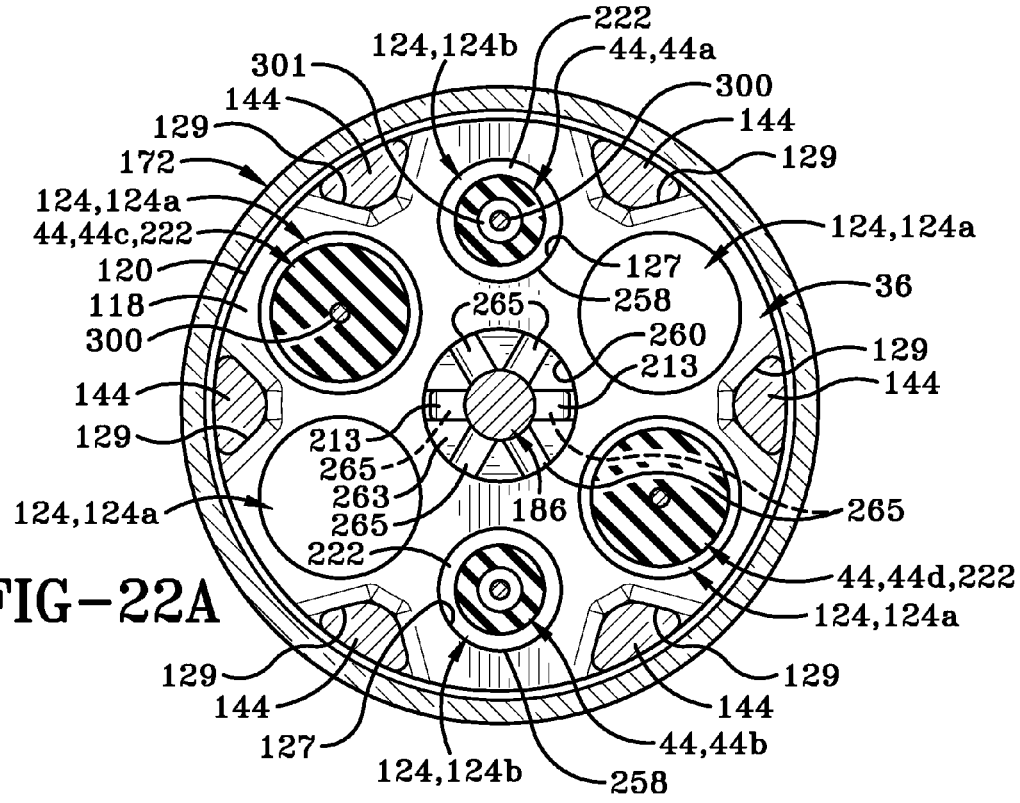
FIG. 22A is a section view taken along line 22-22 in FIG. 19 but depicting the alternative embodiment of the first disc illustrated in FIG. 16A.

Referring to FIG. 2E there is shown an alternative embodiment of adjustment assembly 170 that is used in conjunction with an alternative embodiment of first disc 36 shown in FIGS. 16A and 22A and described hereafter. The alternative embodiment of adjustment assembly 170 includes third pins 213 which are located between upper pins 214 and first end 196 of selector rod 186. Third pins 213 are spaced longitudinally from pins 214 and 216. Pins 213, 214, 216 may all be aligned in the same plane as each other along selector rod 186. This embodiment of selector rod 186 does not include annular recess 210 and E-clip 208 and washer 206 are omitted as well. Thus, in this embodiment, a dedicated pin is provided on selector rod 186 for each of the first, second and third discs 36, 38, 40. When selector rod 186 is rotated to engage first disc 36, third pins 213 will be positioned such that first disc 36 and selector rod 186 will move in unison away from second and third discs 38, 40. When selector rod 186 is rotated to engage second disc 38, third pins 213 will engage first disc 36 and pins 214 will engage second disc 38. When selector rod 186 is rotated to engage third disc 40, third pins 213 will engage first disc 36, pins 214 will engage second disc 38 and pins 216 will engage third disc 40. Thus, none of the discs 36, 38, 40 is passively engaged with selector rod 186.

Referring to FIGS. 16A and 24A there is shown the alternative embodiment of the first disc 36 with which the alternative selector rod is engageable. The alternative embodiment of the first disc is substantially identical to the first disc illustrated in FIGS. 15-17 except that the washer-receiving surface 261 is replaced with a surface 263 that is concentric with central aperture 126. Surface 263 defines a plurality of radial troughs 265 which extend outwardly from central aperture 126 and generally toward sidewall 122. Troughs 265 are shallow semi-circular depressions in surface 263. The alternative embodiment of first disc 36 includes three troughs 265 which each extend along a diameter of the circular surface 263. Each of the three troughs is separated into two separate portions by central aperture 126 so that it appears that six troughs are provided within surface 263. Troughs 265 are oriented at about 60° relative to each other. It will be understood that a different number of troughs 265 disposed at a different angle relative to each other could be provided in the alternative first disc 36.

When the alternative selector rod 186 is inserted through central aperture 126 of the alternative first disc 36, pins 213 will enter the space defined by washer receiving area 260 (FIG. 19) and first surface 118 of second disc 38. It should be remembered when looking at FIG. 19, that the figure is depicting the original embodiment of the first disc and the original selector rod. Since E-clip 208 and washer 206 are omitted from the alternative adjustment assembly 170, the washer receiving area 260 shown in FIG. 19 will only have selector rod 186 passing through it.

Pins 213 on selector rod 186 are located adjacent surface 263 (FIG. 22A). When collar 172 is rotated to the first position (FIG. 1) to select and engage only alternative first disc 36, pins 213 will move in a first direction, traveling across surface 263 and become seated in a first trough 265 (i.e., in two aligned and opposed portions of the first trough). The adjacent sections of surface 263 are effectively raised relative to the first trough and, consequently, rotation of selector rod 186 in either a clockwise direction or a counterclockwise direction is substantially prevented because rotation of pins 213 is stopped by these raised sections of surface 263.

If collar 172 is rotated to the second position, pins 213 will move in the first direction out of the first trough 265 and across the adjacent section of surface 263 (in the first direction) and pins 213 will then drop into the second trough 265 (i.e., second set of opposed and aligned trough portions). Again, the sections of surface 263 are raised relative to the second trough 265 and thus rotation of pins 213 and therefore of selector rod 186 is substantially prevented in each of a clockwise and counterclockwise direction. When collar 272 is in this second position, the pins 214 will have moved, as previously described, to cause second disc 38 to be captured by the alternative selector rod 186. The first and second discs 36, 38 are therefore engaged with the alternative selector rod and the resilient members 44 engaged with those discs will therefore provide an additional level of resistive force to any exercise.

If collar 172 is rotated into the third position, pins 213 will move out of the second trough 265, across the next adjacent surface 263 (in the first direction) and subsequently become seated in the third trough 265 (i.e., third set of opposed an aligned trough portions). Again, the next sections of surface 263 are raised relative to the third trough 265. Consequently, the rotation of pins 213 and therefore of selector rod 186 is substantially prevented in each of a clockwise and counterclockwise direction. When collar 272 is in this third position, the pins 214 will have moved, as previously described, to cause second disc 38 to be captured, and the pins 216 will have moved as previous described, to cause third disc 40 to be captured by the alternative selector rod 186. Thus all three discs are engaged with the alternative selector rod 186 and the resilient members 44 engaged therewith provide the maximum level of resistive force.

Rotating collar 172 in the opposite direction to that described above will cause selector rod 186 and therefore pins 213 to travel in a direction opposite to the first direction and thereby disengage one or more of the captured discs.

In operation and with respect to FIG. 34, there may be instances in which it is desirable to remove first attachment assembly 33. If, for example, it is desired to replace any component of the first attachment assembly 33 because of damage to that component, then retention tabs 194 are depressed inwardly in the direction of arrow "D" (FIG. 34). This permits collar 172 to be disengaged from upper member 182. At this point, upper member 182 is still engaged with selector rod 186 and first, second, and third discs 36, 38, 40. Resilient members 44 still extend from connection plate 42, through insert 90, through third disc 40, second disc 38, and first disc 36. In order to disengage selector rod 186 from the third and second discs 40, 38, the rod 186 needs to be rotated to permit pins 212 to slide out of the associated central apertures. In order to disengage first disc 36 from selector rod 186, clip 208 must first be disengaged. Any component part on upper member 182 or selector rod 186 may then be removed and replaced and then the assembly 30 may be reassembled by reversing these steps.

In other instances, it may be desirable to change or replace one or more resilient members 44. For example, a user may desire to customize his or her resistance band assembly 30 by personally selecting the resilient members 44 utilized therein. The user may insert one or more resilient members which have thinner shafts 221 to provide different resistive forces. A resilient member 44 with a thinner shaft 221 could provide less resistive force and a resilient member with a thicker shaft 221 could provide more resistive force.

Thus, if it was needful or desirable to change one or more resilient members, the user will need to disengage the specific resilient member from connection plate 42 and from the various discs, 36, 38, 40. In order to gain access to connection plate 42, the user will disengage first attachment assembly 33 from collar 172 by depressing tabs 194. Collar 172 will then be removed so that the user has access to discs 36, 38, 40. The user is then able to access the resilient band 44 which he or she wishes to replace and is also able to disengage base member 78 from sleeve 88. This is accomplished by pinching tabs 86 toward each other and so that the tabs 86 slide into the bore of the housing. As soon as tabs 86 are clear of the apertures 98 in sleeve 88, base member 78 and sleeve 88 may be separated from each other. Base member 78 may be moved in the direction of arrow "N" (FIG. 18) until the user is able to gain access to the bulbous member 224 of resilient member 44 it is desired to replace. Bulbous member 224 is pulled radially outwardly until resilient member 44 is no longer engaged with connection plate 42. The user will push resilient member 44 in the opposite direction to arrow "N" and out of the disc resilient member 44 is terminated in and then through the aligned apertures in the other discs; and continues this motion until bulbous member 224 is pulled out of the assembly. The replacement resilient member is then inserted into the resistance band assembly by reversing the aforementioned steps. If the resilient member's shaft 221 is thinner and therefore the tapered end 222 therein is smaller than the apertures in the respective first, second, or third discs, then an aperture adjustment member 223 will be engaged around the tapered end 222 prior to inserting the bulbous end 224 of the replacement resilient member through the apertures in the discs. The size of the aperture adjustment member 223 is selected to ensure that the combination of the aperture adjustment member 223 and tapered end 222 will not pass through the tapered aperture in the necessary first, second, or third disc 36, 38, 40. More than one resilient member 44 may be changed out in this fashion. When all of the desired resilient members 44 are engaged between connection plate 42, insert 90, sleeve 88, and discs 40, 38, 36 then base member 78 is moved in the opposite direction of arrow "N" (FIG. 18) until the spring-biased tabs 86 pop back through apertures 98 in sleeve 88. Collar 172 and collar 172 are then reengaged with the rest of the device. Tabs 194 pass through aperture 178 in collar 172. Resistance band assembly 30 is then ready for use once again.

Figure 35:
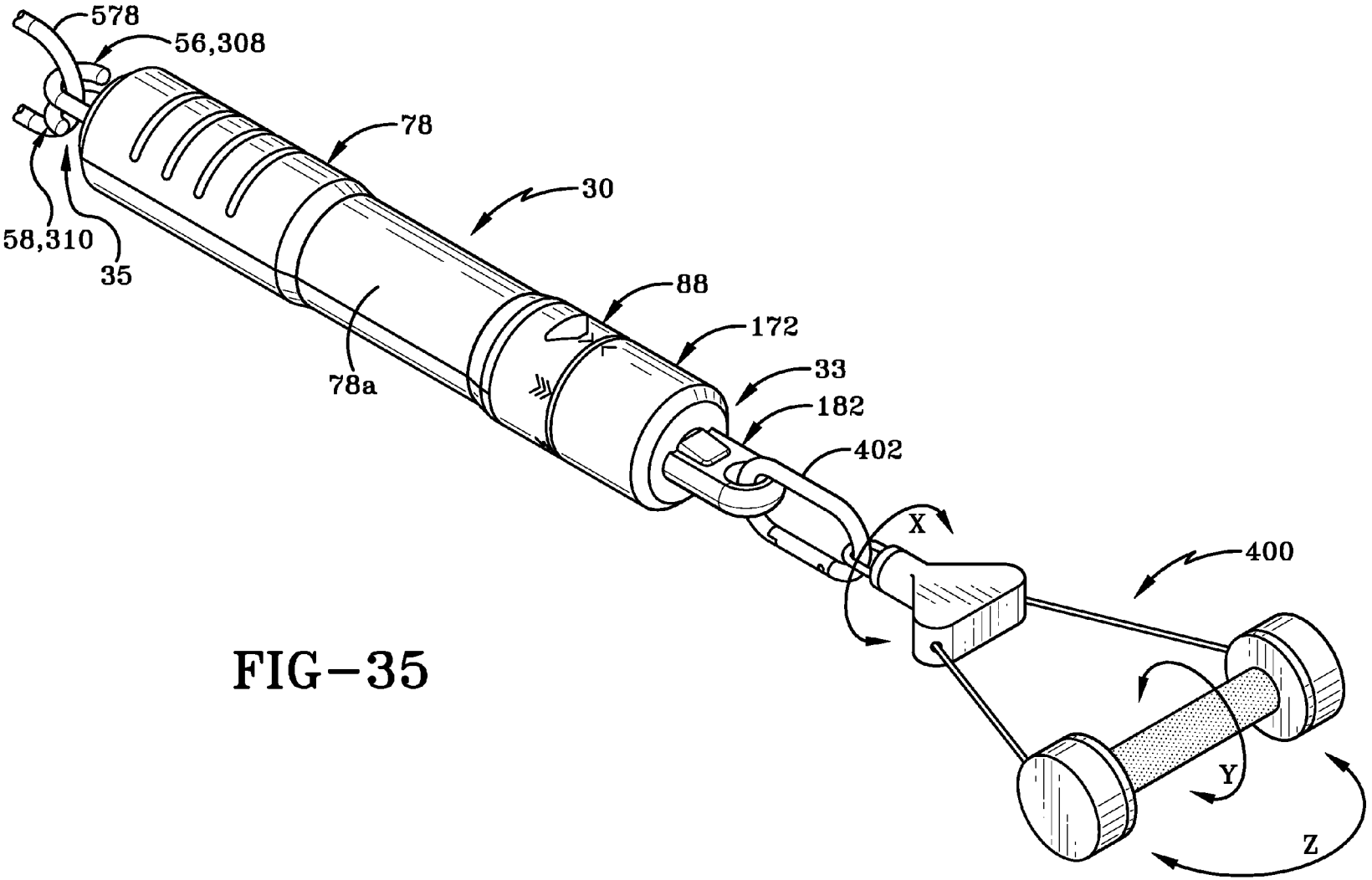
FIG. 35 is an isometric perspective view of the variable resistance exercise band assembly with an auxiliary handle connected to the first end.
Figure 36:
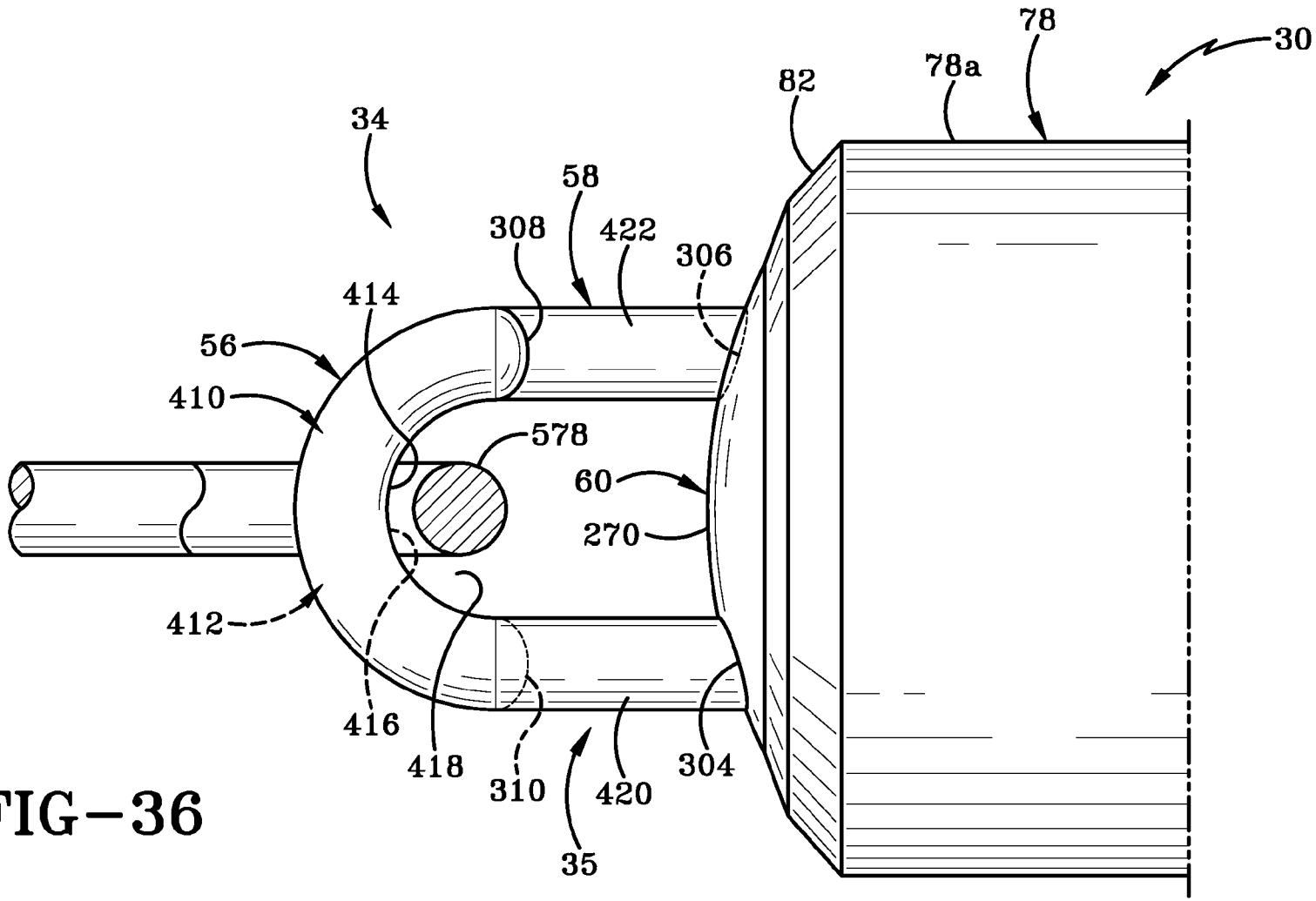
FIG. 36 is an enlarged fragmentary elevation of the second end of the resistance band assembly.

In operation and with reference to FIG. 35, an auxiliary workout accessory such as auxiliary handle 400 may be connected to upper member 182 through aperture 192 via an intermediate member such as carabiner 402. In the instance illustrated in FIG. 35, auxiliary handle 400 is designed to rotate about each "X", "Y", and "Z" axis. For the auxiliary handle 400 depicted in FIG. 35, rotational arrow "X" is associated with the roll about a longitudinal axis. Rotational arrow "Y" is associated with the pitch rotating about a transverse axis and rotational arrow Z is associated with the yaw rotation about a vertical axis. This auxiliary handle 400 coupled via a connecting member or carabiner 402 to upper member 182 ensures that substantially linear forces along longitudinal axis "X" are imparted through assembly 30 during the exercise motion. Also depicted in FIG. 35 is attachment member 578 for attaching hooks 56, 58 thereto. It will be understood that instead of a rotatable handle 400, a swivel carabiner could be utilized instead of carabiner 402. It will further be understood that any one of a number of workout accessories, such as workout bars or ropes may be engaged with upper member 182.

In operation and with reference to attaching assembly 30 to an exercise structure, an aspect of an embodiment for a method may include the steps of providing an attachment member 578 attached to an exercise structure, wherein the ring defines an aperture; affecting relative movement of the attachment member 578, the movement relative to an assembly 30 defining a gap 302 between two inverted hooks 56, 58 including a free end on each hook; positioning the attachment member 578 in the gap 302 beneath two ends of the hooks 56, 58; affecting a relative rotation of the attachment member 578, which is about 90 degrees, relative to the two hooks 56, 58 such that the attachment member 578 is beneath a hook passageway 418 defined by a downwardly facing concave surface of both hooks 56, 58; and engaging the attachment member 578 with the concave surface of both hooks 56, 58.

In operation and with reference to attaching assembly 30 to an exercise structure, another method may include the steps of providing an assembly 30 including two inverted hooks 56, 58 spaced apart and defining a vertical gap 302 therebetween, defining a transverse hook passageway 418 beneath arcuate portions 410, 412 on the hooks 56, 58; and moving hooks 56, 58 in a first direction to position an attachment member 578 attached to a separate exercise structure in the vertical gap 302. The method may further include revolving hooks 56, 58 about a longitudinal axis 45; and, when this step of revolving the hooks 56, 58 about the longitudinal axis is accomplished, rotating assembly 30 about its longitudinal axis 45 through about 90 degrees. Then, hooks 56, 58 are moved in a second direction opposite that of first direction so as to engage the arcuate portion 410, 412 of the hooks with the attachment member 578 such that the attachment member 578 extends through the transverse passageway 418.

While assembly 30 has been described as having a particular configuration in the previous paragraphs, it will be understood by those skilled in the art that first, second, and third discs 36, 38, 40 may be differently configured to what has been illustrated and described herein. For example, instead of first, second and third discs 36, 38, 40 being generally circular when viewed from above, these discs might be oval or elliptical or any other desired shape. It will also be understood that resilient members 44 may be differently configured and that the holes and apertures defined in the discs 36, 38, 40 may be differently placed and shaped.

It will be understood by those skilled in the art that any desired number of discs may be provided in the resistance band assembly in accordance with an aspect of the present invention. Additionally, while the discs described herein are illustrated as having six holes therein, it will be understood that the discs utilized in the resistance band assembly may include less than six holes or more than six holes. The number of actual resilient bands utilized in the resistance band assembly will be complementary to the number of holes in the discs.

While the sample embodiment of band assembly 30 has been illustrated and described herein as having hook-type connectors thereon, it should be understood that other types of connectors may be utilized on band assembly 30. For example, male/female type connectors could be provided on band assembly 30 and on workout accessories to be used in conjunction therewith or on an exercise structure which band assembly 30 may be secured to in order to perform exercises. Other connectors may be ball and socket type connectors.

Additionally, one having ordinary skill in the art would understand that resilient members 44 may be replaceable with other similarly dimensioned elastic bands, such as a bungee-type cord that can attach to the discs and connection plate.

It will further be understood that if the discs 36, 38, 40 were fabricated to be thicker than illustrated herein so that the end termination of resilient member 44 did not protrude beyond the first surface of the associated disc, the assembly could be fabricated to include fewer holes in some of the discs. For example, first disc 36 could be fabricated to include only two apertures. In this scenario, the assembly sequence would be to put the third disc 40 into bore 84 of base member 78, pass two resilient members 44 through third disc 40 (third disc 40 would still have six apertures defined therein), then install second disc 38 (having only four apertures therein), and pass two resilient members 44 therethrough; and then insert first disc 36 into base member 78 and pass two resilient members 44 therethrough. During actual use of the sample embodiment disclosed herein, all six resilient members pass through third disc 40, only four resilient members 44 pass through second disc 38, and only two resilient members 44 pass through first disc 36.

While resistance band assembly 30 has been described and illustrated herein as including first, second, and third discs 36, 38, 40 and six resilient members 44*a-f*, it will be understood that assembly 30 may be provided with just one single disc therein with one or more resilient members engaged therewith; or two discs with one or more resilient members engaged therewith; or more than three discs with one or more resilient members engaged therewith. Any combination of discs and resilient members associated therewith may be utilized to generate a desired resistance level to movement of first attachment assembly 33 away from first end 80 of base member 78.

In accordance with an aspect of the present invention, the components of exercise band resistance assembly 30 as herein described above permit a user to exercise by stretching some or all of resilient members 44. In accordance with another aspect of the present invention, when resilient members are being selectively stretched, substantially all of the resistive force applied to the exercise results from the bands, not the discs 36, 38, 40 to which the bands are connected. Additionally, in accordance with another aspect of the present invention, selector rod 186 and the pins 212 may pass through center apertures in some of the discs when those discs closer to second end 34 are not selected. When pins 214 select second disc 38, elements connected to selector rod 186 contact the second surfaces 118, 132 of both first disc 36 and second disc 38. When third disc 40 is selected, clip 210 contacts the bottom of first disc 36, pins 214 contact the second surface 132 of second disc 38 and pins 216 contact the second surface 152 of third disc 40.

In accordance with another aspect of the invention, the resistance that may be provided by resistance band assembly 30 is selectively variable. Thus, a user may configure resistance band assembly 30 to provide a lower resistance, an intermediate resistance or a higher resistance. This is accomplished by engaging one or more resilient members 44*a-f* with selector rod 186 when the resilient members are engaged with connection plate 42. The engagement of the second set of resistance bands (44*c* and 44*d*) provides a second resistance level to the resistance band assembly and the second resistance level is greater than the first resistance level.

Referring now to FIGS. 37-42, a fitness station 510 in accordance with an aspect of the present invention is described. Fitness station 510 includes a base 512, a support 514, a first arm 516, a second arm 518, a third arm 520, a fourth arm 522, and a fifth arm 523.

Base 512 is generally H-shaped when viewed from above and comprises a first base member 524, a second base member 526 and a first and second crossbar 528, 530 which extend between first and second base members 524, 526. Base 512 is of a size that a user of fitness station 510 may stand between first base member 524 and second base member 526 and either in front of first crossbar 528 or behind second crossbar 530. Fitness station may be of any desired size. For example, the overall height of station 510 may vary between 8 and 12 feet as measured from the bottom surfaces of the base members 524, 526, 528, 530 to an uppermost region of the inverted J-shaped support member 538. Each of the first and second base members 524, 526 may be of any desired length, such as from about 5 feet to about 12 feet long. At their closest points relative to each other first and second base members 524, 526 may be spaced around 3 feet apart from each other but other distances are possible. Furthermore, the first and second arms 516, 518 may be of any desired length. For example, each of the first arm portions 556 may be from about 2 feet up to about 7 feet in length.

Each of the first and second base members 524, 526 may be an arcuate component that may be a generally open-C shape. First and second base members 524, 526 are substantially identical and are oriented so that they are mirror images of each other. Members 524, 526 are spaced a distance laterally apart from each other and in such a manner that the base members may curve away from each other. It will be understood, however, that base members 524, 526 may be of any other suitable shape and may be more angular than arcuate.

First base member 524 includes an upper surface 524*a*, a lower surface 524*b*, a first side 524*c*, a second side 524*d*, a first end 524*e* and a second end 524*f*. Second base member 526 includes an upper surface 526*a*, a lower surface 526*b*, a first side 526*c*, a second side 526*d*, a first end 526*e* and a second end 526*f*. First ends 524*e*, 526*e* are generally equidistant from crossbar 528 and second ends 524*f*, 526*f* are generally equidistant from crossbar 528. First and second base members 524, 526 have a length "L" (FIG. 38) as measured from first end 524*e*, 526*e* through to second end 524*f*, 526*f*. First and second base members 524, 526 may be hollow or substantially solid and may be free of openings or apertures along their lengths. Leveler legs (not shown) may extend downwardly from a bottom surface of base members 524, 526 and from bottom surfaces of one or both of first and second crossbars 528, 530. These leveler legs may be used to level fitness station 510 on the surface upon which it stands.

As indicated above, a first crossbar and a second crossbar 528, 530 extend between first and second members 524, 526. First crossbar 528 is positioned a horizontal distance "L1" from first ends 524*e*, 526*e*. Second crossbar 530 is positioned a horizontal distance "L2" from first ends 524*e*, 526*e*. First crossbar 528 may be a little more than midway between first ends 524*e*, 526*e* and second ends 524*f*, 526*f*. First and second crossbars 528, 530 are spaced longitudinally from each other such that a gap 532 is defined between them. First crossbar 528 has an upper surface 528*a*, a lower surface

528*b*, a first end 528*c*, a second end 528*d*, a front 528*e* and a back 528*f*. Second crossbar 530 has an upper surface 530*a*, a lower surface 530*b*, a first end 530*c*, a second end 530*d*, a front 530*e* and a back 530*f*. First ends 528*c*, 530*c* are welded to first side 526*c* of second base member 526 and second ends 528*d*, 530*d* are welded to first side 524*c* of first base member 524. It will be understood that instead of two crossbars extending between first and second base members 524, 526, a single crossbar may be utilized or more than two crossbars may be utilized. If a single crossbar is used that crossbar may be of a substantially greater width than either of the first and second crossbars illustrated herein. It will be understood that the length and width of the crossbar(s) utilized herein may be varied but will be selected so that the fitness station has sufficient strength and rigidity to act as an anchor for the exercises to be performed therewith.

Lower surfaces 524*b*, 526*b* of first and second base members 524, 526 and lower surfaces 528*b*, 530*b* of first and second crossbars 528, 530 are placed on a flat and substantially horizontal support surface such as the ground or a floor of a gym and base 512 may be anchored to that ground or floor surface. Base 512 may be anchored by way of a plurality of bolts that are driven into the support surface or by the provision of a downwardly extending anchor, such as has been described in parent application Ser. No. 13/836,359, the specification of which is incorporated herein.

Prior to placing fitness station onto the support surface, an exercise mat 534 may be placed onto the surface. Fitness station 510 may be placed onto the upper surface of the exercise mat 534 and be anchored to the support surface. The mat 534 may include a grid comprised of a plurality of markings 534*a*. The markings 534 may be squares that are of a particular size, such as one square foot, so that a person using fitness station 510 is able to stand or lie on mat 534 in particular specific locations each time they perform particular exercises. This grid may help a user perform exercises correctly and be able to consistently replicate the exercises they perform over a period of time. Mat 534 may be resilient in nature and provide cushioning for the user as they work out or stretch using fitness station 510.

Base 512 may be anchored to the flat and substantially horizontal surface in any one of a number of ways. For example, holes may be supplied in first and second base members 524, 526 and first and second crossbeams 528, 530 and then bolts may be inserted through these holes and into the surface beneath base. As indicated previously, leveler legs may be used to ensure fitness station 510 is level and so that it will not be inclined to tip over during use.

The upper surfaces 524*a*, 526*a*, and 528*a* of first and second base members 524, 526 and the upper surface of at least first crossbar 528 is provided with a plurality of attachment members thereon. Each of the attachment members is a component which extends upwardly and outwardly away from the upper surface 524*a*, 526*a* of the associated base member 524, 526 and defines an aperture therein. (While not illustrated herein, it will be understood that second crossbar 530 may also be provided with attachment members thereon.) The attachment members are used as components to which a resistance assembly may be secured when a user desires to utilize resistance to increase the intensity and effectiveness of their workout. The resistance assembly is selectively securable to any one of the attachment members by engaging a connector in the aperture defined by the attachment member. The attachment members are shaped to enable the resistance assembly to be oriented at any one of a range of angles relative to the base members 524, 526. This arrangement even enables the resistance assembly to be able to pivot relative to the base members 524, 526. It is contemplated that resistance bands or cord-type devices may also be engaged with the attachment members. During exercise the resistance bands or cord-type devices will be pulled and expand in length, thereby providing resistance to the performance of the pulling motion. Strap-type devices may also be engaged herewith.

One possible type of attachment member which may be suitable for this purpose is a C-shaped ring which is fixedly and permanently secured to base 512 as first attachment members 536. Each of the first attachment members 536 is welded or otherwise securely engaged with the associated one of the first and second base members 524, 526 or first crossbar 528. The first attachment members 536 are spaced at intervals from each other and are positioned so as to extend outwardly from the first or second base member 524, 526 or first crossbar 528. The interval for placement of first attachment members 536 may be a regular interval so that adjacent pairs of first attachment members 536 are spaced the same distance apart from each other. For example, as shown in the attached figures, first attachment members 536 may be spaced one foot apart from each other but it will be understood that other size intervals may be utilized. Alternatively, the intervals selected during fabrication of station 510 may be of different sizes. So, the interval between some adjacent pairs of first attachment members 536 may be one foot while the interval between other adjacent pairs of first attachment members 536 may be six inches or eighteen inches.

The C-shaped rings that are used as first attachment members 536 are passive connections meaning that any resistance assembly utilized has to be threaded through the ring, tied to the ring or clipped to the ring. It is possible that the attachment members used on fitness station could be active in nature. What is meant about the term "active" is that the attachment member is the component that is secured to the resistance assembly and not the other way round. So, for example, instead of a C-shaped ring which is welded at both ends to first or second base members 524, 526 or first cross-bar 528 and a hook or clip on a resistance assembly is threaded through the ring, the attachment member could be a carabiner-type component which can be opened and closed and thereby selectively connected to a resistance assembly. Alternatively, a combination of active and passive attachment members could be utilized on fitness station 510.

All of the first attachment members 536 illustrated in the attached figures comprise C-shaped metal rings that are fixedly secured to particular components of fitness station 510. It will be understood the metal rings utilized on fitness station 510 do not have to be C-shaped components but could be differently shaped. As shown in the figures, the metal rings provided on each of the first and second base members 524, 526 are positioned so that each ring is oriented substantially at right angles to the respective upper surface 524*a* or 526*a*. This can best be seen in FIG. 38. The metal rings provided as first attachment members 536 on first crossbar 528, however, may not be oriented substantially at right angles to upper surface 528*a*. Instead, the metal rings may be oriented at an angle other than ninety degrees relative to upper surface 528*a*. The angle of the metal rings on first crossbar 528 may be around 45° relative to upper surface 528*a*.

Figure 38:
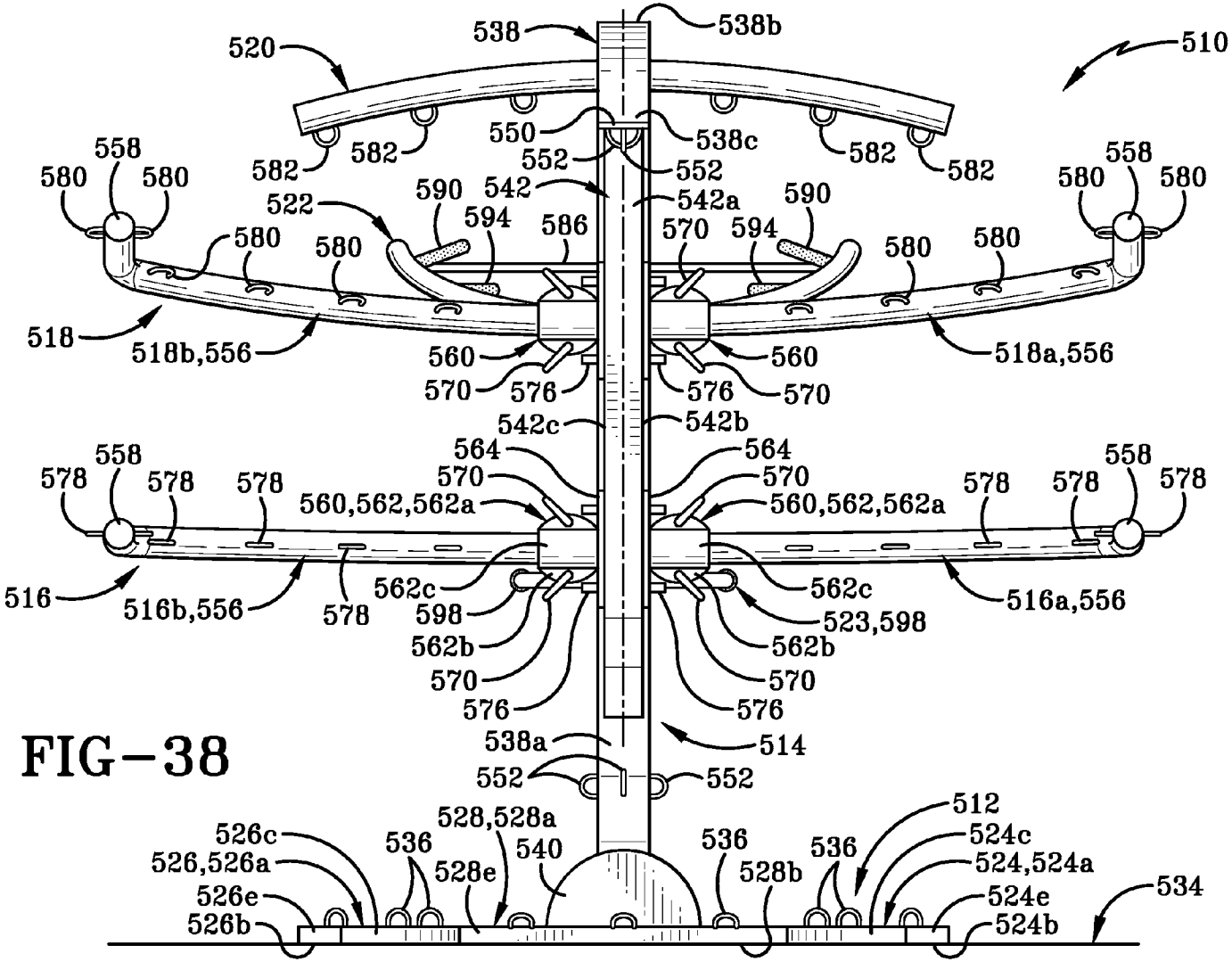
FIG. 38 is a front view of the fitness station.

Support 514 extends upwardly and outwardly from base 512 and includes a support member 538 that, when viewed from the right side, is an upside down J-shape or has the appearance of a question mark. Support 514 may be fabricated as a segmented component where the various segments are bolted together during installation. Alternatively, support 514 may be a monolithic, unitary component. A semi-circular mounting bracket 540 is secured to upper surface 528*a* of first crossbar 528 such as by welding. Support member 538 is secured to and extends upwardly and outwardly from a central region of this mounting bracket 40. Support member 538 has an interior surface 538*a* which faces forwardly and an exterior surface 538*b* which faces rearwardly. Side surfaces extend between interior and exterior surfaces but these side surfaces are not numbered in the attached figures. A central region of support member 538 includes a widened box 542 which extends outwardly and forwardly from interior surface 538*a*. As shown in FIG. 38, box region 542 has a front surface 542*a* and side surfaces 542*b*, 542*c*. Each side surface 542*b*, 542*c* defines a vertically extending first slot 544 and a second slot 546 therein. As is evident from FIG. 40, second slot 546 is located vertically above first slot 544 and is spaced a distance therefrom. A J-shaped hook 548 extends downwardly and forwardly from an upper region of interior surface 538*a* and third arm 520 is engaged therewith. A terminal end 538*c* of support member 538 includes a rearwardly extending suspension member 550. Suspension member 550 may be L-shaped and at least one region of the suspension member 550 is oriented generally parallel to upper surfaces of first and second base members 524, 526 and a second region of suspension member 550 extends upwardly and generally at right angles to the first region. The second region forms an upwardly extending lip. One or more second attachment members 552 may be provided on a lower surface of the first region of suspension member 550. Second attachment member(s) 552 may be oriented at right angles relative to first region of suspension member 550 or they may be orientated at a different angle relative thereto. Suspension member 550 may be utilized to perform various suspension exercises by engaging non-stretchable ropes or straps such as TRX® straps (sold by Fitness Anywhere, LLC). The rope or straps may be secured to suspension member 550 utilizing the vertically-oriented upstanding lip and/or one of second attachment member(s) 552 provided on the underside of suspension member 550. Alternatively, suspension member 550 may be utilized to suspend other fitness apparatus such as a heavy punching bag.

As seen in FIG. 37, an additional plurality of second attachment members 552 is provided on a lower end of support member 538 a distance vertically above mounting bracket 540. One of the second attachment members 552 is provided on interior surface 538*a* and other second attachment members 552 are provided on each of the side surfaces of support member 538. The second attachment members 552 may all be located in the same plane as illustrated in FIG. 37 and is oriented generally at right angles to the respective surface from which it extends. It will be understood, however, that second attachment members 552 may be located in different planes relative to each other and they may be oriented at angles other than ninety degrees to the mounting surface. As with first attachment members 536, second attachment members 552 are welded or otherwise fixedly secured to the surfaces upon which they are provided.

Figure 40:
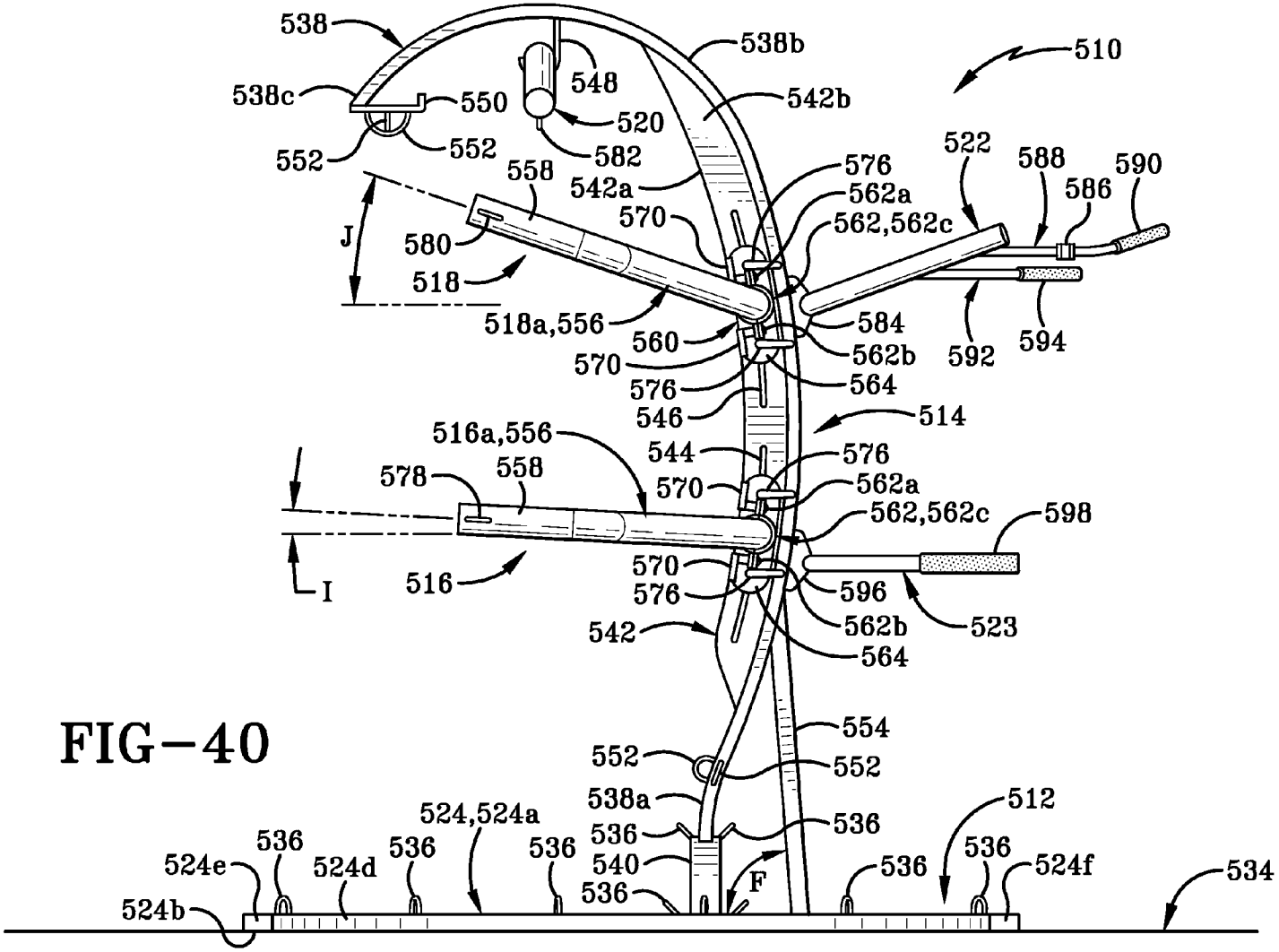
FIG. 40 is a right side view of the fitness station.
Figure 41:
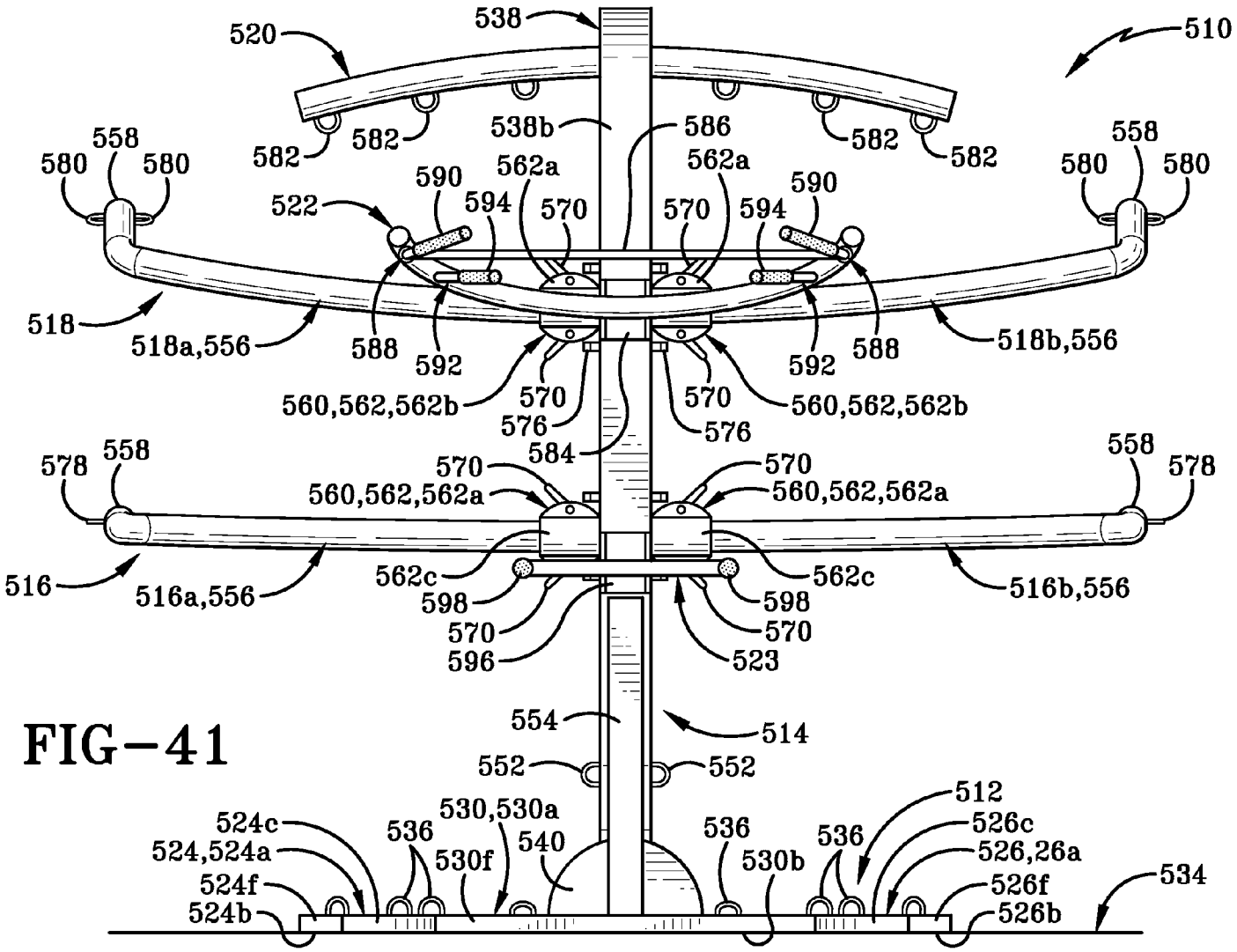
FIG. 41 is a rear view thereof.

Support 514 further includes a brace member 554 which extends upwardly and outwardly from second crossbar 530 and engages exterior surface of support member 538 (FIG. 40). Brace member 554 is oriented at an angle "K" (FIG. 40) relative to upper surface 530*a* of second crossbar 530. Angle "K" is less than 90° so that brace member 554 is able to effectively brace support member 538. A first end of brace member 554 is welded or otherwise secured to second crossbar 530 and a second end of brace member 554 is welded or otherwise secured to exterior surface of support member 538. The second end of brace member 554 engages exterior surface of support member 538 at a location a distance vertically above a bottom end 542*c* of box region 542 but below first arm 416.

First arm 516 may be adjustably mounted to support 514 in such a way that the user is able to selectively vary the distance between base 512 and first arm 516 by moving first arm 516 along support 514 either toward or away from base 512, as will be hereafter described. First arm 516 may be generally U-shaped when viewed from above and includes a first section 516*a* and a second section 516*b*. First and second sections 516*a*, 516*b* are substantially identical to each other but are mounted to support member 538 in such a manner that they are mirror images of each other. Each of the first and second sections 516*a*, 516*b* is generally L-shaped and comprises a generally laterally extending first arm portion 556 and a forward extending second arm portion 558. First and second sections 516*a*, 516*b* may be generally circular in cross section but they can be of any other cross-sectional shape.

Figure 42:
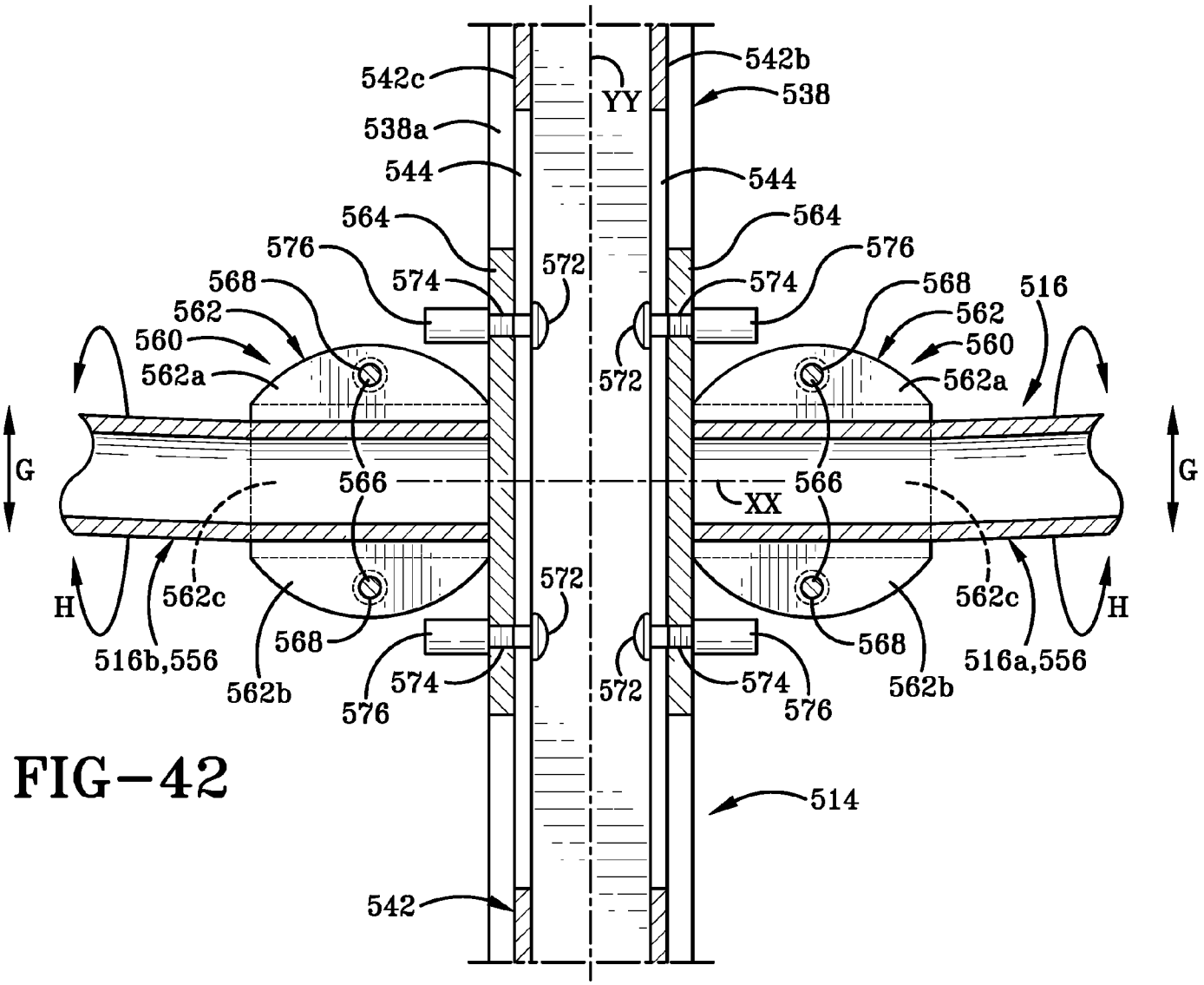
FIG. 42 is an enlarged cross-section of a first embodiment of the first arm of the fitness station taken along line 42-42 of FIG. 37.

A clamping assembly 560 may independently and adjustably secure each first arm portion 556 to support member 538. Clamping assembly 560 includes a clamp 562 and a base plate 564. Clamp 562 comprises a clamshell-type device comprising a first half and a second half that are substantially identical and are positioned adjacent each other. Each of the first and second halves of the clamp 562 has a flat upper region 562*a*, a flat lower region 562*b* (shown on a clamp 562 on first arm 516 in FIG. 42) and a curved mid-section 562*c* (FIG. 40). The radius of curvature of mid-section 562*c* is substantially identical to the radius of curvature of the first arm portions 556 of first and second sections 516*a*, 516*b*. When the first and second halves of clamp 562 are positioned adjacent each other, the curved mid-sections 562*c* are placed so as to define a generally circular bore through clamp 562. As best seen in FIG. 42, the first end of each first arm portion 556 is received through this bore and when the first and second halves are secured to each other, the first ends are tightly retained in the bore. It will be understood that if first arm portion 556 is of a non-circular configuration, the inside surface of the clamp 562*c* would be shaped to mate with the outside surface of first arm portion 556.

Clamp 562 is at least partially secured to plate 564. The first half of clamp 562 is welded or otherwise secured to plate 564 and thus, when plate 564 moves, the first half of clamp 562 moves in unison therewith. The second half of clamp 562 is not welded to plate 564 and is detachably secured to the first half of clamp 562. This detachability enables the end of first arm portion 556 to be received into the bore defined by curved sections 562*c*. Fasteners 566 (FIG. 42) are passed through apertures 568 in upper and lower sections 562*a*, 562*b* of the first and second halves of clamp 562 and are tightened to lock the end of first arm portion 556 therebetween. In order to make it easier to accomplish the tightening motion, a handle 570 is provided on each fastener 566. Moving the handle 570 in a first direction loosens the fastener 566 and this makes it possible for the second half of clamp 562 to be moved away from the first half thereof. Moving the handle 570 in a second direction tightens the fastener 566, thereby moving second half of clamp 562 toward first half thereof and clamping first arm portion 556 therein.

As best seen in FIG. 42, base plate 564 is located adjacent one or the other of side surfaces 542*b*, 542*c* of box region 542 of support member 538. Fasteners 572 secure base plate 564 and thereby the first half of clamp 562 to support member 538. Fasteners 572 each include a shaft 221 which extends through apertures 574 in base plate 564 and into slot 544 in box region 542. A handle 576 is engaged with each fastener 572. When handle 576 is moved in a first direction, the fastener 572 is slightly loosened and the base plate 564 is then free to be moved either upwardly or downwardly relative to the associated side surface 542*b* or 542*c* of box region 542. This up-and-down sliding motion is parallel to a longitudinal axis "YY" (FIG. 42) of support member 538 as is indicated by arrow "G" in this figure. The sliding motion enables the user to selectively and independently adjust the vertical height of the one or the other of the associated first or second section 516*a*, 516*b* of first arm 516 relative to the upper surface 528*a* of first crossbar 528. Thus, first and second sections 516*a*, 516*b* may be independently moved toward or away from base 512 so that the selected section of first arm 516 may be at a desired height for a particular exercise.

In an alternative arrangement clamps 562 may be secured to support member 538 in a different way. In this alternative arrangement the bolt used to secure clamp to support member 538 may be a carriage bolt that is inserted from the outside of the box 542 into the interior and nuts are positioned in the interior of the box 542. This leaves only the rounded carriage bolt head exposed and prevents unauthorized adjustment of the arm height.

When the first or second section 516*a* or 516*b* is moved to the desired height, then clamp 562 is locked in place so that further longitudinal motion is prevented. This locking of clamp 562 is accomplished by engaging handle 576. When the handle 576 is rotated in a second direction, the fastener 572 is tightened once again and sliding motion of base plate 564 in either of an upward direction or a downward direction is effectively prevented. At this point, the selected section 516*a* or 516*b* is in the desired position for engaging one or more resistance bands or resistance assemblies with one or more of a plurality of third attachment members 578 provided on first arm 516. When the resistance band or assembly is so secured, the user is able to perform any one of a plurality of selected exercises.

The third attachment members 578 are located on first arm 516 at spaced intervals from each other. Third attachment members 578 may, again, be C-shaped rings that are welded or otherwise secured to first arm 516. The rings may be oriented at right angles to a front face of first arm 516 and may be provided on one or both of the first and second arm portions 556, 558 of first arm 516. Third attachment members 578 may be provided on more than one face of the first arm 516. The third attachment members 578 may be provided at regular intervals relative to each other, such as at a distance of one foot apart from each other. As with the first attachment members 536 and second attachment members 552 discussed earlier herein, differently shaped third attachment members 578 may be utilized, the spacing interval between adjacent third attachment members 578 may be other than regular, and the orientation thereof may be other than at right angles relative to the face of the first arm 516 upon which the third attachment members 578 are provided.

Clamping assemblies 560 also make it possible for the orientation of each of the first and second sections 516*a*, 516*b* to be changed. This is accomplished by rotating the selected first or second section 516*a* or 516*b* about a horizontal axis "XX" (FIG. 42) which extends along the length of the sections 516*a*, 516*b*. The possible rotational motion is indicated by the arrow "H" in FIG. 42. This rotational motion may be desired to position the third attachment members 578 at a different location or orientation relative to support member 538 in order to perform any desired exercise that requires such placement of third attachment members 578. The rotational adjustment is accomplished by loosening fasteners 568 to a degree sufficient to enable the selected first or second section 516*a* or 516*b* to rotate within the bore defined by the central regions 562*c* of clamp 562. Fasteners 568 are partially loosened by rotating handles 570 in a first direction. Once fasteners 568 are loosened, the first or second section 516*a* or 516*b* is rotated into the desired position, fasteners 568 are tightened once again by rotating handles 570 in a second direction thereby enabling clamp 562 to retain the first end of first or second section 516*a*, 516*b* in the new orientation.

Second arm 518 is engaged with support 514 a distance vertically above first arm 516. As illustrated in FIG. 40 first arm 516 may be oriented generally horizontally or at a slight angle "I" above the horizontal. This angle "I" may be in the order of from about 5° to about 10° above the horizontal. Second arm 518 may be oriented at an angle "J" above the horizontal. This angle "J" may be in the order of from about 15° to about 25° relative to the horizontal.

Second arm 518 may be adjustably mounted to support 514 in a substantially identical manner to the way first arm 516 may be mounted thereto. Second arm 518 also functions in a substantially identical fashion to first arm 516. Second arm 518 is generally U-shaped when viewed from above and is comprised of a first section 518*a* and a second section 518*b*. Each of the first and second sections 518*a*, 518*b* is an L-shaped component comprised of a first arm portion 556 and a second arm portion 558. First arm portions 556 may be independently and adjustably mounted by way of clamping assemblies 560 to box region 542 of support member 538. Clamping assemblies 560 however, include fasteners 572 which extend into second slot 546 instead of into first slot 544. The height of each of the first and second sections 518*a*, 518*b* of second arm 518 may be independently adjustable relative to upper surface 528*a* of first crossbar 528 in the same manner as was described herein with respect to the adjustment of first and second sections 516*a*, 516*b* of first arm 516. Additionally, the orientation of first and second sections 518*a*, 518*b* may be changed by rotating the same within the associated clamping assembly 560 in the same manner as has been described with reference to the rotation of first and second sections 516*a*, 516*b* of first arm 516.

A plurality of fourth attachment members 580 is provided at intervals along first and second sections 518*a*, 518*b* of second arm 518. Fourth attachment members 580 may, again, be C-shaped rings that are welded or otherwise secured to second arm 518 in a similar manner to third attachment members 578 on first arm 516. Rotation of first or second sections 518*a*, 518*b* may be undertaken in order to vary the angle and position of the respective fourth attachment members 580 provided thereon in order to perform any desired exercise.

As best seen in FIG. 38, third arm 520 is engaged with support member 538. Third arm 520 is an arcuate member that may be generally circular in cross-section (FIG. 40). Third arm 520 is welded or otherwise secured to J-shaped hook 548 which extends downwardly from a top region of interior surface 538*a* of support member 538. Third arm 520 curves downwardly on either side of support member 538. A plurality of fifth attachment members 582 are welded or otherwise secured to one of the faces of third arm 520. That face may be a downwardly facing face as illustrated in FIG. 38 but it will be understood that other face(s) may be provided with fifth attachment members 582 instead of the downward facing face or in addition thereto. Fifth attachment members 582 may be similar to first, second, third, and fourth attachment members, 536, 552, 578, 580 and may be engaged with and oriented on third arm 520 in substantially the same way as the other attachment members 536, 552, 578, 580 are engaged with the other components of fitness station 510 set out above.

Figure 39:
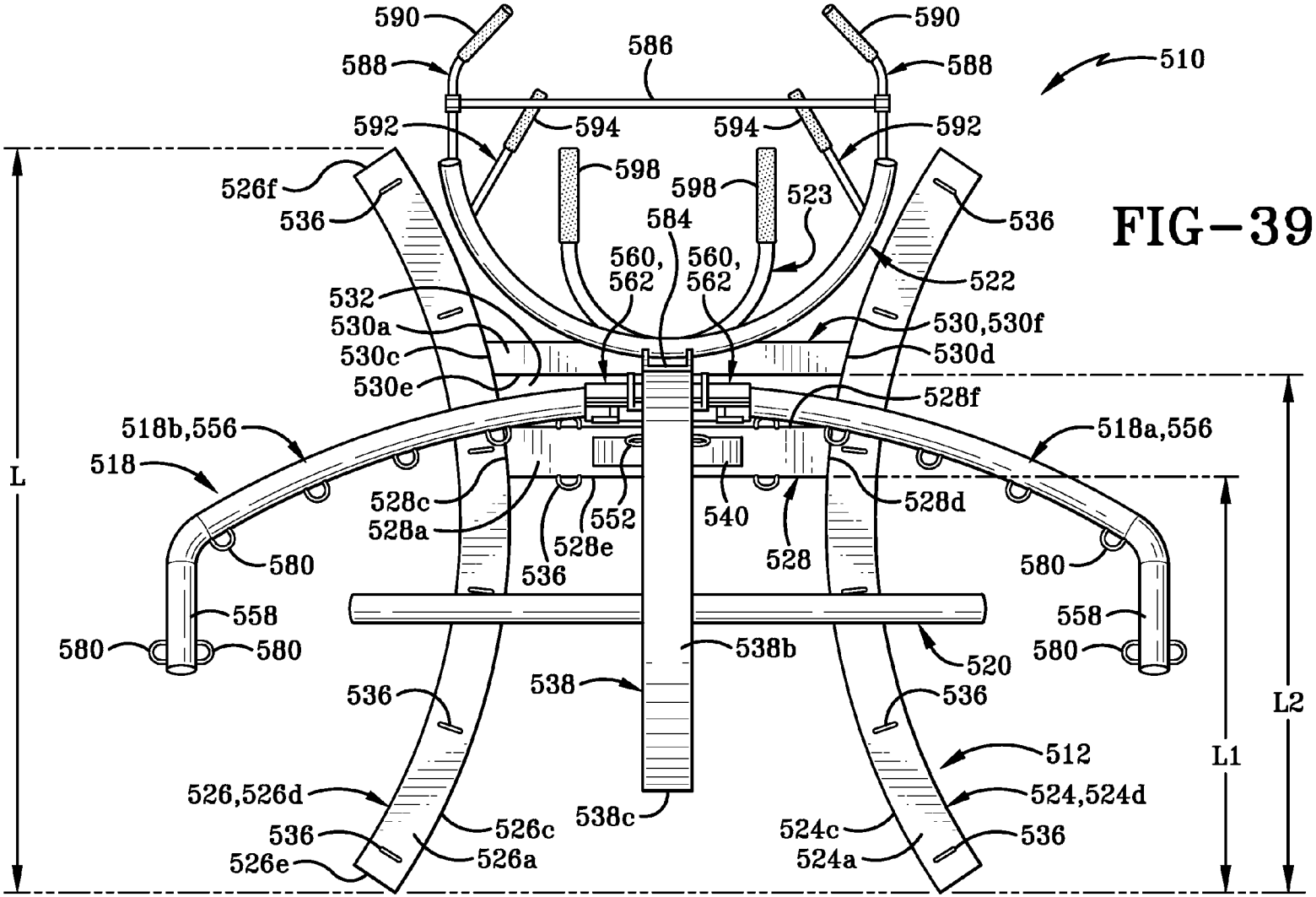
FIG. 39 is a top view thereof.

Each of the fourth and fifth arms 522, 523 is attached to support member 538 and is a generally U-shaped component when viewed from above (FIG. 39). The mountings for fourth and fifth arms 522, 523 are on a plane that is generally 90 degrees relative to the mounting for first and second arms 516, 518. Fourth arm 522 may be mounted to exterior surface 538*b* of support member 538 by way of mounting bracket 584 (FIG. 40). Bracket 584 secures fourth arm 522 to support 514 in a fixed orientation; that orientation being slightly angled upwardly as shown in FIG. 40. Bracket 584 engages support member 538 at a location that is generally aligned with a middle region of second slot 546. It is possible that bracket 584 could be of a type which pivotally secures fourth arm 522 to support 514. In this latter instance, fourth arm 522 could be pivoted up and down during the performance of an exercise.

Fourth arm 522 may include a crossbeam 586 (FIG. 40) that extends between opposed sections of fourth arm 522 to provide the user with a variety of hand grips to facilitate different exercises. Crossbeam 586 may be removable to allow users full range of exercise motion without interference from crossbeam 586. Inwardly extending first handles 588 are provided at each end of fourth arm 522 and first handles 588 are each provided with a cushioning grip 590 thereon. A pair of second handles 592 extends outwardly from fourth arm 522 a distance vertically beneath first handles 588. Second handles 592 extend inwardly toward each other at a different angle from the angle at which first handles 588 extend inwardly toward each other. Cushioning grips 594 are provided on the ends of second handles 592. Fourth arm 522 may be utilized for a variety of different exercises such as pull-ups or chin-ups.

Fifth arm 523 is a generally U-shaped member that is mounted on exterior surface 538*b* of support member 538 by way of a mounting bracket 596. A first embodiment of fifth arm 523 is shown in FIG. 40. Fifth arm 523 may be mounted on support member 538 at a level that is aligned with approximately midway along length of first slot 544. Bracket 596 secures fifth arm 523 to support 514 in a fixed and unchangeable orientation. Fifth arm 523 may be oriented so that it is substantially horizontally mounted and is generally parallel to upper surfaces 524*a*, 526*a* of first and second base members 524, 526. A cushioning grip 598 is provided on each end of fifth arm 523. Fifth arm 523 may be used as a dip bar for performing triceps dips or other similar exercises.

Figure 43:
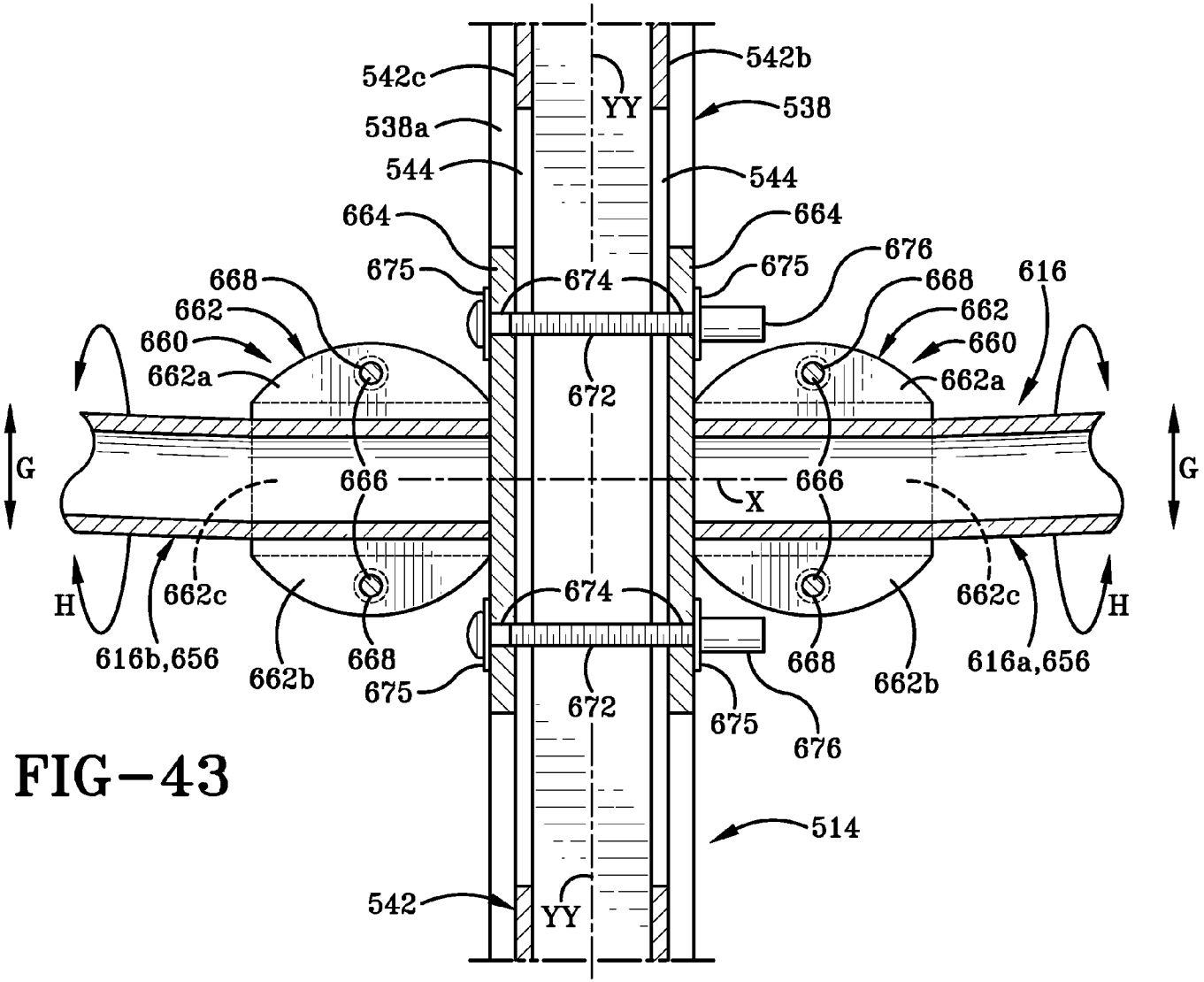
FIG. 43 is an enlarged cross-section of a second embodiment of the first arm of the fitness station taken along line 42-42 of FIG. 37.

FIG. 43 shows a second embodiment of the first arm, generally indicated at 616. First arm 616 may be adjustably mounted to support 514. In particular, the distance between first arm 616 and base 512 is selectively variable by moving first arm 616 toward or away from base 512. First arm 616, like first arm 516, is generally U-shaped when viewed from above and comprises a first section 616*a* and a second section 616*b*. First and second sections 616*a*, 616*b* are substantially identical to each other and are mounted in such a manner that they are mirror images of each other relative to support member 538. Each of the first and second sections 616*a*, 616*b* is generally L-shaped and comprises a generally laterally extending first arm portion 656 and a forward extending second arm portion (not shown in FIG. 43 but substantially identical to second arm portion 558). First and second sections 616*a*, 616*b* may be generally circular in cross section.

A clamping assembly 660 secures each first arm 656 to support member 538. Clamping assembly 660 includes a clamp 662 and a base plate 664. Clamp 662 is substantially identical to clamp 562 and functions in the same manner. Clamp 662 comprises a clamshell-type device comprising a first half and a second half that are substantially identical. Each of the first and second halves of the clamp 662 has a flat upper region 662*a* and a flat lower region 662*b* and a curved mid-section 662*c*. The radius of curvature of mid-section 662*c* is substantially identical to the radius of curvature of the first arms 656. One or the other of the first and second halves of clamp 662 is welded to plate 664. The other of the first and second halves of clamp 662 is not welded to plate 664. One end of first arm 656 of the associated first or second section 616*a*, 616*b* is received in the bore defined by curved mid-sections 662*c* clamp 662. Fasteners 666 pass through apertures 668 in upper and lower sections 662*a*, 662*b* and are tightened to clamp the end of first arm 656 therebetween. A handle (not shown in FIG. 43 but similar to handle 570) is used to rotate fasteners 666 in either of the first and second directions as described in reference to fasteners 566 and handles 570.

First arm 616 differs from first arm 516 in that plates 664 of clamping assemblies 660 link first and second sections 616*a*, 616*b* thereof in such a way that the sections 616*a*, 616*b* may be vertically adjustable in unison with each other. The first and second sections 616*a* and 616*b* may be connected together in any one of a number of ways, one of those possible ways being illustrated in FIG. 43. FIG. 43 shows that a first base plate 664 is detachably engaged with an end of first section 616*a* and a second base plate 664 is detachably engaged with an end of second section 616*b*. The first and second base plates 664 are located adjacent side surfaces 542*b*, 542*c* of box region 542 on support member 538. First and second base plates 664 are connected together in any suitable manner. One such manner is illustrated in FIG. 43; that way being the use of fasteners 672 which extend through aligned apertures 674 in first and second base plates 664 and through first slot 544. When connected in this manner, when the first base plate 664 slides up or down side surface 542*b*, then the second base plate 664 will also slide up or down side surface 542*c*. A handle 676 is engaged with each fastener 672. When handles 676 are rotated in a first direction, the associated fasteners 672 are slightly loosened and first and second base plates 664 are free to slide, in unison, either upwardly or downwardly relative to the associated side surface 542*b* or 542*c* of box region 542. As the base plates 664 move upwardly or downwardly along box region 42, the entire first arm 616 is raised or lowered relative to base members 524, 526. When the desired vertical position of first and second sections 616*a*, 616*b* is attained then handles 676 are rotated in a second direction to lock first and second base plates 664 in that vertical position.

A similar clamping arrangement may also be provided on second arm 518 to enable the entire second arm 518 to be vertically adjusted relative to base members 524, 526.

It will be understood that other mechanisms may be provided on fitness station 10 for linking first and second sections of either of the first and second arms 616, 518 together so that they move vertically as a unit. It will further be understood that if either of the first and second arms 616, 518 is comprised of two separate sections, such as sections 616*a* and 616*b*, then independent rotational motion "H" about the horizontal axis "XX" may still be possible.

It will further be understood that one or both of first and second arms 616, 518 may be comprised of a single unitary component instead of two separate sections and the unitary first or second arm 616, 518 may be caused to be vertically adjustable in any other fashion. Depending on the way this unitary first or second arm 616, 518 is mounted to support member 538, unitary rotational motion "H" about horizontal axis "XX" may also be possible.

Figure 44:
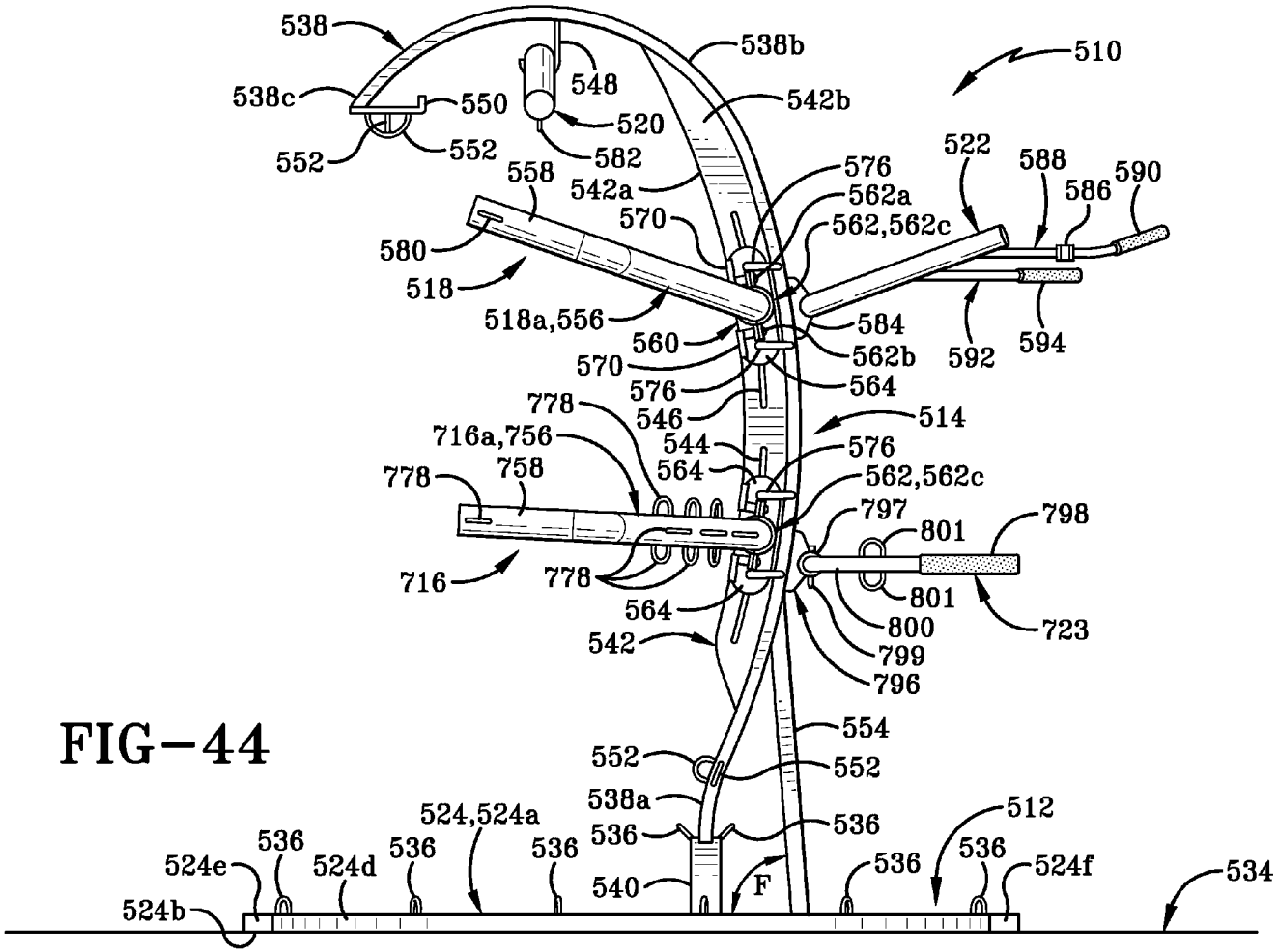
FIG. 44 is a right side view of the fitness station showing a third embodiment of the first arm of the fitness station and a second embodiment of the fifth arm thereof.
Figure 45:
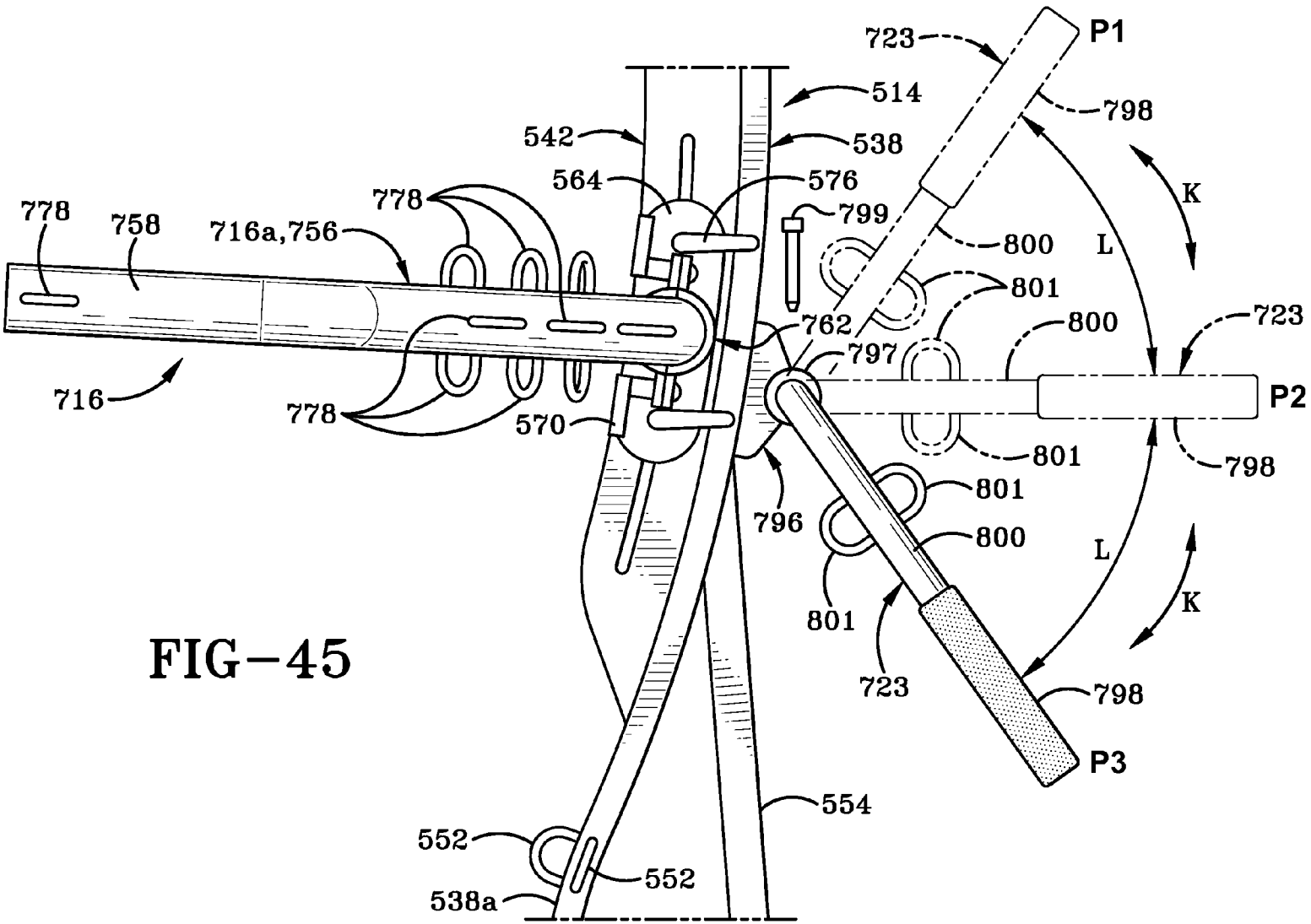
FIG. 45 is an enlarged right side view of a portion of the fitness station of FIG. 44 showing the fifth arm in an unlocked and rotated position.
Figure 46:
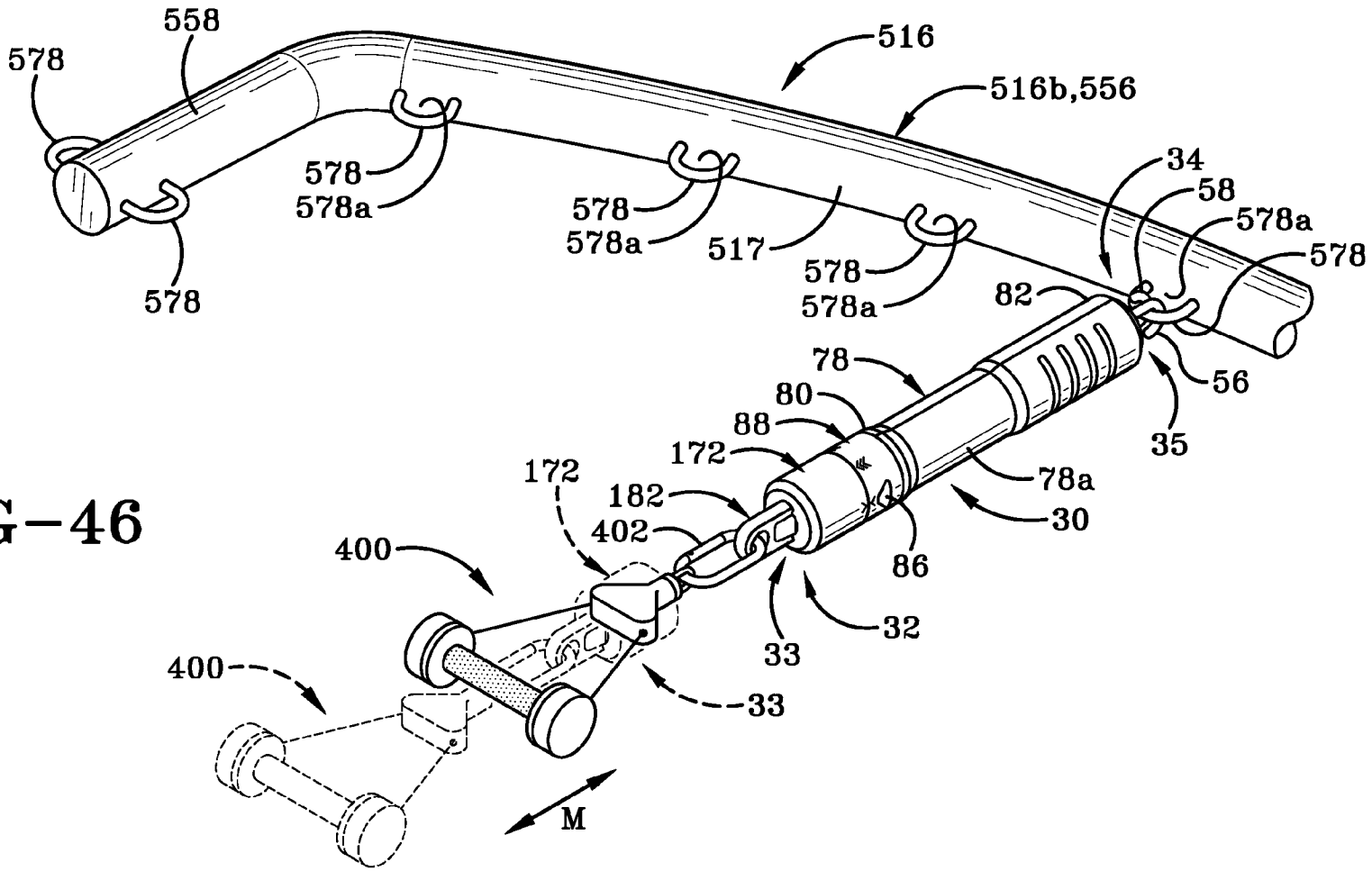
FIG. 46 is an enlarged perspective view of a portion of the first arm of the fitness station showing the resistance band assembly engaged therewith for the performance of an exercise.

Referring to FIGS. 44 and 45, fitness station 510 may be provided with a second embodiment of the fifth arm, generally indicated at 723. Fifth arm 723 is mounted to support member 538 by way of a mounting bracket 796. Mounting bracket 796 may be any type of bracket which permits fifth arm 723 to be selectively rotated relative to support member 538. For example, bracket 723 may be U-shaped with a sleeve 797 provided thereon. Shaft 800, which has cushioning grips 798 at either end, may be passed through sleeve 797 such that a central region of shaft 800 is located within sleeve 797. A spring member may be provided on bracket 796 to urge shaft 800 into a default rest position. In that rest position the fifth arm 723 may, for example, be generally horizontally oriented. Bracket 796 may permit fifth arm 723 to be selectively pivoted into one of a first position P1 (FIG. 45), a second position P2 and a third position P3 and then preferably locked into place to prevent accidental injury to the user or to others. The possible pivotal motion is indicated by arrow "K" in FIG. 45. First position P1 and second position P2 are shown in phantom in FIG. 45 and the third position P3 is shown in solid lines. Second position P2 is where shaft 800 of fifth arm 723 is generally horizontal and parallel to base members 524, 526 and may be the at rest position. First position P1 is where shaft 800 is located at an angle "L" above the horizontal second position P2. Third position P3 is where shaft 800 is located at an angle "L" below second position P2. Fifth arm 723 may be pivoted between first and third positions P1, P3 in some instances or may be pivoted only between first and second positions P1, P2 or between second and third positions P2, P3. Alternatively, fifth arm 723 may be reciprocally movable between positions P1, P2, and P3. The range of pivotal motion may be selectable by the user in order to perform different types of exercises.

It will be understood that the angle "L" may be a pre-determined angle set by the manufacturer of fitness station 510 by providing a suitable mounting bracket 796 that permits this pre-determined range of motion. By way of example only, angle "L" may be from about 20° to about 90° relative to the horizontal. Alternatively, bracket 796 may be of a type which permits the user to select how far down or how far up he or she wishes to pivot fifth arm 723. The user may be able to pivot fifth arm 723 downwardly by grasping grips 798 and pushing downwardly thereon. The user may be able to pivot fifth arm 723 upwardly by grasping grips 798 and pulling the same upwardly. This pivotal motion of fifth arm 723 may be utilized to perform exercises such as triceps-dips. Fifth arm 723 may be moved through 90° to move the arm out of the way during the performance of exercises that do not require this arm. Fifth arm 723 may also be rotated to collapse it against support member 538 for storage purposes or if fitness station 510 needs to be moved. (It should be noted that fourth arm 522 may also be secured to support member 538 by a bracket that enables fourth arm 522 to pivot out of the way during the performance of various exercises or for storage purposes or if fitness station 510 needs to be moved.)

Fifth arm 723 includes a locking member for securing fifth arm 723 against pivotal motion when selectively positioned in one or another of the first, second or third positions P1, P2, P3. One suitable locking member may be a pin 799 as shown in FIGS. 44 and 45. Pin 799 may be passed through aligned holes (not shown) in sleeve 797 and shaft 800 to lock the fifth arm 723 against pivotal motion (FIG. 44). When pin 799 is withdrawn from the aligned holes (as shown in FIG. 45), fifth arm 723 may be pivoted relative to support member 538 in the manner previously described herein. The locking member may be any other suitable locking mechanism that prevents or limits pivotal motion of fifth arm 723.

FIG. 44 also shows a third embodiment of the first arm, generally indicated in this figure at 716. First arm 716 includes additional attachment members 778 which may be provided at intervals on one or more of bottom, top, and rear surfaces of first arm 716 as well as on the front surface thereof.

In accordance with another aspect of the invention and as shown in FIG. 44, attachment members 801 may also be provided on upper and/or lower surfaces of shaft 800 of fifth arm 723. Some type of resistance band (not shown in these figures) may be engaged between any selected attachment member 801 on fifth arm 723 and any selected attachment member 778 of first arm 716 to increase the resistance to the pivotal motion of fifth arm 723 as indicated by arrow "K". This increased resistance may be desirable as a user gets fitter and stronger.

It will be understood that substantially all of the first, third, fourth, and fifth attachment members are illustrated herein as being spaced at regular intervals from each other along surfaces of the associated base 512, first arm 516/616/716, second arm 518, third arm 520, and fifth arm 723. The intervals may be about one foot apart on each of these components. However, the spacing intervals of the attachment members may be different for each of the components upon which they are provided. Alternatively, differently sized intervals between attachment members may be utilized along the length of any one or more of the components upon which the attachment members are provided. The specific placement of the various attachment members may therefore be other than illustrated herein and be determined in accordance with the types of exercise that will be able to be performed on fitness station 510.

It should further be noted that while the various attachment members 536, 552, 578 580, 582 are illustrated as being provided on only one surface of the associated arms, these attachment members may be provided on more than one surface of any one or more of the arms, such as is illustrated with respect to arm 716 (having attachment members 778) and arm 723 (having attachment members 801). For example, third attachment members 578 may be provided on a top surface, a bottom surface and a rear surface of first arm 516 in addition to the illustrated placement on the front surface thereof.

Additionally, the angles at which any of the attachment members 536, 552, 578, 580, 582, 778, 801 are provided on any particular arm may be other that what has been illustrated herein. Still further, not all the angles of the attachment members on a single arm need be of the same orientation relative to the surface of the arm or relative to each other. Some attachment members may be installed at right angles to the surface on which they are mounted or they may be at an angle other than ninety degrees thereto. Furthermore, not all the attachment members need to be aligned along the same plane or in the same orientation relative to each other on a single component. For example, on the first arm 516 attachment members 578 are all illustrated as being horizontally oriented. At least some of those attachment members 578 could be turned through ninety degrees relative to the surface on which they are mounted and could be vertically oriented or they may be mounted at angles other than ninety degrees.

Still further, it will be understood that attachment members may be provided on support member 538 and may further be provided on any surface on support member 538.

Fitness station 510 is used by securing one or more resistance assemblies with any one or more selected attachment members in order to perform a particular type of exercise with the resistance assembly. The attachment members and fitness station 510 acts as an anchor for these resistance assemblies. The types of exercises that may be performed using fitness station 510 have been more fully discussed in the parent application Ser. No. 13/836,359, the entire specification of which is incorporated herein by reference.

Referring now to FIG. 46, resistance band assembly 30 is shown selectively engaged with one of the first attachment members 578 on first arm 516 of fitness station 510 (FIG. 37). In particular, second attachment assembly 35 is shown selectively engaged with first attachment member 578. A workout accessory 400 is shown engaged with first attachment assembly 33.

Thus, referring to FIG. 46, there is disclosed in combination a fitness station 510 and assembly 30. Fitness station includes a base 512; a support 514 extending upwardly from base 512; a first arm 516 extending outwardly from support 514 a distance vertically above base 512; and a plurality of attachment members 578 provided on one or more of base 512, support 514 or first arm 516. Assembly 30 is selectively engageable with one of attachment members 578 and is operable to apply a resistive force during a performance of an exercise. Assembly 30 includes a housing that is at least partially rigid and a first resilient member 44 within the housing for providing the resistive force. The rigid part of the housing may be base member 78 and the first resilient member 44 is located within base member 78. The housing or at least base member 78 tends to maintain its shape during engagement of resistance band assembly 30 with the one of attachment members 578 on fitness station 510 and during the performance of the exercise. Base member 78 is secured to fitness station 510 by inserting first hook 56 or second hook 58 through an aperture 578*a* defined by the C-shaped ring of attachment member 578 and the surface upon which that ring is mounted. When the terminal end of one of the first or second hooks is inserted through aperture 578*a*, resistance band assembly 30 is twisted about its longitudinal axis 45 to engage the other of the hooks 56, 58 and thereby lock resistance band assembly 30 to the attachment member 578.

During use, a workout accessory such as handle 400 is selectively engaged with first attachment assembly 33. A pulling motion applied to workout accessory 400 causes first attachment assembly 33 to move away from first end 80 of base member 78 and this stretches first resilient member 44 from a first length to a second length and provides the resistive force to the pulling motion. If assembly 30 is selectively adjusted to engage the second or third disc 38, 40 therein so that more than one resilient member 44 is operatively engaged with first attachment assembly 33, then applying a pulling motion to first attachment assembly 33 will cause the additional resilient members 44 to be stretched from a first length to a second length and thereby increase the resistive force to the pulling motion.

It will be understood that engaging an collar 172 on base member 78 changes the resistive force applied by assembly 30. So, for example if collar 172 is operatively engaged with only a first resilient member 44, assembly 30 will provide a first resistive force to the pulling motion; if a second resilient member 44 is operatively engaged therewith, assembly 30 will provide a second resistive force to the pulling motion on first attachment assembly 33.

A method of performing a resistance exercise includes the steps of providing a fitness station 510 (FIG. 37) having a base 512, a support 514 extending upwardly from base 512; a first arm 516 extending outwardly from support 514, and a plurality of attachment members engaged with one of first arm 516, base 512 or support 514. FIG. 46 shows assembly 30 engaged with first attachment member 578 on first arm 516. The method further includes the step of providing resistance band assembly 30 comprising a base member 78 that is at least partially rigid and a first resilient member 44 (not shown in the Figure but shown in FIGS. 18 and 19) within the interior of base member 78 for providing the resistive force during the performance of an exercise. Base member 78 may be rigid along its entire length from first end 80 to second end 82 thereof or only portion of base member 78 may be rigid. That portion is sufficiently rigid enough to enable a user to engage assembly 30 with fitness station while supporting base member 78 in a single hand and such that assembly 30 does not become limp and flop over during this engagement. The method further includes the step of attaching assembly 30 to one of attachment members (such as 578) on fitness station 510; applying a pulling motion on assembly 30 during the performance of an exercise therewith; and generating a resistive force within assembly 30 in response to the applied pulling motion. The pulling motion as illustrated in FIG. 46 would include moving workout accessory 400 in a first direction away from first arm 516, i.e., generally along the longitudinal axis 45 (FIG. 38) of assembly 30. The generated resistive force will occur in a second direction opposite the first direction. The reciprocal pulling motion and resultant resistive force is illustrated by the arrow "M" in FIG. 46.

The step of attaching assembly 30 to fitness station 510 includes holding an exterior surface 78*a* (FIGS. 1 and 2B) of base member 78 of assembly 30 and introducing a terminal end of J-shaped hook 56 or 58 on one end 82 of base member 78 into an aperture 578*a* defined by one of the attachment members 578 on fitness station 510; and engaging hook 56 or 58 with attachment member 578. The step further includes twisting base member 78 to engage the other hook 56 or 58. The step of holding exterior surface 78*a* of base member 78 includes holding base member 78 in one hand.

The step of attaching assembly 30 to fitness station 510 may alternatively include inserting attachment member 578 on fitness station 510 between two laterally spaced-apart hooks 56 and 56 on one end 82 of base member 78. A terminal end 308 or 310 of one of hooks 56, 58, respectively, is inserted through aperture 578*a* defined between the C-shaped ring of attachment assembly 578 and a surface 517 of fitness station 510 to which attachment assembly 35 is mounted. Base member 78 is then rotated to engage the terminal end 308 or 310 of the other hook 56, 58 with the C-shaped ring and thereby secure assembly 30 to fitness station 510 by way of both hooks 56, 58.

Once assembly 30 is so engaged, the user may use fitness station 510 and assembly 30 to perform an exercise. This may include a step of applying a pulling motion "M" in a first direction to assembly 30 and this motion includes moving first attachment assembly 33 on a first end 80 of base member 78 away from the first end 80 of base member 78. The step of applying a pulling motion "M" further includes engaging workout accessory 400 with first attachment assembly 33 and then moving first attachment assembly 33 by pulling on the workout accessory 400. The pulling motion on the workout accessory 400 preferably occurs in a direction along the longitudinal axis 45 of assembly 30.

This motion in a first direction generates a resistive force inasmuch as the pulling motion causes first resilient member 44 within bore 84 of base member 78 to be stretched from a first length to a second length. If a second resilient member 44 or additional resilient members are provided within bore 84 and extend generally between first attachment assembly 33 and second attachment assembly 34, the second resilient member or additional resilient member may also be stretched from a first length thereof to a second length by moving first attachment assembly 33 away from first end 80 of base member 78. The more resilient members stretched in response to movement of first attachment assembly 33, the greater the resistive force applied by assembly 30.

The method may further include activating an adjustment selector 88/172 provided on base member 78 prior to stretching a second set of resilient members 44. The activating of the collar 172 has been previously described herein. The activating of collar 172 includes rotating a collar 172 at first end 80 of base member 78 to align a marking 177 on collar 172 with a marking 100 on base member 78. The step of rotating collar 172 includes rotating collar 172 to a first position (where marking 177 aligns with the marking 100 of a first chevron) to stretch the first resilient member only; rotating collar 172 to a second position (where marking 177 aligns with the marking 100 of a second chevron) to stretch the first and the second set of resilient members only; and rotating collar 172 to a third position (where marking 177 aligns with the marking 100 of a third chevron) to stretch the first resilient member, second set of resilient members and the additional set of resilient members.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

The invention claimed is:

1. A resistance assembly, comprising:

a housing that has a first attachment assembly proximate to a first end of the housing and a second attachment assembly proximate to a second end of the housing; and wherein the second attachment assembly is configured to be engaged to a structure;

a first resilient member for providing a first resistive force;

a second resilient member for providing a second resistive force; and an adjustment assembly which is selectively engageable with the first resilient member or both of the first and second resilient members; and when the adjustment assembly is engaged with only the first resilient member, the resistance assembly will provide the first resistive force to a pulling motion on the first attachment assembly; and when the adjustment assembly is engaged with both of the first and second resilient members; the resistance assembly will provide the first and second resistive forces to the pulling motion on the first attachment assembly;

wherein the adjustment assembly includes a selector rod that selectively engages the adjustment assembly with the first resilient member or both of the first and second resilient members.

2. The resistance assembly of claim 1, wherein the first attachment assembly is configured to be engaged with a workout accessory, and wherein a pulling motion applied to the workout accessory causes the first attachment assembly to move in a direction away from the second attachment assembly.

3. The resistance assembly of claim 2, wherein the movement of the first attachment assembly stretches the first resilient member from a first length to a second length and provides the first resistive force to the pulling motion when the adjustment assembly is engaged with only the first resilient member.

4. The resistance assembly of claim 3, wherein the movement of the first attachment assembly further stretches the second resilient member from a first length to a second length and provides the first and second resistive forces to the pulling motion when the adjustment assembly is engaged with the first and second resilient members.

5. The resistance assembly of claim 1, further comprising:

a connector proximate the second end of the housing, the connector having a first surface, an opposed second surface and a hole defined in the connector extending between the first and second surfaces;

wherein the first and second resilient members are removably engaged with the connector at a first end of the resilient members.

6. The resistance assembly of claim 5, further comprising:

a rigid rod extending proximate the adjustment assembly on a first rod end and a second rod end proximate to the first surface of the connector;

wherein the first and second resilient members are provided around a circumference of the rigid rod.

7. The resistance assembly of claim 5, wherein the first and second resilient members are removably engaged with the adjustment assembly at a second end of the resilient members.

8. The resistance assembly of claim 1, further comprising:

a third resilient member for providing a third resistive force;

wherein when the adjustment assembly is engaged with the first, second and third resilient members, the resistance assembly will provide the first, second and third resistive forces when pulled at the first end of the housing; and wherein the selector rod selectively engages the adjustment assembly with (i) the first resilient member; (ii) the first and second resilient members; or (iii) the first, second and third resilient members.

9. The resistance assembly of claim 8, wherein the first resilient member comprises at least two resilient members.

10. The resistance assembly of claim 1, wherein the housing is a tubular member which is substantially rigid from the first end to the second end thereof.

11. The resistance assembly of claim 1, wherein the first resilient member extends through the housing from proximate the first attachment assembly to proximate the second attachment assembly.

12. The resistance assembly of claim 1, wherein rotation of the selector rod allows engagement of the adjustment assembly with either the first resilient member or both of the first and second resilient members.

13. The resistance assembly of claim 1, wherein the adjustment assembly and selector rod are proximate the first end of the housing.

14. The resistance assembly of claim 1, wherein the selector rod further comprises:

a first pin extending outwardly from the selector rod and positioned to engage the adjustment assembly with the first resilient member when the selector rod is in a first position; and a second pin extending outwardly from the selector rod a distance along the selector rod from the first pin, wherein the second pin is positioned on the selector rod so as to engage the adjustment assembly with the second resilient member when the selector rod is in a second position.

15. A resistance assembly, comprising:

a rigid rod having a first end and a second end;

a connector proximate the second end of the rigid rod, the connector having a first surface, an opposed second surface and a hole defined in the connector extending between the first and second surfaces;

a first resilient member for providing a first resistive force;

a second resilient member for providing a second resistive force;

wherein said the first and second resilient members are removably engaged with the connector and are provided around a circumference of the rigid rod;

an adjustment assembly proximate the first end of the rigid rod, engageable with either the first resilient member or both of the first and second resilient members; wherein when the adjustment assembly is engaged with only the first resilient member, the resistance assembly will provide the first resistive force when pulled at the first end of the rigid rod, and when the adjustment assembly is engaged with both of the first and second resilient members, the resistance assembly will provide the first and second resistive forces when pulled at the first end of the rigid rod; and a selection mechanism configured to allow a user to select engagement of the adjustment assembly with the first resilient member or both of the first and second resilient members.

16. The resistance assembly of claim 15, further comprising a hollow housing having first section and a second section adjacent the first section, wherein the first and second sections of the housing are selectively separable to gain access to the first and second resilient members.

17. The resistance assembly of claim 15, further comprising:

a third resilient member for providing a third resistive force;

wherein when the adjustment assembly is engaged with the first, second and third resilient members, the resistance assembly will provide the first, second and third resistive forces when pulled at the first end of the rigid rod; and wherein the selection mechanism selectively engages the adjustment assembly with (i) the first resilient member; (ii) the first and second resilient members; or (iii) the first, second and third resilient members.

18. The resistance assembly of claim 15, wherein the selection mechanism comprises a selector rod that selectively engages the adjustment assembly with the first resilient member or both of the first and second resilient members.

19. The resistance assembly of claim 18, wherein the selector rod further comprises:

a first pin extending outwardly from the selector rod and positioned to engage the adjustment assembly with the first resilient member when the selector rod is in a first position; and a second pin extending outwardly from the selector rod a distance along the selector rod from the first pin, wherein the second pin is positioned on the selector rod so as to engage the adjustment assembly with the second resilient member when the selector rod is in a second position.

20. The resistance assembly of claim 15, wherein rotation of the selection mechanism allows engagement of the adjustment assembly with the first resilient member or both of the first and second resilient members.

21. The resistance assembly of claim 15, wherein the adjustment assembly and selection mechanism are proximate the first end of the rigid rod.

22. The resistance assembly of claim 15, wherein the first and second resilient members are removably engaged with the adjustment assembly at a second end of the resilient members.

23. The resistance assembly of claim 16, wherein the first resilient member comprises at least two resilient members.

* * * * *